US008689512B2

(12) United States Patent
Pervan

(10) Patent No.: US 8,689,512 B2
(45) Date of Patent: Apr. 8, 2014

(54) MECHANICAL LOCKING OF FLOOR PANELS WITH VERTICAL FOLDING

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 666 days.

(21) Appl. No.: 11/923,836

(22) Filed: Oct. 25, 2007

(65) Prior Publication Data

US 2008/0110125 A1 May 15, 2008

Related U.S. Application Data

(60) Provisional application No. 60/858,968, filed on Nov. 15, 2006.

(51) Int. Cl.

| | |
|---|---|
| ***E04B 2/08*** | (2006.01) |
| ***E04F 15/02*** | (2006.01) |
| ***E04F 15/04*** | (2006.01) |

(52) U.S. Cl.

CPC ..... *E04F 15/02038* (2013.01); *E04F 15/04* (2013.01)

USPC ..... 52/586.1; 52/391; 52/588.1; 52/748.11; 428/50

(58) Field of Classification Search

USPC ..... 52/390, 392, 533, 534, 539, 553, 578, 52/582.1, 586.31, 586.2, 588.1, 589.1, 52/590.2, 590.3, 591.1, 591.2, 591.3, 52/591.4, 591.5, 592.1, 592.2, 592.4, 52/745.08, 745.17, 747.1, 747.11, 748.1, 52/748.11; 403/334, 345, 364–368, 372, 403/375, 376, 381; 404/34, 35, 40, 41, 46, 404/47, 49–58, 68, 70; 428/44, 47–50, 57, 428/58, 60, 106, 192–194

See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |

(Continued)

FOREIGN PATENT DOCUMENTS

| | | | |
|---|---|---|---|
| CA | 2 252 791 | A1 | 5/1999 |
| CA | 2 456 513 | A1 | 2/2003 |

(Continued)

OTHER PUBLICATIONS

Boo, U.S. Appl. No. 12/362,977, entitled "Mechanical Locking of Floor Panels", filed Jan. 30, 2009.

(Continued)

*Primary Examiner* — William Gilbert

(74) *Attorney, Agent, or Firm* — Buchanan Ingersoll & Rooney PC

(57) ABSTRACT

Floor panels (1, 1', 1") are shown, which are provided with a mechanical locking system on long and short edges (5*a*, 5*b*, 4*a*, 4*b*) allowing installation with vertical folding and where the long edge (5*a*, 5*b*) locking system prevents separation of the short edges (4*a*, 4*b*) during the folding action.

54 Claims, 27 Drawing Sheets

(56) References Cited

U.S. PATENT DOCUMENTS

| | | | |
|---|---|---|---|
| 1,743,492 | A | 8/1927 | Sipe |
| 1,723,306 | A | 8/1929 | Sipe |
| 1,787,027 | A | 12/1930 | Wasleff |
| 1,809,393 | A | 6/1931 | Rockwell |
| 1,902,716 | A | 3/1933 | Newton |
| 1,925,070 | A | 8/1933 | Livezey |
| 1,995,264 | A | 3/1935 | Mason |
| 2,015,813 | A | 10/1935 | Nielsen |
| 2,026,511 | A | 12/1935 | Storm |
| 2,088,238 | A | 7/1937 | Greenway |
| 2,089,075 | A | 8/1937 | Siebs |
| 2,204,675 | A | 9/1937 | Grunert |
| 2,277,758 | A | 3/1942 | Hawkins |
| 2,303,745 | A | 12/1942 | Karreman |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,863,185 | A | 12/1958 | Riedi |
| 2,865,058 | A | 12/1958 | Andersson |
| 2,889,016 | A | 6/1959 | Warren |
| 3,023,681 | A | 3/1962 | Worson |
| 3,077,703 | A | 2/1963 | Bergstrom |
| 3,099,110 | A | 7/1963 | Spaight |
| 3,147,522 | A | 9/1964 | Schumm |
| 3,259,417 | A | 7/1966 | Chapman |
| 3,271,787 | A | 9/1966 | Clary |
| 3,325,585 | A | 6/1967 | Brenneman |
| 3,378,958 | A | 4/1968 | Parks et al. |
| 3,396,640 | A | 8/1968 | Fujihara |
| 3,436,888 | A | 4/1969 | Ottosson |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,554,850 | A | 1/1971 | Kuhle |
| 3,572,224 | A | 3/1971 | Perry |
| 3,579,941 | A | 5/1971 | Tibbals |
| 3,720,027 | A | 3/1973 | Christensen |
| 3,722,379 | A | 3/1973 | Koester |
| 3,731,445 | A | 5/1973 | Hoffmann et al. |
| 3,742,669 | A | 7/1973 | Mansfeld |
| 3,760,547 | A | 9/1973 | Brenneman |
| 3,760,548 | A | 9/1973 | Sauer et al. |
| 3,778,954 | A | 12/1973 | Meserole |
| 3,849,235 | A | 11/1974 | Gwynne |
| 3,919,820 | A | 11/1975 | Green |
| 3,950,915 | A | 4/1976 | Cole |
| 4,007,994 | A | 2/1977 | Brown |
| 4,030,852 | A | 6/1977 | Hein |
| 4,037,377 | A | 7/1977 | Howell et al. |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,107,892 | A | 8/1978 | Bellem |
| 4,113,399 | A | 9/1978 | Hansen, Sr. |
| 4,169,688 | A | 10/1979 | Toshio |
| 4,196,554 | A | 4/1980 | Anderson |
| 4,227,430 | A | 10/1980 | Jansson et al. |
| 4,299,070 | A | 11/1981 | Oltmanns et al. |
| 4,304,083 | A | 12/1981 | Anderson |
| 4,426,820 | A | 1/1984 | Terbrack |
| 4,447,172 | A | 5/1984 | Galbreath |
| 4,512,131 | A | 4/1985 | Laramore |
| 4,599,841 | A | 7/1986 | Haid |
| 4,648,165 | A | 3/1987 | Whitehorne |
| 4,819,932 | A | 4/1989 | Trotter, Jr. |
| 4,944,514 | A | 7/1990 | Suiter |
| 5,007,222 | A | 4/1991 | Raymond |
| 5,071,282 | A | 12/1991 | Brown |
| 5,135,597 | A | 8/1992 | Barker |
| 5,148,850 | A | 9/1992 | Urbanick |
| 5,173,012 | A | 12/1992 | Ortwein et al. |
| 5,182,892 | A | 2/1993 | Chase |
| 5,247,773 | A | 9/1993 | Weir |
| 5,272,850 | A | 12/1993 | Mysliwiec et al. |
| 5,295,341 | A | 3/1994 | Kajiwara |
| 5,344,700 | A | 9/1994 | McGath et al. |
| 5,348,778 | A | 9/1994 | Knipp et al. |
| 5,349,796 | A | 9/1994 | Meyerson |
| 5,465,546 | A | 11/1995 | Buse |
| 5,485,702 | A | 1/1996 | Sholton |
| 5,502,939 | A | 4/1996 | Zadok et al. |
| 5,548,937 | A | 8/1996 | Shimonohara |
| 5,577,357 | A | 11/1996 | Civelli |
| 5,598,682 | A | 2/1997 | Haughian |
| 5,618,602 | A | 4/1997 | Nelson |
| 5,634,309 | A | 6/1997 | Polen |
| 5,658,086 | A | 8/1997 | Brokaw et al. |
| 5,694,730 | A | 12/1997 | Del Rincon et al. |
| 5,755,068 | A | 5/1998 | Ormiston |
| 5,860,267 | A | 1/1999 | Pervan |
| 5,899,038 | A | 5/1999 | Stroppiana |
| 5,950,389 | A | 9/1999 | Porter |
| 5,970,675 | A | 10/1999 | Schray |
| 6,006,486 | A | 12/1999 | Moriau |
| 6,029,416 | A | 2/2000 | Andersson |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,203,653 | B1 | 3/2001 | Seidner |
| 6,254,301 | B1 | 7/2001 | Hatch |
| 6,295,779 | B1 | 10/2001 | Canfield |
| 6,314,701 | B1 | 11/2001 | Meyerson |
| 6,324,809 | B1 | 12/2001 | Nelson |
| 6,332,733 | B1 | 12/2001 | Hamberger et al. |
| 6,339,908 | B1 | 1/2002 | Chuang |
| 6,345,481 | B1 | 2/2002 | Nelson |
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,449,918 | B1 | 9/2002 | Nelson |
| 6,450,235 | B1 | 9/2002 | Lee et al. |
| 6,490,836 | B1 | 12/2002 | Moriau et al. |
| 6,505,452 | B1 | 1/2003 | Hannig |
| 6,536,178 | B1 | 3/2003 | Palsson et al. |
| 6,553,724 | B1 | 4/2003 | Bigler |
| 6,576,079 | B1 | 6/2003 | Kai |
| 6,591,568 | B1 | 7/2003 | Palsson |
| 6,601,359 | B2 | 8/2003 | Olofsson |
| 6,617,009 | B1 | 9/2003 | Chen et al. |
| 6,647,689 | B2 | 11/2003 | Pletzer |
| 6,647,690 | B1 | 11/2003 | Martensson |
| 6,651,400 | B1 | 11/2003 | Murphy |
| 6,670,019 | B2 | 12/2003 | Andersson |
| 6,681,820 | B2 | 1/2004 | Olofsson |
| 6,685,391 | B1 | 2/2004 | Gideon |
| 6,695,944 | B2 | 2/2004 | Courtney |
| 6,729,091 | B1 | 5/2004 | Martensson |
| 6,763,643 | B1 | 7/2004 | Martensson |
| 6,766,622 | B1 | 7/2004 | Thiers |
| 6,769,219 | B2 | 8/2004 | Schwitte et al. |
| 6,769,835 | B2 | 8/2004 | Stridsman |
| 6,802,166 | B1 | 10/2004 | Gerhard |
| 6,804,926 | B1 | 10/2004 | Eisermann |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,880,307 | B2 | 4/2005 | Schwitte et al. |
| 6,898,911 | B2 | 5/2005 | Kornfalt et al. |
| 6,922,965 | B2 | 8/2005 | Rosenthal et al. |
| 6,948,716 | B2 | 9/2005 | Drouin |
| 6,955,020 | B2 | 10/2005 | Moriau et al. |
| 6,966,963 | B2 | 11/2005 | O'Connor |
| 7,021,019 | B2 | 4/2006 | Knauseder |
| 7,040,068 | B2 | 5/2006 | Moriau et al. |
| 7,051,486 | B2 | 5/2006 | Pervan |
| 7,108,031 | B1 | 9/2006 | Secrest |
| 7,121,058 | B2 | 10/2006 | Palsson |

(56) References Cited

U.S. PATENT DOCUMENTS 7,127,860 B2 10/2006 Pervan et al.
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,275,350 B2 10/2007 Pervan et al.
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,302,367 B2 11/2012 Schulte
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,234 B2 10/2013 Pervan et al.
8,572,922 B2 11/2013 Pervan
2001/0024707 A1 9/2001 Andersson et al.
2002/0007608 A1 1/2002 Pervan
2002/0007609 A1 1/2002 Pervan
2002/0031646 A1 3/2002 Chen et al.
2002/0046433 A1 4/2002 Sellman et al.
2002/0056245 A1 5/2002 Thiers
2002/0069611 A1 6/2002 Leopolder
2002/0083673 A1 7/2002 Kettler et al.
2002/0092263 A1 7/2002 Schulte
2002/0170258 A1 11/2002 Schwitte et al.
2002/0170259 A1 11/2002 Ferris
2002/0178674 A1 12/2002 Pervan
2002/0178680 A1 12/2002 Martensson
2003/0009971 A1 1/2003 Palmberg
2003/0024199 A1 2/2003 Pervan
2003/0037504 A1 2/2003 Schwitte et al.
2003/0084636 A1 5/2003 Pervan
2003/0094230 A1* 5/2003 Sjoberg ..... 156/91
2003/0101674 A1 6/2003 Pervan et al.
2003/0101681 A1 6/2003 Tychsen
2003/0154676 A1 8/2003 Schwartz
2003/0180091 A1 9/2003 Stridsman
2003/0188504 A1 10/2003 Ralf
2003/0196405 A1 10/2003 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0107659 A1 6/2004 Glockl
2004/0123548 A1 7/2004 Gimpel et al.
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0182033 A1 9/2004 Wernersson
2004/0182036 A1 9/2004 Sjoberg et al.
2004/0200175 A1 10/2004 Weber
2004/0211143 A1* 10/2004 Hanning ..... 52/578
2004/0211144 A1 10/2004 Stanchfield
2004/0250492 A1 12/2004 Becker
2004/0261348 A1 12/2004 Vulin
2005/0028474 A1 2/2005 Kim
2005/0050827 A1 3/2005 Schitter
2005/0160694 A1 7/2005 Pervan
2005/0166514 A1 8/2005 Pervan
2005/0210810 A1 9/2005 Pervan
2005/0235593 A1 10/2005 Hecht
2005/0252130 A1 11/2005 Martensson
2006/0032168 A1 2/2006 Thiers et al.
2006/0070333 A1 4/2006 Pervan
2006/0101769 A1 5/2006 Pervan et al.
2006/0156670 A1 7/2006 Knauseder
2006/0236642 A1 10/2006 Pervan
2006/0260254 A1 11/2006 Pervan
2007/0006543 A1 1/2007 Engstrom
2007/0028547 A1 2/2007 Grafenauer
2007/0065293 A1 3/2007 Hannig
2007/0108679 A1 5/2007 Grothaus
2007/0151189 A1 7/2007 Yang
2007/0175156 A1 8/2007 Pervan et al.
2007/0193178 A1 8/2007 Groeke et al.
2007/0209736 A1 9/2007 Deringor
2008/0000185 A1 1/2008 Duernberger
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan et al.
2008/0104921 A1 5/2008 Pervan et al.
2008/0110125 A1 5/2008 Pervan
2008/0134607 A1 6/2008 Pervan et al.
2008/0134613 A1 6/2008 Pervan
2008/0134614 A1 6/2008 Pervan et al.
2008/0155930 A1 7/2008 Pervan et al.
2008/0172971 A1 7/2008 Pervan
2008/0216434 A1 9/2008 Pervan
2008/0216920 A1 9/2008 Pervan
2008/0236088 A1 10/2008 Hannig
2008/0295432 A1 12/2008 Pervan et al.
2009/0019806 A1 1/2009 Muehlebach
2009/0133353 A1 5/2009 Pervan et al.
2009/0193741 A1 8/2009 Cappelle
2009/0193748 A1 8/2009 Boo et al.
2009/0193753 A1 8/2009 Schitter
2009/0308014 A1 12/2009 Muehlebach
2010/0043333 A1 2/2010 Hannig
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0088344 A1 4/2011 Pervan et al.

(56) References Cited

U.S. PATENT DOCUMENTS

| | | | |
|---|---|---|---|
| 2011/0088345 | A1 | 4/2011 | Pervan |
| 2011/0154763 | A1 | 6/2011 | Bergelin et al. |
| 2011/0167750 | A1 | 7/2011 | Pervan |
| 2011/0225922 | A1 | 9/2011 | Pervan et al. |
| 2011/0252733 | A1 | 10/2011 | Pervan |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0279161 | A1 | 11/2012 | Håkansson et al. |
| 2013/0008117 | A1 | 1/2013 | Pervan |
| 2013/0014463 | A1 | 1/2013 | Pervan |
| 2013/0019555 | A1 | 1/2013 | Pervan |
| 2013/0042562 | A1 | 2/2013 | Pervan |
| 2013/0042563 | A1 | 2/2013 | Pervan |
| 2013/0042564 | A1 | 2/2013 | Pervan |
| 2013/0042565 | A1 | 2/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |
| 2013/0160391 | A1 | 6/2013 | Pervan et al. |
| 2013/0232905 | A2 | 9/2013 | Pervan |
| 2013/0239508 | A1 | 9/2013 | Darko et al. |

FOREIGN PATENT DOCUMENTS

| | | | |
|---|---|---|---|
| CA | 2 252 791 | C | 5/2004 |
| CA | 2 618 496 | A1 | 2/2007 |
| CN | 1270263 | A | 10/2000 |
| DE | 2 159 042 | A1 | 6/1973 |
| DE | 33 43 601 | A1 | 6/1985 |
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A1 | 5/1997 |
| DE | 198 54 475 | A1 | 7/1999 |
| DE | 299 22 649 | U1 | 4/2000 |
| DE | 199 40 837 | A1 | 11/2000 |
| DE | 199 58 225 | A1 | 6/2001 |
| DE | 202 05 774 | U1 | 8/2002 |
| DE | 103 16 695 | A1 | 10/2004 |
| DE | 203 20 799 | U1 | 4/2005 |
| DE | 10 2004 055 951 | A1 | 7/2005 |
| DE | 10 2004 001 363 | A1 | 8/2005 |
| DE | 10 2004 054 368 | A1 | 5/2006 |
| DE | 198 54 475 | B4 | 6/2006 |
| DE | 10 2005 024 366 | A1 | 11/2006 |
| DE | 10 2006 037 614 | B3 | 12/2007 |
| EP | 0 013 852 | A1 | 8/1980 |
| EP | 0 652 340 | A1 | 5/1995 |
| EP | 0 871 156 | A2 | 10/1998 |
| EP | 0 974 713 | A1 | 1/2000 |
| EP | 1 045 083 | A1 | 10/2000 |
| EP | 1 120 515 | A1 | 8/2001 |
| EP | 1 146 182 | A2 | 10/2001 |
| EP | 1 045 083 | B1 | 10/2002 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| FR | 1.138.585 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 3-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-180333 | A | 7/1995 |
| JP | 7-300979 | A | 11/1995 |
| JP | 7-310426 | A | 11/1995 |
| JP | 10-219975 | A | 8/1998 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 98/22677 | A1 | 5/1998 |
| WO | WO 98/38401 | A1 | 9/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/07729 | A1 | 2/2001 |
| WO | WO 01/48332 | A1 | 7/2001 |
| WO | WO 01/51732 | A1 | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/092342 | A1 | 11/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/06877 | A1 | 2/2004 |
| WO | WO 2004/020764 | A1 | 3/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/116926 | A1 | 9/2009 |
| WO | WO 01/02670 | A1 | 1/2011 |

OTHER PUBLICATIONS

Pervan, Darko, et al., U.S. Appl. No. 12/868,137, entitled "Mechanical Locking System for Floor Panels," filed in the U.S. Patent and Trademark Office on Aug. 25, 2010.

International Search Report issued in corres. PCT/SE2007/050781, Mar. 7, 2008, Swedish Patent Office, Stockholm, SE.

(56) References Cited

OTHER PUBLICATIONS

Pervan, et al., U.S. Appl. No. 12/518,584, filed Jun. 10, 2009, entitled, "Mechanical Locking of Floor Panels".
Pervan, Darko, et al, U.S. Appl. No. 12/788,384, entitled "Mechanical Locking of Floor Panels With a Flexible Bristle Tongue," filed in the U.S. Patent and Trademark Office on May 27, 2010.
Pervan, Darko, et al, U.S. Appl. No. 12/910,138, entitled "Mechanical Locking of Floor Panels With a Flexible Bristle Tongue," filed in the U.S. Patent and Trademark Office on Oct. 22, 2010.
Pervan, Darko, U.S. Appl. No. 12/941,760, entitled "Floorboard, System and Method for Forming a Flooring, and a Flooring Formed Thereof," filed in the U.S. Patent and Trademark Office on Nov. 8, 2010.
Pervan, Darko, et al., U.S. Appl. No. 12/865,136, entitled "Mechanical Locking of Floor Panels, Methods to Install and Uninstall Panels . . . ," filed Oct. 7, 2010.
Pervan, Darko, U.S. Appl. No. 12/962,341, entitled "Mechanical Locking System for Panels and Method of Installing Same," filed in the U.S. Patent and Trademark Office on Dec. 7, 2010.
*Plaintiff'S First Amended Complaint and Counterclaim on Reply, Akzenta Paneele + Profile GmbH and W. Classen GmbH & Co. KG* v. *Shaw Industries Group, Inc. and Valinge Innovation AB and Darko Pervan*, United States District Court for the Eastern District of Texas, Marshall Division, Case No. 2:10-CV-16, dated Nov. 30, 2010, and attachments thereto.
European prosecution file history, European Patent No. 1863984 (Appln. No. 06700664), dated Oct. 5, 2006 to Sep. 9, 2010.
Pervan Darko, U.S. Appl. No. 13/253,283, entitled "Mechanical Locking System for Floor Panels," filed in the U.S. Patent and Trademark Office on Oct. 5, 2011.
Pervan, Darko, et al., U.S. Appl. No. 13/232,467, entitled "Mechanical Locking for Panels and Method of Installing Same," filed in the U.S. Patent and Trademark Office on Sep. 14, 2011.
Extended European Search Report issued in EP 07 835 365.3, Apr. 11, 2011, 11 pages, European Patent Office, Munich, DE.
Pervan, Darko, et al., U.S. Appl. No. 13/146,731, entitled "Mechanical Lockings of Floor Panels and a Tongue Blank," filed in the U.S. Patent and Trademark Office on Jul. 28, 2011.
Pervan, Darko, et al., U.S. Appl. No. 13/195,297, entitled "Mechanical Locking of Floor Panels With a Flexible Bristle Tongue," filed in the U.S. Patent and Trademark Office on Aug. 1, 2011.
Pervan, Darko, U.S. Appl. No. 12/977,399, entitled "Mechanical Locking System for Floor Panels," filed in the U.S. Patent and Trademark Office on Dec. 23, 2010.
Pervan, Darko, et al., U.S. Appl. No. 13/020,456, entitled "Mechanical Locking System for Floor Panels," filed in the U.S. Patent and Trademark Office on Feb. 3, 2011.
Pervan, Darko, et al., U.S. Appl. No. 13/158,776, entitled "Mechanical Locking System for Floor Panels," filed in the U.S. Patent and Trademark Office on Jun. 13, 2011.
Laminate Flooring Tips (http://flooring.lifetips.com/cat/61734/laminate-flooring-tips/index.html), 12 pages Copyright 2000.
Pervan, Darko, et al., U.S. Appl. No. 13/426,115 entitled "Mechanical Locking System for Floor Panels," filed in the U.S. Patent and Trademark Office on Mar. 21, 2012.
Pervan, Darko, et al., U.S. Appl. No. 13/577,042, entitled "Mechanical Locking System for Floor Panels," filed in the U.S. Patent and Trademark Office on Aug. 3, 2012.
Pervan, Darko, et al., U.S. Appl. No. 13/329,019 entitled "Mechanical Locking of Panels," filed in the U.S. Patent and Trademark Office on Dec. 16, 2011.
Boo, Christian, U.S. Appl. No. 61/620,246, entitled "Method for Producing a Mechanical Locking System for Building Panels," filed in the U.S. Patent and Trademark Office on Apr. 4, 2012.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Pervan, Darko, et al., U.S. Appl. No. 13/758,603, entitled "Mechanical Locking System for Panels and Method of Installing Same," filed in the U.S. Patent and Trademark Office Feb. 4, 2013.
Pervan, Darko, et al., U.S. Appl. No. 13/886,916, entitled "Mechanical Locking of Building Panels," filed in the U.S. Patent and Trademark Office on May 3, 2013.
Boo, Christian, U.S. Appl. No. 13/855,966, entitled "Building Panel with a Mechanical Locking System," filed in the U.S. Patent and Trademark Office on Apr. 3, 2013.
Boo, Christian, et al., U.S. Appl. No. 13/855,979, entitled "Method for Producing a Mechanical Locking System for Building Panels," filed in the U.S. Patent and Trademark Office on Apr. 3, 2013.
Pervan, Darko, U.S. Appl. No. 13/540,107, entitled "Mechanical Locking of Floor Panels with a Glued Tongue," filed in the U.S. Patent and Trademark Office on Jul. 2, 2012.
Pervan, Darko, U.S. Appl. No. 13/544,281, entitled "Mechanical Locking System for Floor Panels," filed in the U.S. Patent and Trademark Office on Jul. 9, 2012.
Pervan, Darko, et al., U.S. Appl. No. 13/546,569, entitled "Mechanical Locking System for Floor Panels," filed in the U.S. Patent and Trademark Office on Jul. 11, 2012.
Pervan, Darko, et al., U.S. Appl. No. 13/585,204, entitled "Mechanical Locking System for Floor Panels," filed in the U.S. Patent and Trademark Office on Aug. 14, 2012.
Pervan, Darko, et al., U.S. Appl. No. 13/585,485, entitled "Mechanical Locking System for Floor Panels," filed in the U.S. Patent and Trademark Office on Aug. 14, 2012.
Pervan, Darko, et al., U.S. Appl. No. 13/585,179, entitled, "Mechanical Locking System for Floor Panels," filed in the U.S. Patent and Trademark Office on Aug. 14, 2012.
Pervan, Darko, et al., U.S. Appl. No. 13/596,988, entitled, "Mechanical Locking System for Floor Panels," filed in the U.S. Patent and Trademark Office on Aug. 28, 2012.
Pervan, Darko, et al., U.S. Appl. No. 13/660,538, entitled "Mechanical Locking of Floor Panels with Vertical Snap Folding," filed in the U.S. Patent and Trademark Office on Oct. 25, 2012.
Pervan, Darko, et al., U.S. Appl. No. 13/670,039, entitled "Mechanical Locking of Floor Panels with a Flexible Tongue," filed in the U.S. Patent and Trademark Office on Nov. 6, 2012.
Pervan, Darko, et al., U.S. Appl. No. 13/728,121, entitled "Mechanical Locking of Floor Panels with a Flexible Tongue," filed in the U.S. Patent and Trademark Office on Dec. 27, 2012.
Boo, Christian, U.S. Appl. No. 61/620,233, entitled "Building Panel with a Mechanical Locking System," filed in the U.S. Patent and Trademark Office on Apr. 4, 2012.
Pervan, Darko, et al., U.S. Appl. No. 13/962,446 entitled "Mechanical Locking System for Floor Panels," filed in the U.S. Patent and Trademark Office on Aug. 8, 2013.
Pervan, Darko, U.S. Appl. No. 14/011,042 entitled "Mechanical Locking System for Floor Panels," filed in the U.S. Patent and Trademark Office on Aug. 27, 2013.
Pervan, Darko, et al., U.S. Appl. No. 14/011,121 entitled "Mechanical Locking System for Floor Panels with Vertical Snap Folding," filed in the U.S. Patent and Trademark Office on Aug. 27, 2013.
Pervan, Darko, U.S. Appl. No. 14/042,887 entitled "Mechanical Locking of Floor Panels with a Glued Tongue," filed in the U.S. Patent and Trademark Office on Oct. 1, 2013.
Pervan, Darko, et al., U.S. Appl. No. 14/046,235 entitled "Mechanical Locking of Floor Panels with a Flexible Tongue," filed in the U.S. Patent and Trademark Office on Oct. 4, 2013.
U.S. Appl. No. 61/774,749, Nygren, et al.
Nygren, Per, et al., U.S. Appl. No. 61/774,749, entitled "Building Panels Provided with a Mechanical Locking System," filed in the U.S. Patent and Trademark Office on Mar. 8, 2013.
Pervan, Darko, U.S. Appl. No. 14/080,105 entitled "Mechanical Locking of Floor Panels with Vertical Folding," filed in the U.S. Patent and Trademark Office on Nov. 14, 2013.
Pervan, Darko, et al., U.S. Appl. No. 14/095,052, entitled "Mechanical Locking of Floor Panels," filed in the U.S. Patent and Trademark Office on Dec. 3, 2013.

* cited by examiner

Prior Art

Prior Art

Prior Art

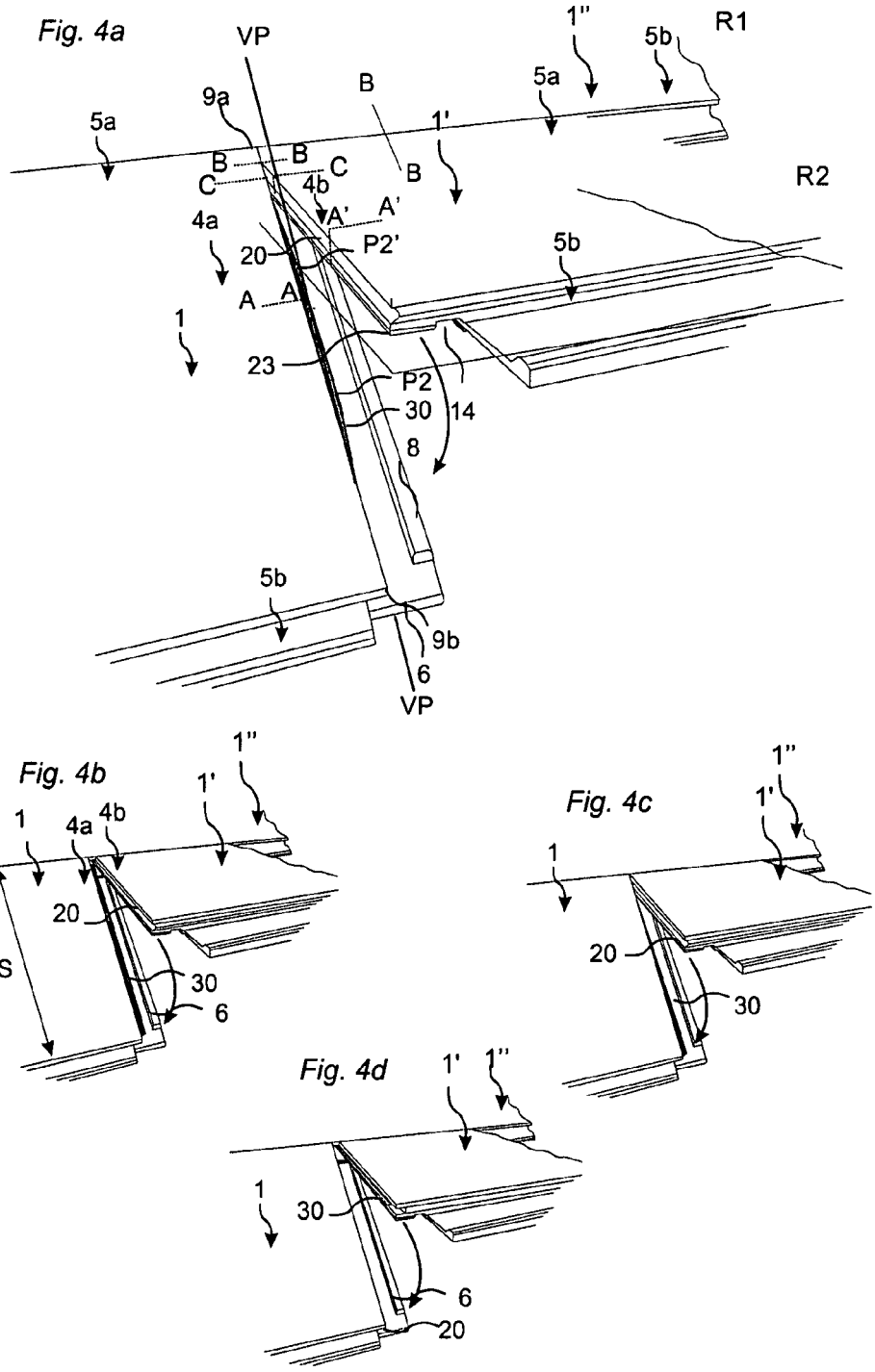
Prior Art

MECHANICAL LOCKING OF FLOOR PANELS WITH VERTICAL FOLDING

AREA OF INVENTION

The invention generally relates to the field of floor panels with mechanical locking systems with a flexible and displaceable tongue allowing easy installation. The invention provides new improved locking systems and installation methods.

BACKGROUND OF THE INVENTION

In particular, yet not restrictive manner, the invention concerns a mechanical locking system for rectangular floor panels with long and short edges. It should be emphasized that long and short edges are only used to simplify the description. The panels could also be square. However, the invention is as well applicable to building panels in general. More particularly the invention relates to the type of mechanically locking systems which allow that all four edges of a panel could be locked to other panels by a single angling action preferably comprising a flexible or partly flexible tongue and/or displaceable tongue and/or a flexible locking strip in order to facilitate the installation of building panels.

A floor panel of this type is presented in WO2006/043893, which discloses a floor panel with a locking system comprising a locking element cooperating with a locking groove, for horizontal locking, and a flexible tongue cooperating with a tongue groove, for locking in a vertical direction. The flexible tongue bends in the horizontal plane during connection of the floor panels and makes it possible to install the panels by vertical folding or solely by vertical movement. By "vertical folding" is meant a connection of three panels where a first and second panel are in a connected state and where a single angling action of a new panel referred to as the "folding panel", connects two perpendicular edges of the new panel, at the same time, to the first and second panel. Such a connection takes place for example when a long edge of the first panel in a first row is already connected to a long edge of a second panel in a second row. The new folding panel is then connected by angling to the long edge of the first panel in the first row. This specific type of angling action, which also connects the short edge of the new folding panel and second panel, is referred to as "vertical folding". The short edges are gradually folded together and locked from one edge part to the other as scissors when the panel is angled down to the subfloor. It is also possible to connect two panels by lowering a whole panel solely by vertical movement against another panel. This specific type of locking is referred to as "vertical locking" A first row in a flooring system, which is designed to be locked with vertical folding, is often connected with a vertical locking where one short edge is pressed down vertically towards an another short edge. The other rows are connected with vertical folding. It is also possible to install a complete floor by connecting a row with vertical locking. The whole row is than connected to a previous installed row by angling.

Similar floor panels are further described in WO2003/016654, which discloses locking system comprising a tongue with a flexible tab. The tongue is extending and bending essentially in a vertical direction and the tip of the tab cooperates with a tongue groove for vertical locking.

Vertical locking and vertical folding of this type creates a separation pressure at the short edges when the flexible tongue or flexible parts of the tongue are displaced horizontally during the angling of the long edges. The inventor has analysed several types of floor panels and discovered that there is a considerable risk that the short edges could be pushed away from each other during installation and that a gap could occur between the edge portions of the short edges. Such a gap could prevent further installation and the floor panels will not be possible to connect. It could also cause serious damage to the locking system at the short edges. Pushing the floorboards sideways towards the short edges during installation could prevent the gap. Such an installation method is however complicated and difficult to use since three actions have to be combined and used simultaneously in connection with angling down of the long edges as described below.

a) The edges of a new floor panel has to be brought in contact with a first floor panel laying on the floor and the long edge of the new panel has to be pressed forward in angled position towards the first panel
b) The new panel has to be displaced sideways, in the pressed and angled up position, and pressed sideways against a short edge of a second panel laying on the floor in order to counteract the counter pressure of the tongue
c) The new panel must finally be angled down to the floor and the forward and sideways pressure must be maintained during the angling action.

The inventor has discovered that separation and installation problems often occur when the panels have a small thickness and small compact locking systems on the long edges or when the panel core comprise a material with smooth surfaces such as high density fibreboard (HDF). Such problems could also occur when the panels are short or in connection with the installation of the first or last panel in each row since such installation is generally made with panels which are cut to a smaller length in order to adapt the floor to the wall position. Separation problems are of course extremely difficult to handle in any type of panels using locking systems with a strong flexible tongue that creates a substantial horizontal separation pressure during the vertical folding. Such strong tongues are very important in many applications where a high quality vertical connection is required and panels with such flexible tongues are very difficult to install with the known installation methods.

The invention aims to solve separation problems in flooring which is intended to be installed with vertical folding or vertical locking.

Definition of Some Terms

In the following text, the visible surface of the installed floor panel is called "front face", while the opposite side of the floor panel, facing the sub floor, is called "rear face". The edge between the front and rear face is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane.

By "joint" or "locking system" are meant co acting connecting means, which connect the floor panels vertically and/or horizontally. By "mechanical locking system" is meant that joining can take place without glue. Mechanical locking systems can in many cases also be combined with gluing. By "integrated with" means formed in one piece with the panel or factory connected to the panel.

By a "flexible tongue" is meant a separate tongue which has a length direction along the joint edges and which is forming a part of the vertical locking system and could be displaced at least partly horizontally during locking. The whole tongue could for example be bendable or it could have flexible and resilient parts that can be bend to a locked position or that could bent and spring back to its initial position.

By "angling" is meant a connection that occurs by a turning motion, during which an angular change occurs between two parts that are being connected, or disconnected. When angling relates to connection of two floor panels, the angular motion takes place with the upper parts of joint edges at least partly being in contact with each other, during at least part of the motion.

By an "angling locking system" is meant a mechanical locking system which could be connected vertically and horizontally with angling comprising a tongue and a grove that locks two adjacent edges in a vertical direction and a locking strip with a locking element in one edge of a panel called "strip panel" that cooperates with a locking groove on another edge of a panel called "grove panel" and locks the edges in a horizontal direction. The locking element and the locking groove have generally rounded guiding surfaces that guide the locking element into the locking groove and locking surfaces that locks and prevents horizontal separation between the edges.

With "installation angle" is meant the generally used angel between two panels which are in the initial stage of an angling installation when one panel is in an upwardly angled position and pressed with its upper edge against the upper edge of another panel laying flat on the sub floor. The installation angle is generally about 25 degrees and in this position there is only two contact points between the strip panel and the grove panel. In very special cases, where there may be more than two contact points between the connectors, the installation angle is higher then 25 degrees.

With "three point contact angle" is meant the angle between two floor panels during angling when there are at least three contact points between parts of the locking system.

With "contact angle" is meant the angle of the folding panel when the short edge of one panel is brought in the initial contact with the part of the flexible tongue which is intended to be displaced horizontally and which is active in the vertical locking at the short edges.

With "guiding angle" is meant the angle between two floor panels during angling when guiding surfaces of the locking element on the locking strip and/or on the locking groove are in contact with each other or with the upper part of the locking element or the lower part of the locking groove respectively. Guiding surfaces are often rounded or bevelled parts that during angling press the upper edges of the panels towards each other and facilitate the insertion of the locking element into the locking groove. Most locking systems on the market have a guiding angle of about 5 degrees.

With "locking angle" is meant the angle between two floor panels at a final stage of an angling action when the active locking surfaces on the locking element and the locking groove are in an initial contact with each other. Most locking systems have locking angles of about 3 degrees or lover.

With "friction angle" is meant the angle when a friction along long edges increase considerably during angling from an installation angle due to the fact that more than two contact points are active in an angling locking system and counteracts displacement along the long edges.

With "tongue pressure" is meant the pressure in N when a tongue is in a predetermined position. With "maximum tongue pressure" is meant the pressure of the tongue when it is in the inner position during vertical folding and with "tongue pre tension" is meant the tongue pressure in locked position when the tongue presses against a part of the tongue grove.

SUMMARY

The disclosure aims at a set of floor panels or a floating flooring with a mechanical locking system which will improve installation of floor panel installed with vertical folding and which will counteract or prevent separation of the short edges during installation.

The disclosure is based on a first basic understanding that such separation problems are mainly related to the locking system at the long edges. All known locking systems, that are used to lock panels with angling, are very easy to displace along the joint when the floor panels are in an initial angled position in relation to each other. The friction increases considerably at a low angle, when the floor panels are almost in a locked position. This means that the friction between the long edges is not sufficient to prevent displacement of the short edges during the initial stage of the vertical folding when the angle is high and when a part of the flexible tongue has to be pressed horizontally in order to allow the vertical folding. The friction between long edges will in most locking systems increase at a low angle but this is a disadvantage since the short edges could already have been separated and the locking system on the short edge is not capable to overcome the friction in a low angle and to pull together the short edges. The separation makes installation more complicated since panels have to be angled and pressed sideway during installation and there is a considerable risk that the locking system on the short edge will be damaged.

An objective of the invention is to solve the separation problem between the short edges by, contrary to the present technology, increasing the friction between the long edges, when the long edges are in an angled position and prior to their final locked position. The increased friction between the long edges could counteract or even prevent displacement along the joint of the long edges during the vertical folding when the flexible tongue is pressing the floor panels away from each other and it could counteract or even completely prevent separation of the short edges during such installation.

The disclosure is based on a second understanding that the combined function of the long edge locking system and the short edge locking system is essential in a floor, which is designed to be installed with vertical folding. Long and short edge locking systems should be adapted to each other in order to provide a simple, easy and reliable installation.

The disclosure provides for new embodiments of locking systems at long and short edges according to different aspects offering respective advantages. Useful areas for the invention are floor panels of any shape and material e.g. laminate; especially panels with surface materials contain thermosetting resins, wood, HDF, veneer or stone.

The disclosure comprises according a first principle floor panels with long edges having a locking system that at an angle, larger than used by the present known technology, counteracts displacement along the joint when panels are connected with vertical folding.

According to one embodiment of the first principle, the invention provides for a set of essentially identical floor panels each comprising long and short edges and provided with first and second connectors integrated with the floor panels. The connectors are configured to connect adjacent edges. The first connector comprises a locking strip with an upwardly directed locking element at an edge of one floor panel and a downwardly open locking groove at an adjacent edge of another floor panel for connecting the adjacent edges horizontally in a direction perpendicular to the adjacent edges. The second connector comprises a tongue at an edge of one floor panel, extending horizontally perpendicular to the edge and a horizontally open tongue groove in an adjacent edge of another floor panel for connecting the adjacent edges in vertical direction. The connectors at the long edges are configured to be locked with angling and the connectors at the short edge are configured to be locked with vertical folding. A long edge of a new panel in a second row is configured to be connected to a long edge of a first panel in a first row by angling. A short edge of the new panel and a short edge of a second panel in a second row are configured to be connected with the same angle motion. The connectors of the long edges have at least three separate contact points or contact surfaces between adjacent parts of the connectors when the new panel is pressed with its upper edge against the upper edge of the first panel at an angle against the principal plane of at least 10 degrees.

As the floor panel according to the first principle of the invention is provided with long edges which at an angling angle of 10 degrees have three contact points, a considerable friction between long edges will be created and this friction will counteract or prevent displacement of the short edges caused by the pressure of the tongue during the vertical folding. The advantage is that the flexible tongue could be formed and positioned on the short edge with an initial contact point which is located close to the long edge, for example at a distance of about 15 mm from the long edge, and this will allow a vertical locking over a substantial length of the short edge.

Improved installation function could be obtained in some embodiments if the three point contact angle is greater than 10 degrees, preferably 15 degrees or higher. In other embodiments, more than 18 or even more than 20 degrees are required to obtain an easy installation.

According to a second principle of the invention, the position and shape of a preferably flexible tongue at the short edge and the locking system on the long edges are such that the friction along the long edges will increase when the panel is angled downwards from an installation angle to a contact angle when the flexible tongue due to the vertical folding action will come into initial contact with the adjacent short edge and when further angling will cause a first flexible edge of the flexible tongue to be displaced horizontally and to create a horizontal separation pressure of the short edges.

According to an embodiment of this second principle, the invention provides for a set of essentially identical floor panels each comprising long and short edges and provided with first and second connectors integrated with the floor panels. The connectors are configured to connect adjacent edges. The first connector comprises a locking strip with an upwardly directed locking element at an edge of one floor panel and a downwardly open locking groove at an adjacent edge of another floor panel for connecting the adjacent edges horizontally in a direction perpendicular to the adjacent edges. The second connector comprises a tongue at an edge of one floor panel, extending horizontally perpendicular to the edge and a horizontally open tongue groove in an adjacent edge of another floor panel for connecting the adjacent edges in vertical direction. The connectors at the long edges are configured to be locked with angling and the connectors at the short edge are configured to be locked with vertical folding. A long edge of a new panel in a second row is configured to be connected to a long edge of a first panel in a first row by angling. A short edge of the new panel and a short edge of a second panel in a second row are configured to be connected with the same angle motion. The tongue at the short edges is made of a separate material, connected to a connection groove and has a flexible part with an edge section located closest to the long edge of the first panel. The edge section is configured to be displaced horizontally during the folding and to cooperate with the tongue groove of an adjacent short edge for locking the floor panels together in a vertical direction. The first and second connectors on the long edges are configured such that a friction force along the long edges is lower in an installation angle than in a contact angle when the panels are pressed against each other with the same pressure force and with the upper joint edges in contact. The installation angle is 25 degrees and the contact angle is a lower angle corresponding to an initial contact between the edge section and the adjacent short edge.

The increased friction between the long edges at the contact angle could be obtained in many alternative ways for example by increasing the pressure between contact points and/or by increasing the size of contact surfaces at the contact points between the first and second connections and/or by increasing the contact points from 2 to 3 or from 3 to 4.

According to a third principle of the invention a locking system is provided on the long edges with friction means such that the friction will be high along the long edges in an angled position when there are only two contact points between the connectors on the long edges.

According an embodiment of this third principle the invention provides for a set of essentially identical floor panels each comprising long and short edges and provided with first and second connectors integrated with the floor panels. The connectors are configured to connect adjacent edges. The first connector comprises a locking strip with an upwardly directed locking element at an edge of one floor panel and a downwardly open locking groove at an adjacent edge of another floor panel for connecting the adjacent edges horizontally in a direction perpendicular to the adjacent edges. The second connector comprises a tongue at an edge of one floor panel, extending horizontally perpendicular to the edge and a horizontally open tongue groove in an adjacent edge of another floor panel for connecting the adjacent edges in vertical direction. The connectors at the long edges are configured to be locked with angling and the connectors at the short edge are configured to be locked with vertical folding. A long edge of a new panel in a second row is configured to be connected to a long edge of a first panel in a first row by angling. A short edge of the new panel and a short edge of a second panel in a second row are configured to be connected with the same angle motion. The tongue at the short edges is made of a separate material, connected to a connection groove and has a flexible part which is configured to be displaced horizontally during the folding and to cooperate with the tongue groove of an adjacent short edge for locking the floor panels together in a vertical direction. The first and second connectors on the long edges comprise friction means configured to increase friction along the long edges when the panels are in an angle where there are only two contact points between the first and second connectors.

The friction means could or could not be active at lower angles when there are three or more contact points in the locking system.

The third principle offer the advantages that friction along the long edges could be high even at a high angle for example at the installation angle and this could be used in connection with an installation method where an edge of the flexible tongue is compressed by the displacement of the long edge during an initial stage of the vertical folding as shown in FIGS. 4*b* and 4*c*. The friction means will prevent or counteract displacement along the long edges and separation of the short edges during vertical folding.

Such friction means could comprise mechanically formed devices as for example small protrusions formed by rotating tools or pressure wheels on parts of the locking system for example on the tongue and/or on the locking strip. They could also comprise chemicals or small particles, which are applied in the locking system in order to increase friction along the long edges.

According to a fourth principle of the invention a flooring system with a locking system on the long and short edges is provided where the floor panels could be locked with vertical folding and where the position, shape and material properties of a preferably flexible tongue on the short edge is combined with a long edge locking system comprising connectors which allow that a floor panel cut to a length of 20 cm could be connected to an other panel in the same row with vertical folding and that the friction between the long edges will prevent separation of the short edges.

According to one embodiment of this fourth principle a set of essentially identical floor panels each comprising long and short edges and provided with first and second connectors integrated with the floor panels. The connectors are configured to connect adjacent edges. The first connector comprises a locking strip with an upwardly directed locking element at an edge of one floor panel and a downwardly open locking groove at an adjacent edge of another floor panel for connecting the adjacent edges horizontally in a direction perpendicular to the adjacent edges. The second connector comprises a tongue at an edge of one floor panel, extending horizontally perpendicular to the edge and a horizontally open tongue groove in an adjacent edge of another floor panel for connecting the adjacent edges in vertical direction. The connectors at the long edges are configured to be locked with angling and the connectors at the short edge are configured to be locked with vertical folding. A long edge of a new panel in a second row is configured to be connected to a long edge of a first panel in a first row by angling. A short edge of the new panel and a short edge of a second panel in a second row are configured to be connected with the same angle motion. The tongue at the short edges is made of a separate material, connected to a connection groove and has a flexible part which is configured to be displaced horizontally during the folding and to cooperate with the tongue groove of an adjacent short edge for locking the floor panels together in a vertical direction. The connectors on long and short edges are configured such that the second and new panel, whereby one of said panels, cut to a length of about 20 cm, is not displaced away from the other panel when said panels are in a contact position at an installation angle and during the vertical folding.

The fourth principle offer the advantages that floor panels with such a locking system could be installed with high precision and that separation of short edges will not take place even when panels are cut to small pieces and installed as a first or a last panels in a row. A separation of some 0.01 mm could be sufficient to create problems and undesired gaps, which could be visible in a floor surface or where moisture could penetrate into the joint.

The second object of the invention is to provide an installation method to connect floor panels with vertical folding. The panels have an angling locking system on the long edges and a vertical folding system on the short edges for locking the panels vertically and horizontally, whereby a first and a second panel are laying flat on a sub floor with the long edges connected to each other, characterized in that the method comprises the steps of a) bringing a long edge of an angled new panel in contact with the upper part of a long edge of the first panel and
b) bringing a short edge of the new panel in contact with a short edge of the second panel, whereby the new panel is maintained in this position by the locking system on the long and/or short edges,
c) pressing a short edge section of the new panel downwards towards the sub floor and thereby connecting the first, second and third panel to each other with vertical folding This installation method allows that floor panels will be maintained in an angled up position by for example the upper part of a locking element and the lower part of a locking groove. This will facilitate installation since the installer could change hand position from bring a panel into an installation angle and than to a position suitable to press down the short edge section of this panel towards the sub floor. The advantage is that the combined actions of pressing together upper edges in an angle, pressing the panel sideways to avoid separation of short edges and folding down the panel to the floor, could be avoided and replaced by three separate and independent actions.

A third objective of the invention is to provide new locking system or combinations of locking systems that could be used on long and/or short edges and that are especially designed to reduce separation problems. These locking systems could of course be used separately to connect any type of floorboards or building panels on short and/or long edges.

According to a first aspect of this third objective a flexible tongue is provided that comprises two flexible parts, an inner flexible part which is located in an inner part of a displacement groove and an outer flexible part located at the outer part of the displacement groove and that locks into a tongue groove of an adjacent edge of another panel. The inner part is preferably more flexible than the outer part and could preferably be displaced to a greater extent than the outer more rigid part that locks the panels vertically. The invention makes it possible to combine strength and low displacement resistance.

According to a second aspect of this third objective a short edge locking system with a preferably flexible tongue is combined with a compact tongue lock system that could be locked with angling. Such a locking system is cost effective and the geometry is favourable and could be used to design a locking system that creates considerable friction along the long edge during angling. Such a tongue lock could replace the long edge locking system with a protruding strip in all principles and methods described above. This embodiment of the invention has a first connector which comprises a tongue with an upwardly directed locking element at an upper part of the tongue at an edge of one floor panel and a second connector comprising a downwardly extending locking groove located in an undercut tongue groove at an adjacent edge of another floor panel for connecting the adjacent edges horizontally and vertically. The connectors at the long edges are even in this embodiment configured to be locked with angling and the connectors at the short edge are configured to be locked with vertical folding. As an example it could be mentioned that according to the first principle, the connectors of the long edges have at least three separate contact points or contact surfaces between adjacent parts of the connectors when the new panel is pressed with its upper edge against the upper edge of the first panel at an angle against the principal plane of at least 10 degrees.

According to a third aspect of this third objective a short edge locking system with a preferably flexible tongue is provided which counteracts or prevents displacement of the long edges during vertical folding. The locking system comprises, as described before, a strip with a locking element and a separate flexible tongue in a strip panel, a tongue groove and a locking groove in the folding panel. The locking surface of the locking groove is essential vertical and parallel with the vertical plane VP and has preferably a height, which is at least 0.1 time the floor thickness. The locking system is preferably designed such that the locking element with its upper part of the locking surface is in contact with the lower part of the locking surface of the locking groove in a locking angle when there are no contacts between the fold panel and the flexible tongue. The essentially vertical locking surface will prevent separation when the tongue during further angling is in contact with the fold panel. A part of the locking surfaces are in a preferred embodiment located on a protrusion and in a cavity.

It is obvious that two or more or even all of the principles described above could be combined and that all embodiments of locking systems described in this application could be used in combinations or independently to connect long and/or short edges. The figures are only used to show examples of different embodiments, which could be used in various combinations on long and short edges in a same panel type or in different panel types intended to be connected to each other. All locking systems on long and/or short edges of a panel could be formed in one piece with the core or they could comprise separate materials, for example a separate tongue and/or strip, which could be integrated with the floor panel or connected during installation. Even the locking groove and/or the tongue groove could be made of separate materials. This means that the invention also comprises one piece locking systems on the short edges where parts of the locking system, such as for example the tongue and/or the strip and/or the locking element, are flexible and preferably comprise wood fibre based material, for example HDF, and which could be locked by vertical folding, provided that such locking systems create a separation force during locking. A separate wood fibre based material could also be fixed connected to the panel edge by for example gluing, and it could be machined to a locking system in the same way as the one piece system described above.

The invention is useful in all types of floorings. It is however especially suitable for short panels for example 40-120 cm where the friction along the long edges is low, for wide panels with a width of more than 20 cm since the flexible tongue is long and will create an extensive tongue pressure, and for panels with for example a core of HDF, compact laminate or plastic materials and similar where the friction is low due to very smooth and low friction surfaces in the locking system. The invention is also useful in thin panels, for example with a thickness of 6-9 mm, more preferably thinner 8 mm and thinner and especially is such panels with compact locking systems on long edges, for example with locking strips shorter than 6 mm, since such floor panels and such locking system will have small contact surfaces with low friction.

Several advantages could be reached with a flooring system configured according to one or several of the principles described above. A first advantage consists in that installation could be made in a simple way and no sideway pressure has to be applied during installation in order to prevent floorboards to separate at the short edges. A second advantage is that the risk of edge separation, which could cause cracks in the locking system during folding, is reduced considerably. A third advantage is that locking systems could be formed with more rigid and stronger tongues that could lock the panels vertically with higher strength and a substantial tongue pre tension. Such tongues with substantial maximal tongue pressure and pre tension pressure in locked position will create high separation forces during the vertical folding. A fourth advantage is that the flexible tongue could be positioned close to the long edge and a reliable locking function could be obtained in spite of the fact that such flexible tongue will create a separation pressure at a rather high contact angle.

A measurement of the initial contact friction and the installation friction should be made according to the following principles. The contact angle of a new floor board and a first floor board should be measured when a first edge section of the flexible tongue, which is active in the vertical locking, is in a first contact with the short edge during the initial stage of the vertical folding action. The contact friction along the long edge of a 200 mm sample should be measured at this contact angle when the panels are pressed against each other with a normal installation pressure of 10 N. The installation friction should be measured according to the same method at an installation angle of 25 degrees. The contact friction should be at least about 50% higher than the installation pressure.

Friction means comprising mechanical devices such as protrusions, brushed fibres, scraped edge and similar in a locking system are easy to detect. Chemicals are more difficult.

Another method should be used to measure increased friction due to friction means if it is not clear and obvious that mechanical devices, chemicals, impregnation, coating, separate materials etc have been used in order to increase friction between floorboards in an installation angle. A new locking system with essentially the same design as the original sample should be produced from the same original floor panels and core material. The friction should be measured at the same installation angle and pressure and the friction between the two samples, the original sample and the new sample, should be compared. This testing method assumes of course that the whole core does not contain friction-increasing materials.

A lot of HDF based floor panels on the market have been tested and the result is that a sample with a 200 mm long edge which is pressed against an other long edge with a pressure of 10 N at an angle of 25 degrees generally have a friction of about 10 N or lower. This is too low to prevent displacement of the short edges during vertical folding. Friction means could increase the friction considerably.

The contact angle is defined as the angle of the new panel when an edge is in initial contact with the part of the flexible tongue, which is intended to be displaced, and is active in the vertical locking. There could be for example protrusions at the edge of the tongue that are not causing any major horizontal pressure during vertical folding. Such protrusions and similar devices should not be considered to be a part of the flexible tongue.

All references to "a/an/the [element, device, component, means, step, etc]" are to be interpreted openly as referring to at least one instance of said element, device, component, means, step, etc., unless explicitly stated otherwise.

BRIEF DESCRIPTION OF THE DRAWINGS

FIGS. 4*a-d* show how short edges of two floor panels could be locked with vertical folding according to known technology.

DESCRIPTION OF EMBODIMENTS OF THE INVENTION

FIGS. 1-6 and the related description below describe published embodiments and are used to explain the major principles of the invention and to show examples of embodiments that could be used in the invention. The showed embodiments are only examples. It should be emphasized that all types of flexible tongues and one piece tongues which could be used in a locking system allowing vertical folding and/or vertical locking, could be used and applicable part of this description form a part of the present invention.

A prior art floor panel 1, 1' provided with a mechanical locking system and a displaceable tongue is described with reference to FIGS. 1*a-d*.

Figure 1A:
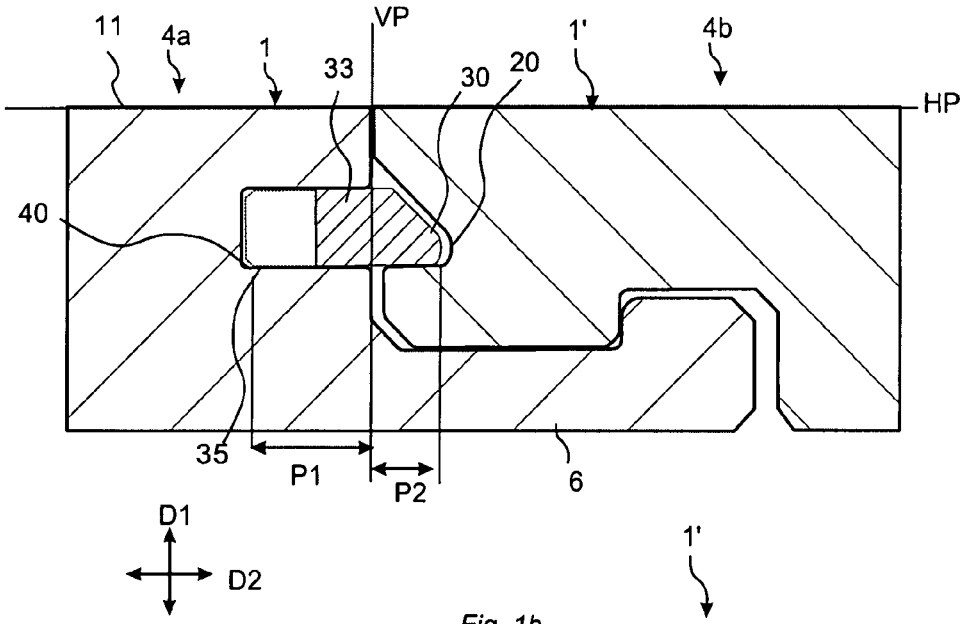
FIGS. 1*a-d* illustrate a known locking system
Figure 1B:
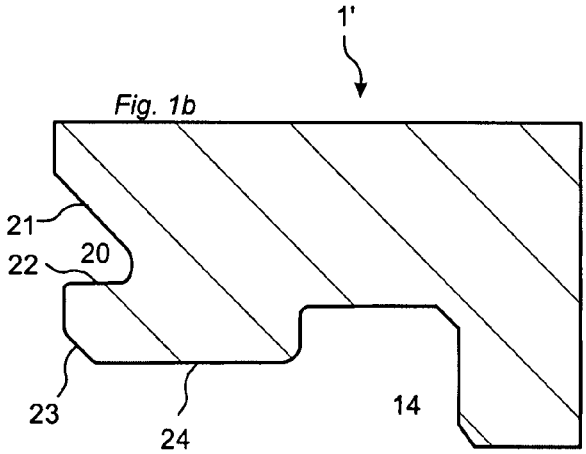
Figure 1C:
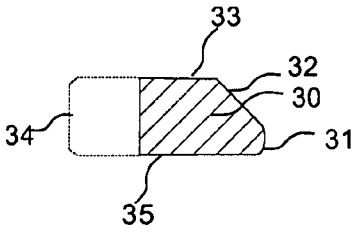
Figure 1D:
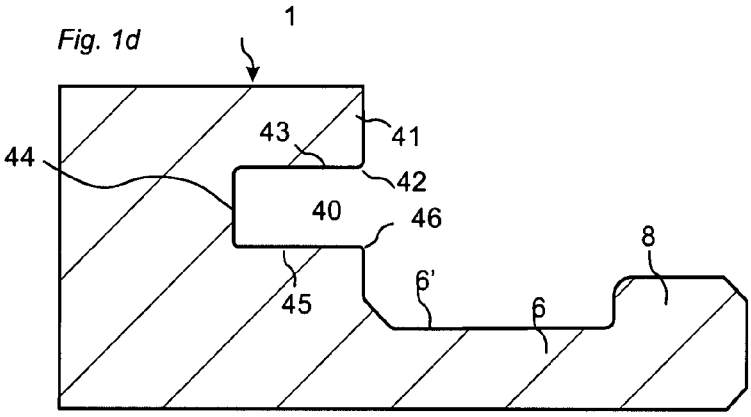

FIG. 1*a* illustrates schematically a cross-section of a joint between a short edge joint edge 4*a* of a panel 1 and an opposite short edge joint edge 4*b* of a second panel 1'.

The front faces of the panels are essentially positioned in a common horizontal plane HP, and the upper parts 21, 41 of the joint edges 4*a*, 4*b* abut against each other in a vertical plane VP. The mechanical locking system provides locking of the panels relative to each other in the vertical direction D1 as well as the horizontal direction D2.

To provide joining of the two joint edges in the D1 and D2 directions, the edges of the floor panel have in a manner known per se a locking strip 6 with a locking element 8 in one joint edge, hereafter referred to as the "strip panel" which cooperates with a locking groove 14 in the other joint edge, hereafter referred to as the "fold panel", and provides the horizontal locking.

The prior art mechanical locking system comprises a separate flexible tongue 30 fixed into a displacement groove 40 formed in one of the joint edges. The flexible tongue 30 has a groove portion P1, which is located in the displacement groove 40 and a projecting portion P2 projecting outside the displacement groove 40. The projecting portion P2 of the flexible tongue 30 in one of the joint edges cooperates with a tongue groove 20 formed in the other joint edge.

The flexible tongue 30 has a protruding part P2 with a rounded outer part 31 and a sliding surface 32, which in this embodiment if formed like a bevel. It has upper 33 and lower 35 tongue displacement surfaces and an inner part 34.

The displacement groove 40 has an upper 42 and a lower 46 opening, which in this embodiment are rounded, a bottom 44 and upper 43 and lower 45 groove displacement surfaces, which preferably are essentially parallel with the horizontal plane HP.

The tongue groove 20 has a tongue-locking surface 22, which cooperates with the flexible tongue 30 and locks the joint edges in a vertical direction D1. The fold panel 1' has a vertical locking surface 24, which is closer to the rear face 62 than the tongue groove 20. The vertical locking surface 24 cooperates with the strip 6 and locks the joint edges in another vertical direction. The fold panel has in this embodiment a sliding surface 23 which cooperated during locking with the sliding surface 32 of the flexible tongue 30.

The flexible tongue could be wedge shaped and could be locked in the tongue grove with pre tension which will press the folding panel 1' against the strip panel. Such an embodiment will give a very strong high quality joint.

Figure 3A:
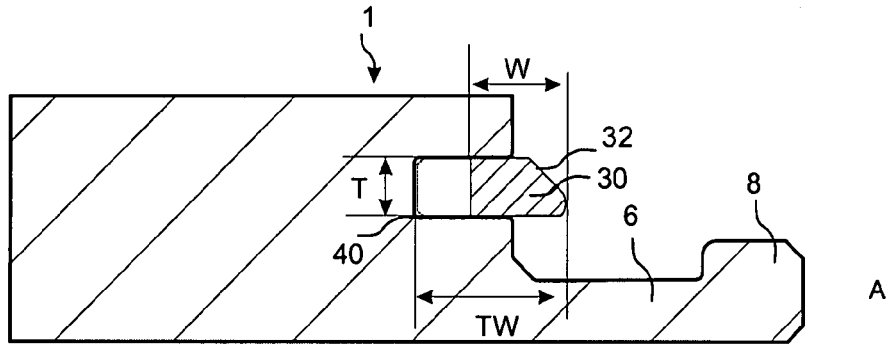
FIGS. 3*a-b* show a floor panels with a known mechanical locking system on a short edge.
Figure 3B:
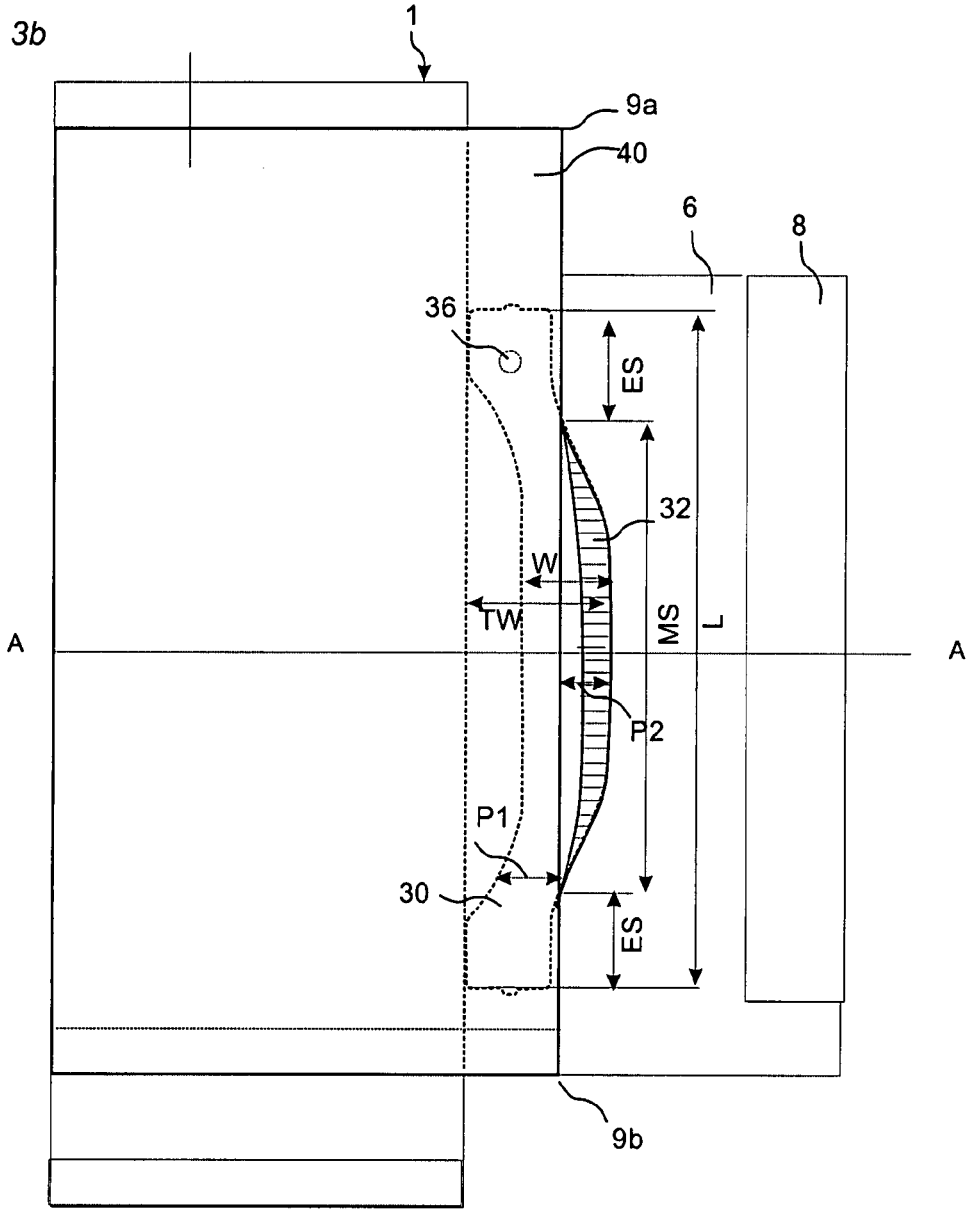

FIG. 3*a* shows a cross section A-A of a panel according to FIG. 3*b* seen from above. The flexible tongue 30 has a length L along the joint edge, a width W parallel to the horizontal plane and perpendicular to the length L and a thickness T in the vertical direction D1. The sum of the largest groove portion P1 and the largest protruding part P2 is the total width TW. The flexible tongue has also in this embodiment a middle section MS and two edge sections ES adjacent to the middle section. The size of the protruding part P2 and the groove portion P1 varies in this embodiment along the length L and the tongue is spaced from the two corner sections 9*a* and 9*b*. The flexible tongue 30 has on one of the edge sections a friction connection 36 which could be shaped for instance as a local small vertical protrusion. This friction connection keeps the flexible tongue in the displacement groove 40 during installation, or during production, packaging and transport, if the flexible tongue is integrated with the floor panel at the factory.

Figure 2A:
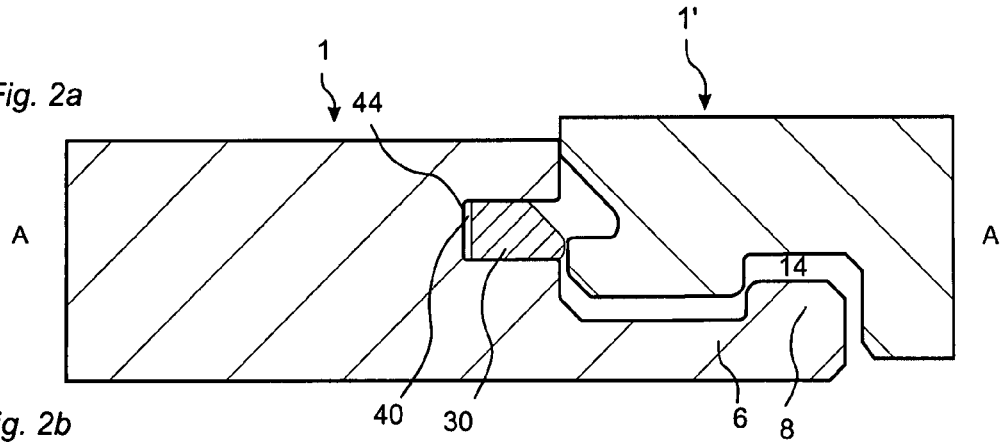
FIGS. 2*a-b* show a known art flexible tongue during the locking action.
Figure 2B:
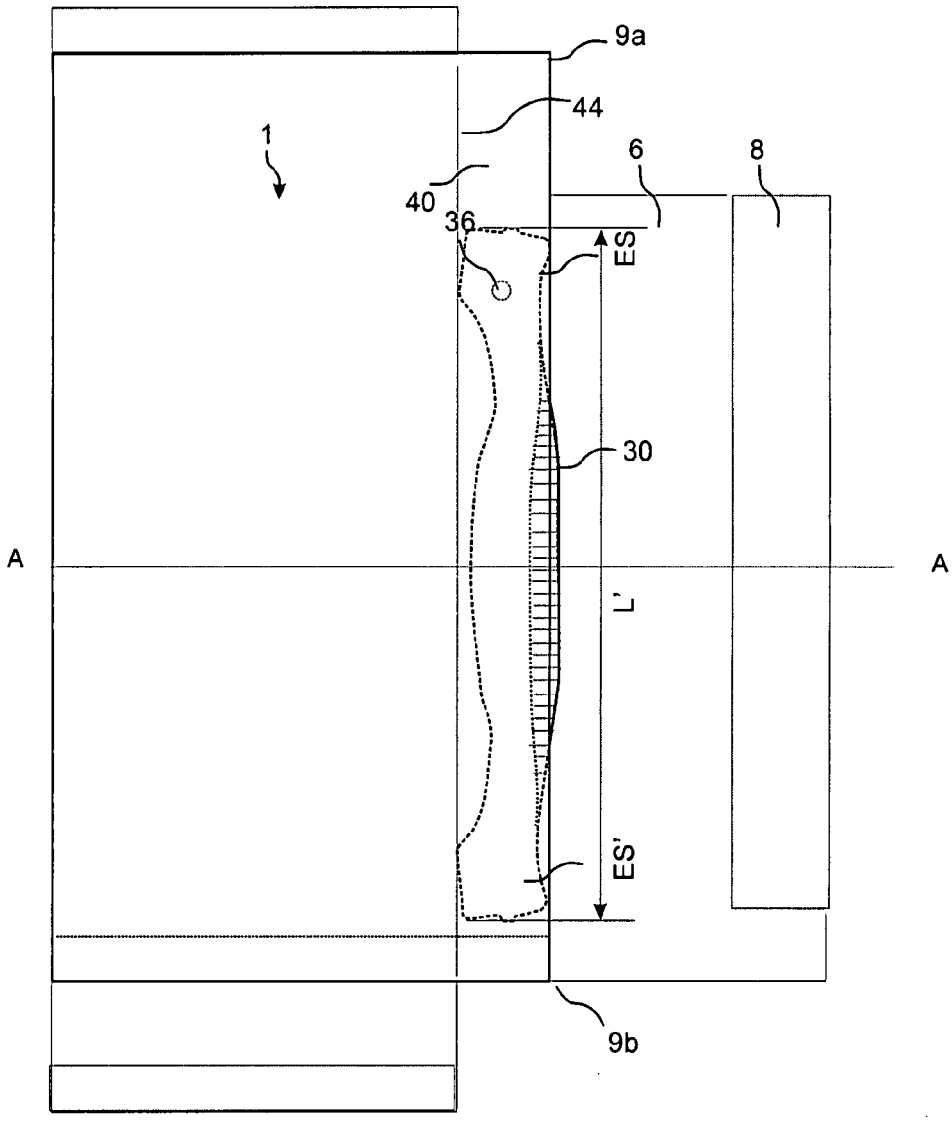

FIGS. 2*a* and 2*b* shows the position of the flexible tongue 30 after the first displacement towards the bottom 44 of the displacement groove 40. The displacement is caused essentially by bending of the flexible tongue 30 in its length direction L parallel to the width W. This feature is essential for this prior art. Embodiments that are on the market have a maximum tongue pressure of about 20 N.

The fold panel could be disconnected with a needle shaped tool, which could be inserted from the corner section 9*b* into the tongue grove 20 and press the flexible tongue back into the displacement groove 40. The fold panel could than be angled up while the strip panel is still on the sub floor. Of course the panels could also be disconnected in the traditional way.

FIG. 4*a* shows one embodiment of a vertical folding. A first panel 1" in a first row R1 is connected to a second 1 panel in a second row R2. A new panel 1' is moved with its long edge 5*a* towards the long edge 5*b* of first panel 1" at a normal installation angle of about 25-30 degrees, pressed to the adjacent edge and connected with its long edge 5*a* to the long edge 5*b* of the first panel with angling. This angling action also connects the short edge 4*b* of the new pane 1' with the short edge 4*a* of the second panel 1. The fold panel 1' is locked to the strip panel 1 with a combined vertical and turning motion along the vertical plane VP. The protruding part P2 has a rounded and or angled folding part P2' which during folding cooperates with the sliding surface 23 of the folding panel 1'. The combined effect of a folding part P2', and a sliding surface 32 of the tongue which during the folding cooperates with the sliding surface 23 of the fold panel 1' facilitates the first displacement of the flexible tongue 30. An essential feature of this embodiment is the position of the projecting portion P2, which is spaced from the corner section 9*a* and 9*b*. The spacing is at least 10% of the length of the joint edge, in this case the visible short edge 4*a*.

FIG. 4*b-c* show an embodiment of the set of floor panels with a displaceable tongue and an alternative installation method. In this embodiment the length of the tongue is of more than 90% of the width WS of front face of the panel, in other preferred embodiments the length of the tongue is preferably in the range from 75% to substantially the same as the width WS of front face. Preferably, the length of the tongue is about the total width of the panel minus the width of the locking system of the adjacent edges of the panel. A small bevel may be provided at the ends of the outer edge, but the straight part of the tongue at the outer edge has preferably a length substantially equal to the length of the tongue or desirable more than 90%. The new panel 1' is in angled position with an upper part of the joint edge in contact with the first panel 1" in the first row. The short edges 4*a* and 4*b* are spaced from each other. The new panel 1', is then displaced sideways towards the second panel 1 until the short edges 4*a*, 4*b* are essentially in contact and a part of the flexible tongue 15 is pressed into the displacement groove 40 as can be seen in the FIG. 4*b*. The new panel 1' is then folded down towards the second panel 1. Since the displacement of the new panel 1' presses only an edge section of the flexible tongue 30 into the displacement groove 40, vertical folding will be possible to make with less resistance. Installation could be made with a displaceable tongue that has a straight outer edge. When panels with the known bow shaped tongue 30 (see FIG. 2-4) are installed the whole tongue has to be pressed into the displacement groove. When comparing the known bow shaped tongue with a tongue according to the invention less force is needed for a tongue with the same spring constant per length unit of the tongue. It is therefore possible, to use a tongue with higher spring constant per length unit and higher spring back force, resulting in more reliable final position of the tongue. With this installation method, the bevelled sliding surface of the fold panel is not necessary, or may be smaller, which is an advantage for thin panel. The disadvantage of this method is that the new panel has to be angled and pressed sideways during the vertical folding. FIG. 4*c* show that all embodiments of a tongue could be on the folding panel. Of course some adjustments are required.

It is generally an advantage to have the tongue on the strip panel since rounded or bevelled parts on the folding panel could be used to facilitate displacement of flexible parts of the tongue. An embodiment with a tongue, which is on the folding panel, as shown in FIG. 4*d*, will have the disadvantage that the tongue must slide against a sharp edge of the panel surface.

A tongue could comprise of plastic material and could be produced with for example injection moulding. With this production method a wide variety of complex three-dimensional shapes could be produced at low cost and the flexible tongues may easily be connected to each other to form tongue blanks. A tongue could also be made of an extruded or machined plastic or metal section, which could be further shaped with for example punching to form a flexible tongue. The drawback with extrusion, besides the additional productions steps, is that it is hard to reinforce the tongue, e.g. by fibres.

Any type of polymer materials could be used such as PA (nylon), POM, PC, PP, PET or PE or similar having the properties described above in the different embodiments. These plastic materials could, when injection moulding is used, be reinforced with for instance glass fibre, Kevlar fibre, carbon fibre or talk or chalk. A preferred material is glass fibre, preferably extra long, reinforced PP or POM.

Figure 5A:
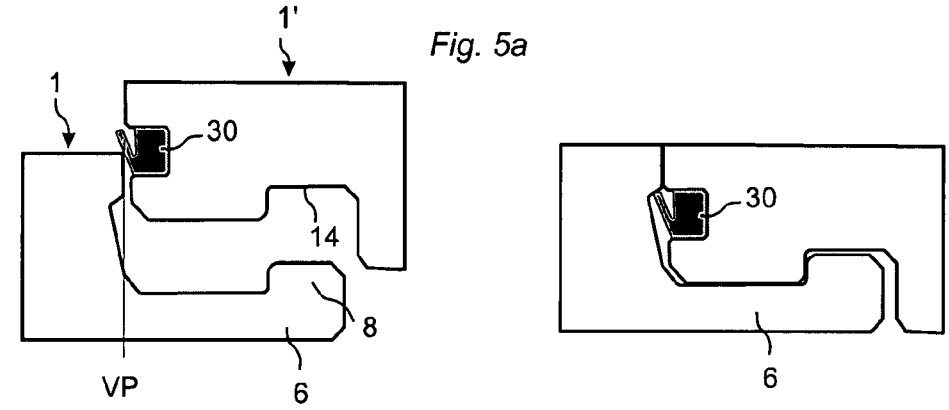
FIGS. 5*a-e* show embodiments of short edge locking systems which could be used in connection with the invention.
Figure 5B:
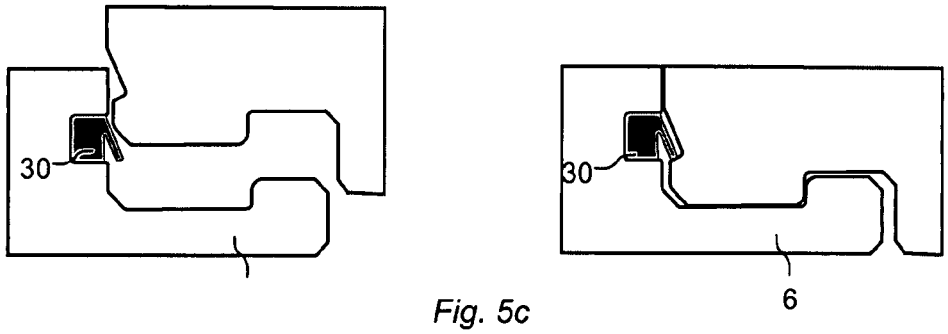
Figure 5C:
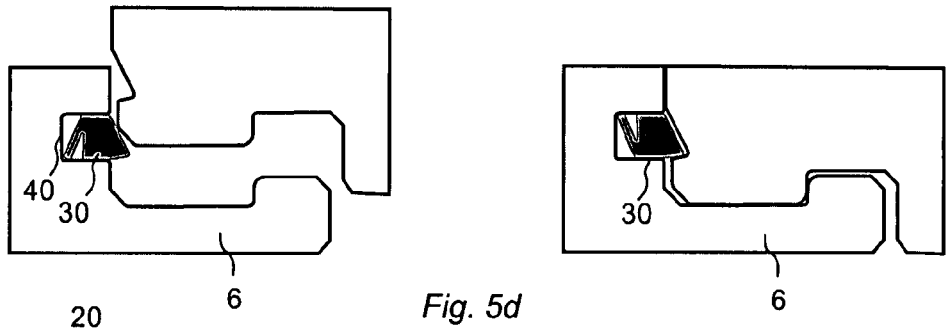
Figure 5D:
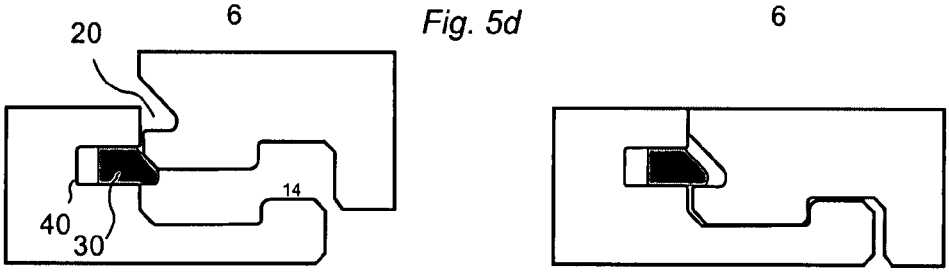
Figure 5E:
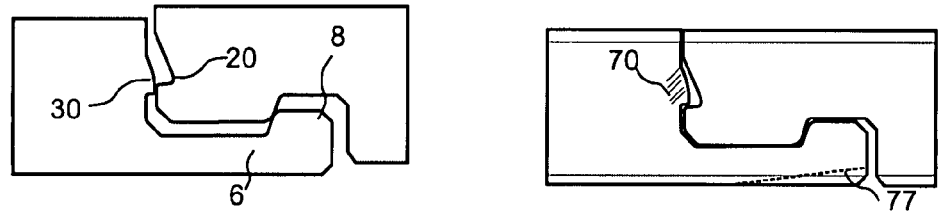
Figure 6A:
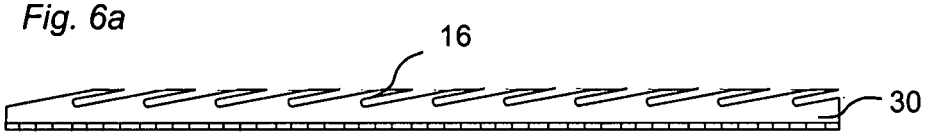
FIGS. 6*a-c* shows displaceable tongues in embodiments according to the invention.

FIGS. 5*a*-5*e* shows embodiments of flexible tongues 30, which could be used to lock short edges according to the invention. FIG. 5*a* shows a separate tongue 30 on the folding panel with a flexible snap tab extending upwards. FIG. 5*b* shows a separate tongue 30 on the strip panel with a flexible snap tab extending downwards. FIG. 5*c* shows a separate tongue with a flexible snap tab inside a displacement grove 40. The snap tab could extend upwards or downwards and could be on the strip panel or on the folding panel according to the same principles as shown in FIGS. 5*a* and *b*. FIG. 5 *d* shows a flexible tongue comprising protrusions, as shown in FIG. 6*a* and these protrusions could be located in the displacement groove 40 or extend from the vertical plane into the tongue grove 20. FIG. 5*e* shows that the tongue 30 could be formed in one piece with the panel and locking could be obtained due to compression of fibres or parts of the panel material and/or bending of the strip 6.

Figure 6B:
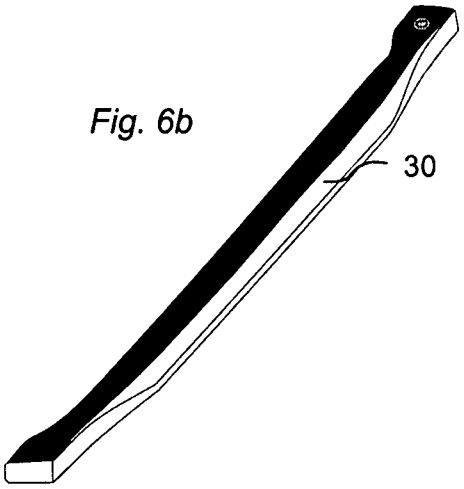
Figure 6C:
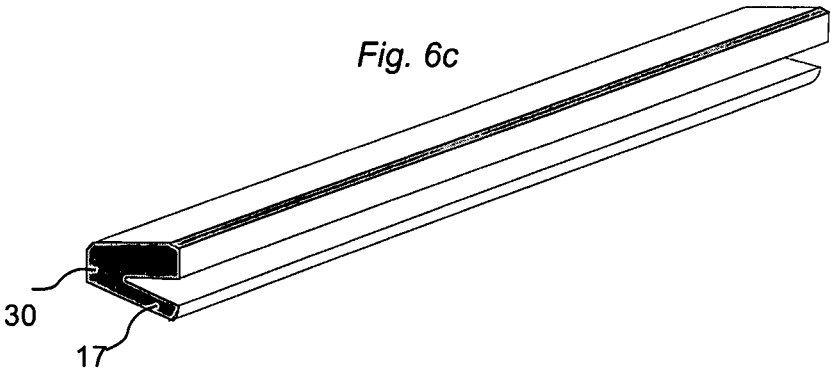

FIG. 6*a-c* shows embodiments of the tongue 30 which could be used according to the invention. They are all configured to be inserted in a groove in a floor panel. FIG. 6*a* shows a flexible tongue 30 with flexible protrusions 16. FIG. 6*b* shows a bow shaped tongue 30 and FIG. 6*c* shows a tongue 30 with a flexible snap tab 17.

A flexible tongue similar to the embodiment shown in FIGS. 1-4, 5*d* 6*a* and 6*b* could for example also be produced from a wood fibre based material, for example HDF, solid wood or plywood with several layers. Extremely strong and flexible tongues could be made of HDF especially if the design is such that flexibility is obtained essentially parallel with the fibre orientations of the HDF fibres.

Figure 7A:
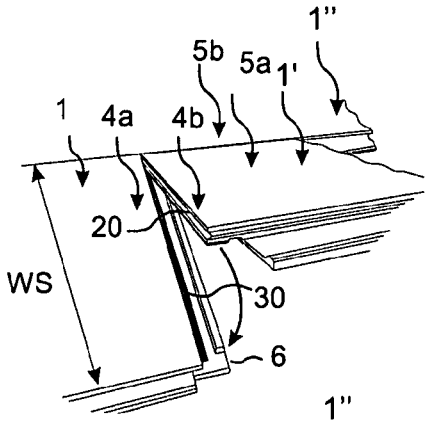
FIGS. 7*a-d* shows in a 3D view separation between panels during vertical folding
Figure 7B:
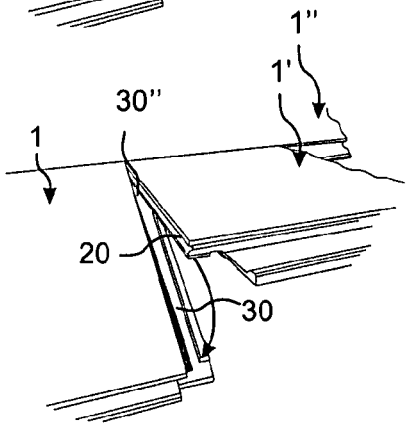
Figure 7C:
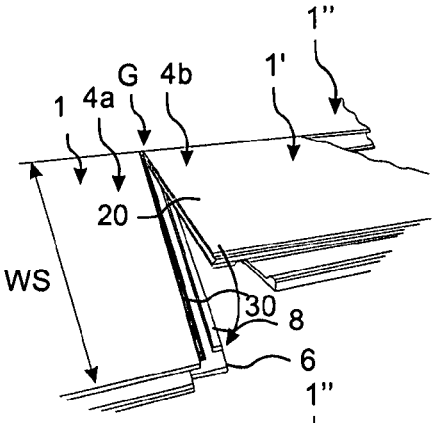
Figure 7D:
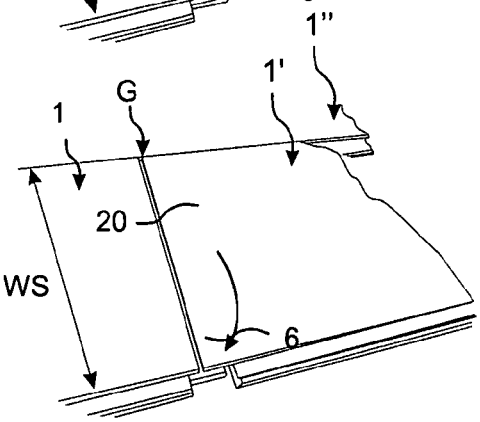

FIG. 7*a-d* shows in 4 steps installation with vertical folding and problems related to such installation. In order to simplify the description, an embodiment is shown with the flexible tongue 30 on the strip panel. As explained before the tongue could be on the folding panel. A new panel 1' is moved in an installation angle with its long edge 5*a* towards the long edge of a first panel 1" until the upper edges are in contact. The new panel is thereafter displaced sideway until the short edge 4*b* is in contact with a short edge of an adjacent second panel in the same row, as shown in FIG. 7*a*. The new panel 1' is than angled down to a contact angle when an edge part 30' of the flexible tongue 30 is in a first initial contact with the short edge of the new panel as shown in FIG. 7*b*. Further angling, which for optimal function should be made with contact between the short edges, will gradually push a larger part of the flexible tongue horizontally and the flexibility of the tongue will create an increasing pressure that could push the short edges 4*a* and 4*b* away from each other. Un undesired gap G will be created as shown in FIG. 7*c*. The locking element 8 will in many cases not be able to pull back the short edges of the panels since the friction between the long edges could be substantial when the panels are at a low angle and the gap G will be maintained in the connected stage as shown in FIG. 7*d*. This could cause cracks or other damages in the locking system. Even very small remaining gaps of 0.01-0.1 mm could cause major problems since moisture could easily penetrate into the joint.

Figure 8A:
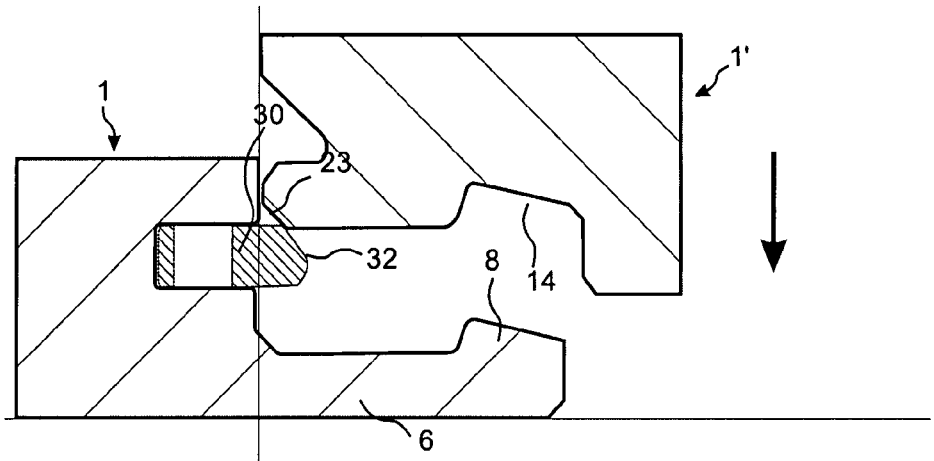
FIGS. 8*a-d* show separation pressure of the tongue on the short edge, during installation.
Figure 8B:
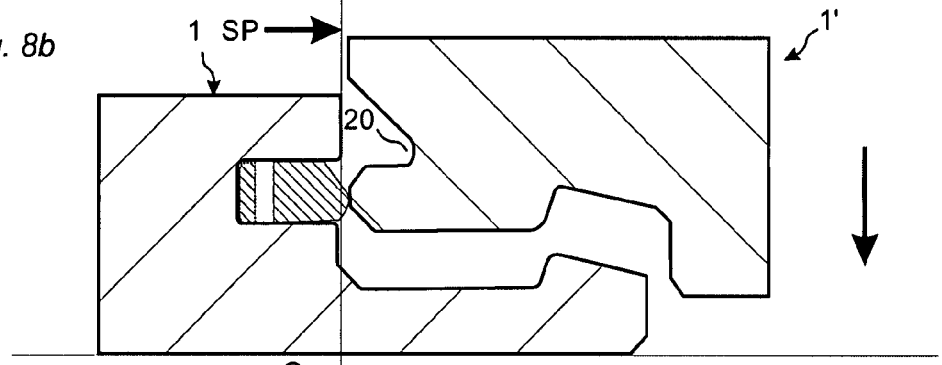
Figure 8C:
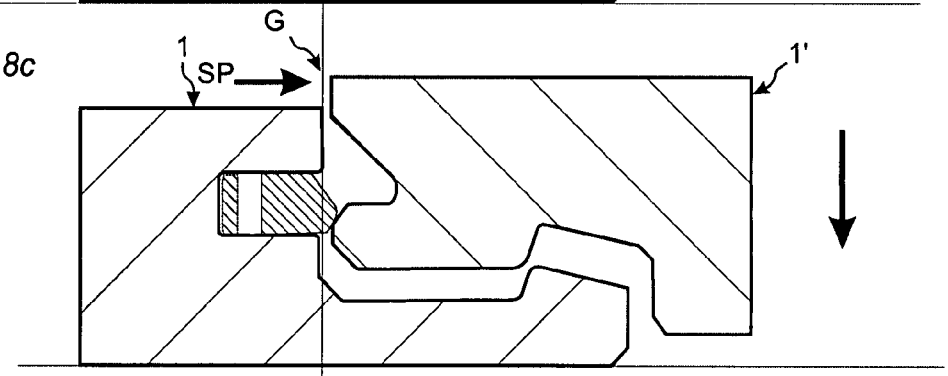
Figure 8D:
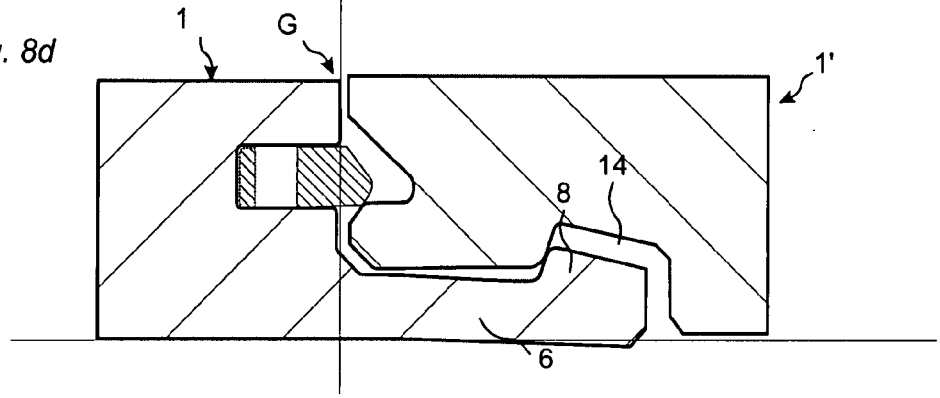

FIGS. 8*a*-8*d* show in detail the separation problems caused by the flexible tongue 30. The panels 1, 1' are according to FIG. 8*a* in a contact angle with the sliding surfaces 23, 32 of the folding panel 1' and the flexible tongue in contact. FIGS. 8*b* and 8*c* shows that the flexibility of the tongue will create a separation pressure SP which could separate the panels 1, 1' from each other and create a gap G if the panels are not pressed together by the installer. FIG. 8*d* shows the panels in locked position with a permanent gap G. In this case the locking strip 6 is bended and the locking element 8 is only partly in the locking groove 14. In the worst case there will be cracks in the locking element 8 and the panels will not be locked horizontally at the short edges.

Figure 9A:
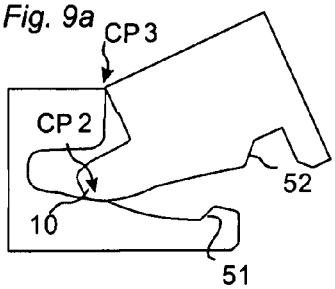
FIGS. 9*a-o* show locking systems used in large volumes on the market and contact points between surfaces in such systems at various angles during installation with angling.
Figure 9B:
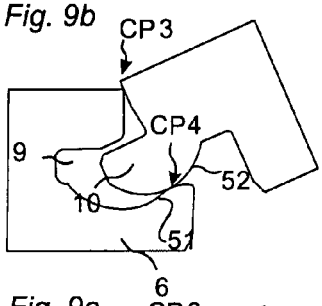
Figure 9C:
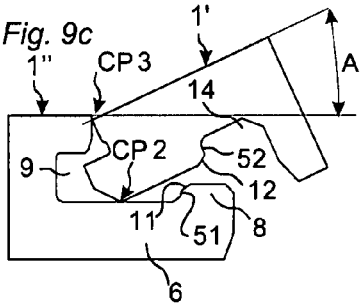
Figure 9D:
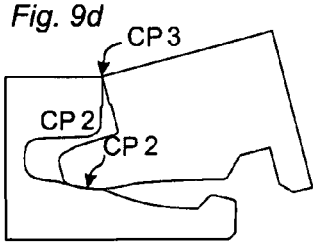
Figure 9E:
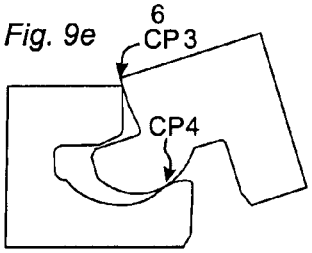
Figure 9F:
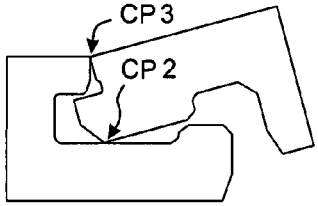
Figure 9G:
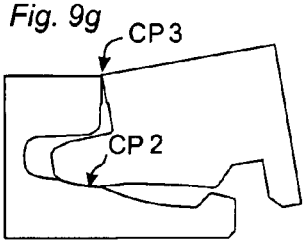
Figure 9H:
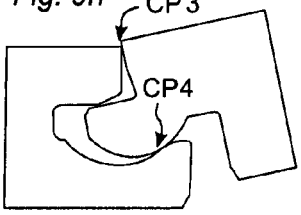
Figure 9I:
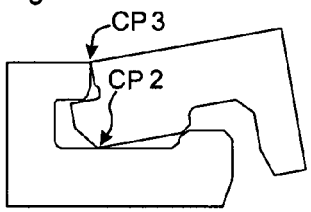
Figure 9J:
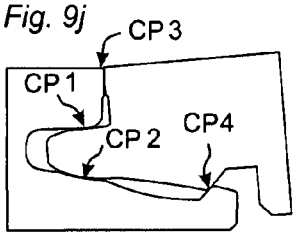
Figure 9K:
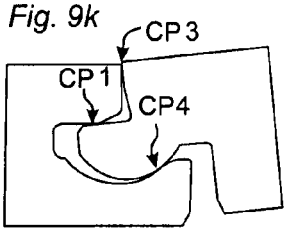
Figure 9L:
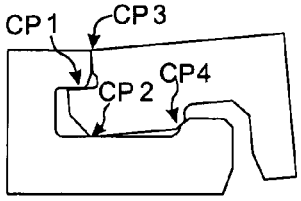
Figure 9M:
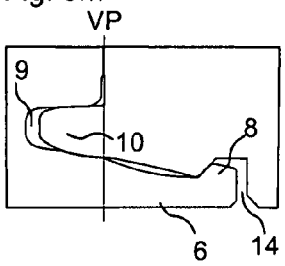
Figure 9N:
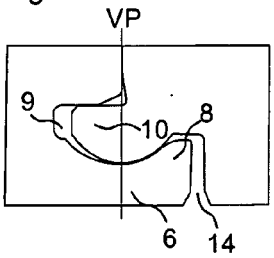
Figure 9O:
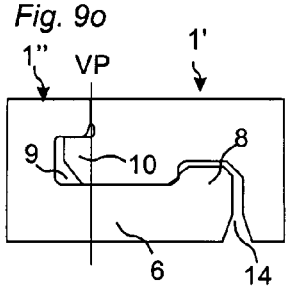

FIGS. 9*a*-9*o* shows 3 types of angling locking systems which are used in large quantities in traditional floorings locked with angling. FIGS. 9*a*-*c* show the floor panels in an installation angle A of 25 degrees. In this position there are only two contact points CP3 and CP2 or CP3, CP4 between the first and second connectors. There is always an upper contact point CP3 or contact surface at the upper joint edges and a second lower contact point or contact surface CP4, CP2 on the lower part of the tongue or somewhere between the inner lower part of the tongue 10 and the locking groove 14. The displacement friction along the joint edges is in this position very low especially in HDF based floorings with smooth surfaces. FIGS. 9*d*-*f* shows further angling to an angle of 15 degrees and FIGS. 9*g*-*l* shows an angle of 10 degrees. In these positions there are still only two contact points and the friction remains low. FIGS. 9*j*-*l* shows the position at an angle of 5 degrees, which in these embodiments is the friction angle. FIGS. 9*j* and 9*k* show that the locking systems are in a locking angle where the locking surfaces 51,52 are partly in contact. FIG. 9*l* shows a locking system in a guiding angle with the guiding surfaces 11,12 in contact. FIG. 9*j* shows that this locking system has 4 contact points, two upper contact points at the upper joint edges CP3 and at the upper part of the tongue CP1 and two lower contact points at the lower part of the tongue CP2 and between the locking surfaces CP4. FIG. 9*k* shows two upper CP1, CP3 and one lower contact point CP4. FIG. 91 is similar to FIG. 9*j* but one lower contact point is between the guiding surfaces 11, 12. The displacement friction along the joint edges will in these positions increase considerably especially if there is a tight fit between the contact points or contact surfaces and/or if the contact surfaces are of a considerable size. Pre tension could increase the friction further and a displacement along the long edges in connection with vertical folding could be counteracted and in most cases completely eliminated even in small pieces of floor panels. Such locking systems are however not suitable on the long side in a vertical folding system where the contact angle is higher than 5-8 degrees, especially if they are produced with a normal fit between the connectors, since they will not prevent displacement along the long edges and separation of the short edges.

Figure 10A:
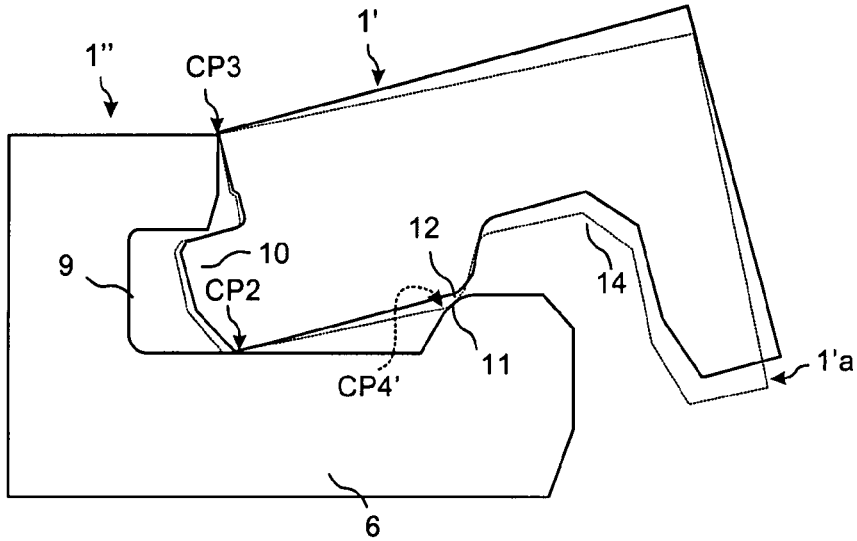
FIGS. 10*a-c* show embodiments of the long edge locking systems with a friction angle of 10 degrees according to the invention.
Figure 10B:
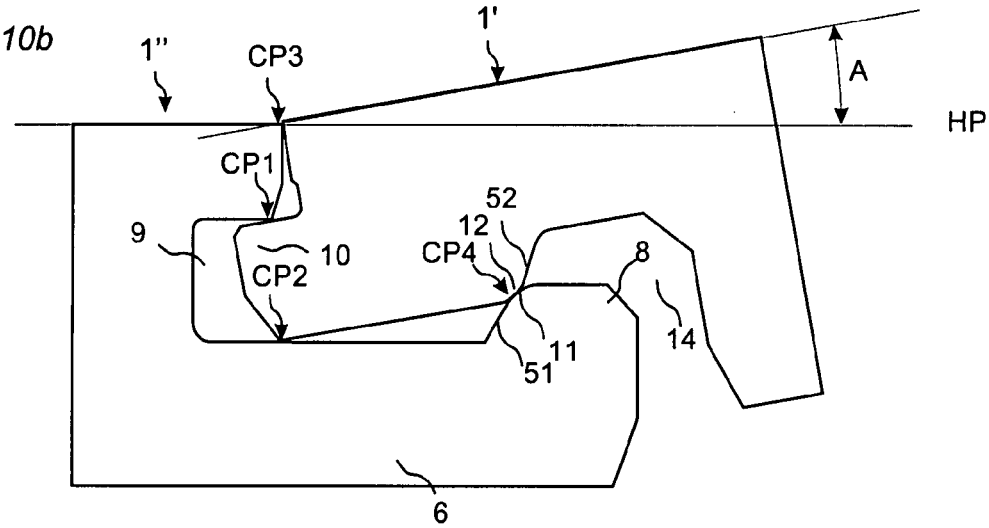
Figure 10C:
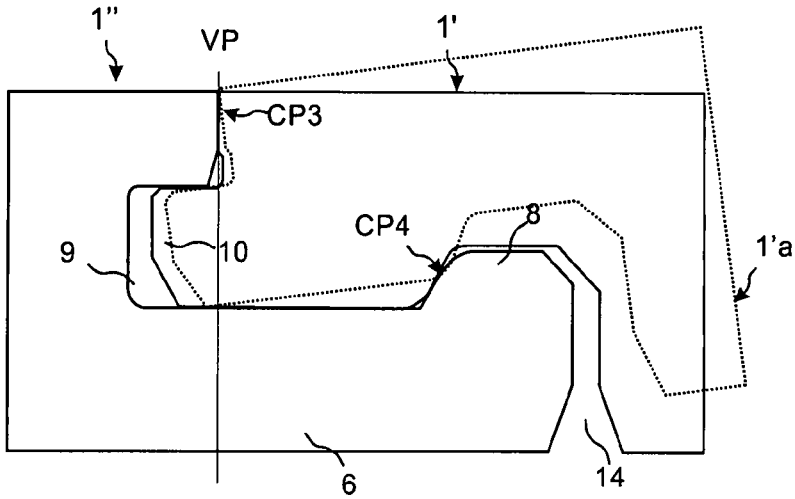

FIG. 10*a* shows an embodiment according to the first object of the invention. Such a locking system could preferably be used on the long edges in a vertical folding system with a contact angle A of about 10 degrees and lower. It will also be possible to use such a system in locking systems with a higher contact angle since such system will prevent displacement already at 10 degrees when most fold down locking systems create the highest displacement pressure. FIG. 10*a* show the position of panel 1' at an angle of 15 degrees when only two points CP3, CP2 are in contact. Panel 1'*a* is in a friction angle position of 12 degrees with three contact points CP3, CP2, CP4'. This position is characterized by the fact that there is only one contact point CP2 on the tongue and that the guiding surfaces 11, 12 are in contact. This is an advantage since the guiding surfaces will press the tongue into the groove during further angling which is shown in FIG. 10*b*. The friction has increased further and is caused by vertical contacts and cooperation between the tongue 10 and the tongue groove 9 (CP1,CP2), the horizontal contacts between the upper edges CP3 and the guiding surfaces 11, 12 which form the second lower contact point CP4. The ideal position is preferably an embodiment with a contact angle equal or lower than the friction angle and the guiding angle. Such embodiment could for example have a friction and guiding angle of about 10 degrees and a contact angle of about 8-9 degrees. The locking could be made in an extremely simple way and only a downward pressure on the new panel has to be applied when the panel is positioned at a guiding angle. FIG. 10*c* show that the locking system is configured with a high angle between the locking surfaces and that fibres during the final stage of angling, shown by the position 1'*a*, must be compressed at top edges CP4 and at locking surfaces CP4 in order to allow locking. This configuration gives several advantages. The friction will increase and be at a high level when the separation force is at the highest level. The floor panels will be maintained in an angled up position by the locking element and the locking groove, as shown in FIG. 10*b* independently or in combination with a contact between the short edge of the folding panel and an edge section of the flexible tongue. The friction will prevent the short edge to slide away from the flexible tongue. This will facilitate installation since the installer could change the hand position from bringing the panel into the installation angle to a vertical pressing action at the short edge. The invention therefore provides a vertical locking system with a long edge angling system that allows one panel to stay in an angled position against another panel with upper joint edges in contact. It also provides a locking system where there is an increasing pressure between the upper joint edges and the locking element and/or between the tongue and the grove in an final stage of angling when the a part of the locking groove 14 is in contact with the locking element 8.

Figure 11A:
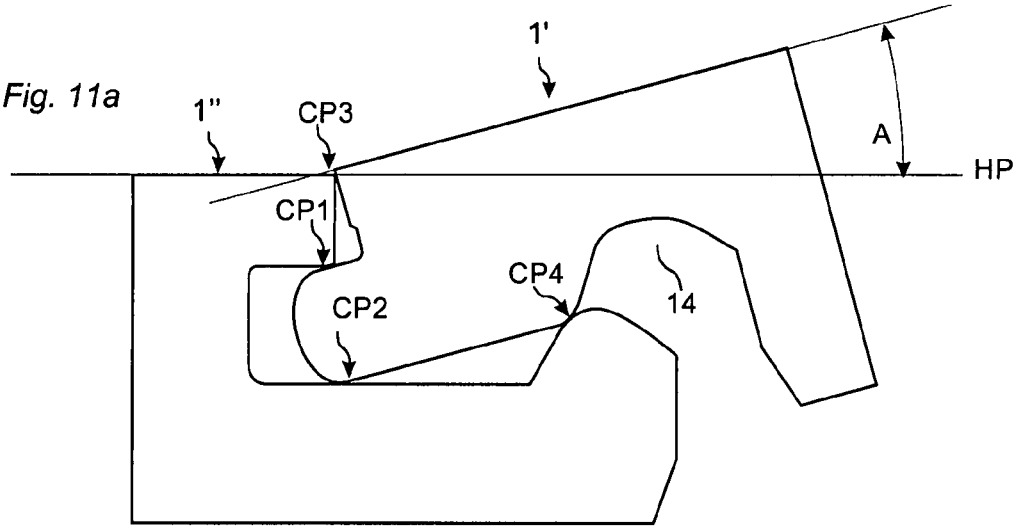
FIGS. 11*a-c* show embodiments of the long edge locking systems with a friction angle of 15 degrees according to the invention.
Figure 11B:
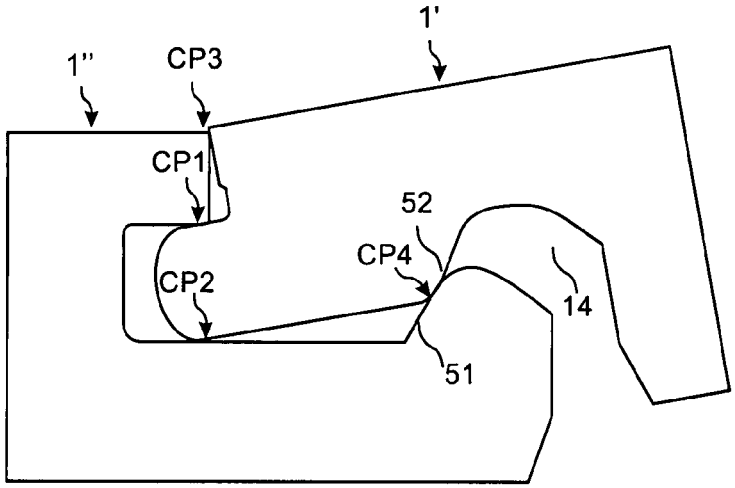
Figure 11C:
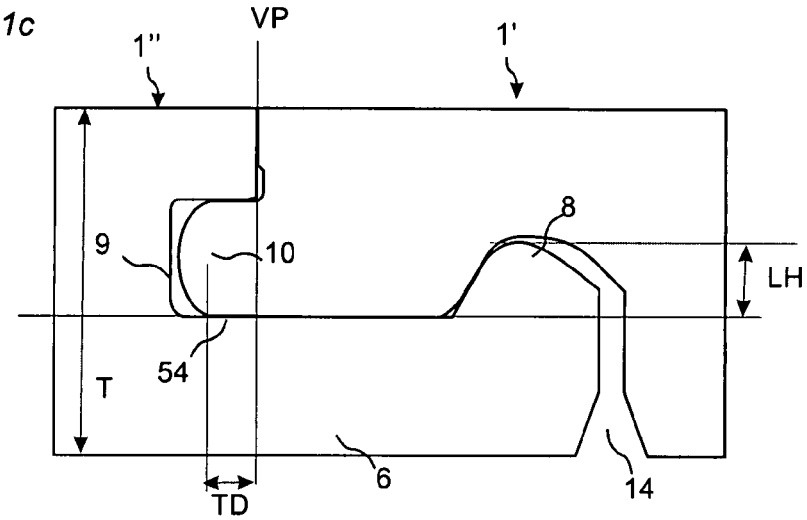

FIGS. 11*a*-11*c* show that the same principles could be used to form a locking system with an even higher friction angle A of for example 15 degrees as shown in FIG. 11*a*. The locking element 8 has been made higher and it extends in this preferred embodiment vertically LH from the lowest point of the locking strip 6 about 0.2 times the floor thickness T. The tongue has a lower part 54, which is essentially parallel with the horizontal plane HP and which extends from the vertical plane VP preferably along a distance TD of about 0.1 times the floor thickness T.

The importance of the contact angle and the combined function of the long and short edges during vertical folding and vertical locking will now be explained with reference to FIGS. 12*a*-13*d*.

Figure 12A:
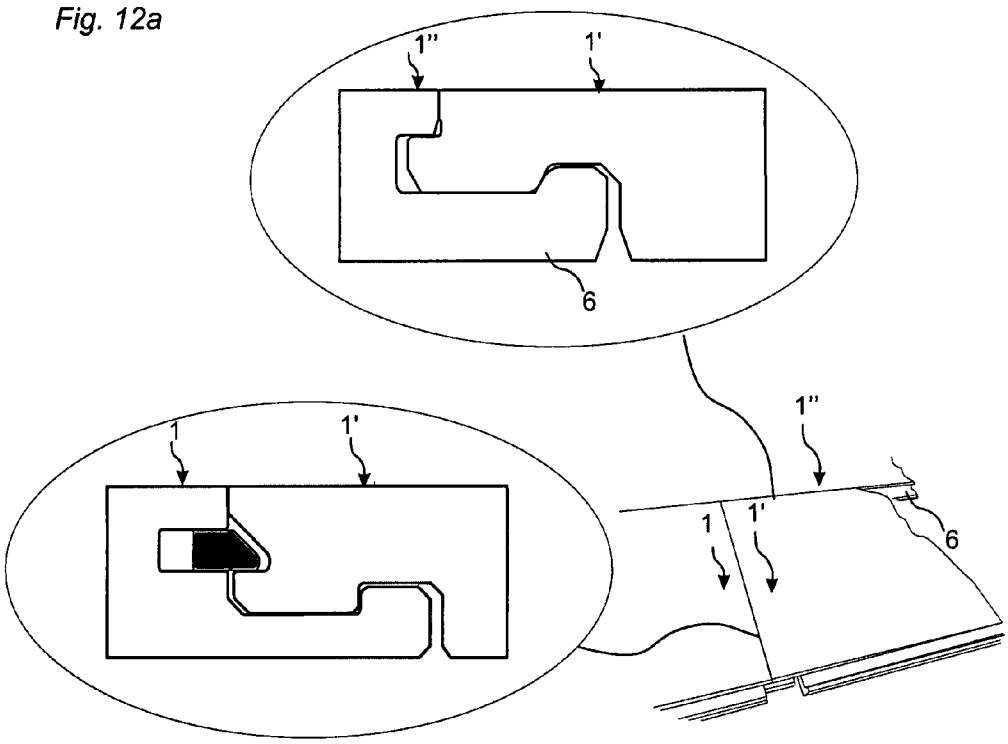
FIGS. 12*a-c* show long and short edge locking systems and the position of a flexible tongue according to embodiments of the invention

FIG. 12*a* shows a long edge locking system 1", 1' and a short edge locking system 1,1' in an installed flooring system which is intended to be locked with vertical folding or vertical locking. The long edges have a locking system that is possible to lock with angling. The short edges have a locking system that is possible to lock with vertical locking or vertical folding.

FIG. 12 *b* shows the position of the sliding surface 23 of for example a new panel 1' seen from a second panel 1 towards the new panel 1' when the new panel 1' is moved vertically downwards. This locking could be used to for example connect the first row. The sliding surface 23 is in a plane which is located in the lower part of the panel 1'.

Figure 12B:
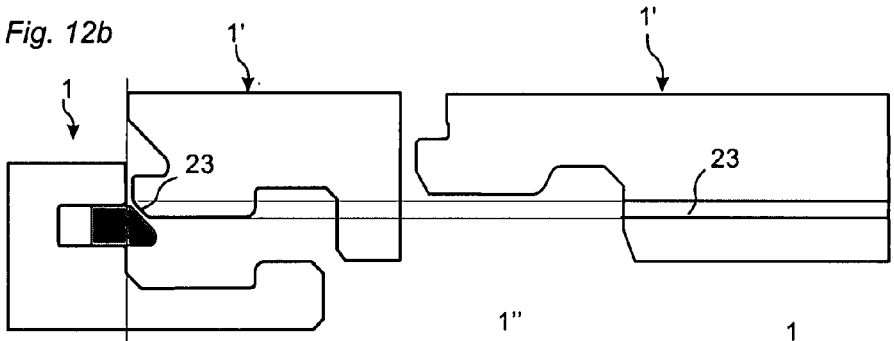
Figure 12C:
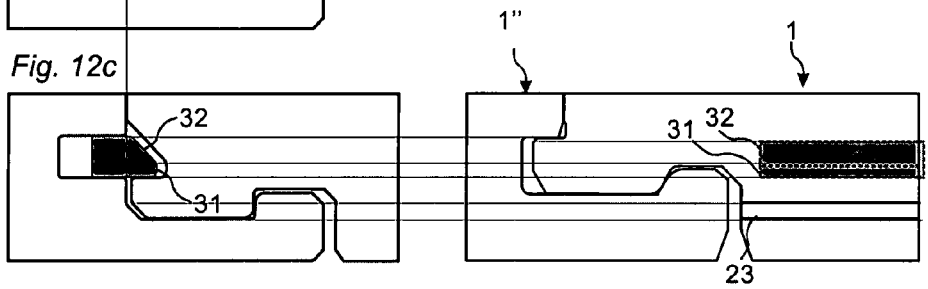

FIG. 12*c* shows the position of sliding surface 32, the tip 31 of the flexible tongue and the sliding surface 23 when the first 1", and the second panel 1 are laying flat on the floor.

FIGS. 12*b* and 12*c* show that position of the flexible tongue in the length direction of the short edge is not important in a vertical locking where the whole panel is moved vertically downwards.

Figure 13A:
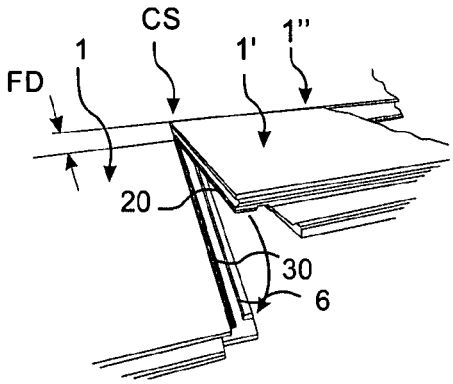
FIGS. 13*a-d* show embodiments of the panel position at the contact angle.
Figure 13B:
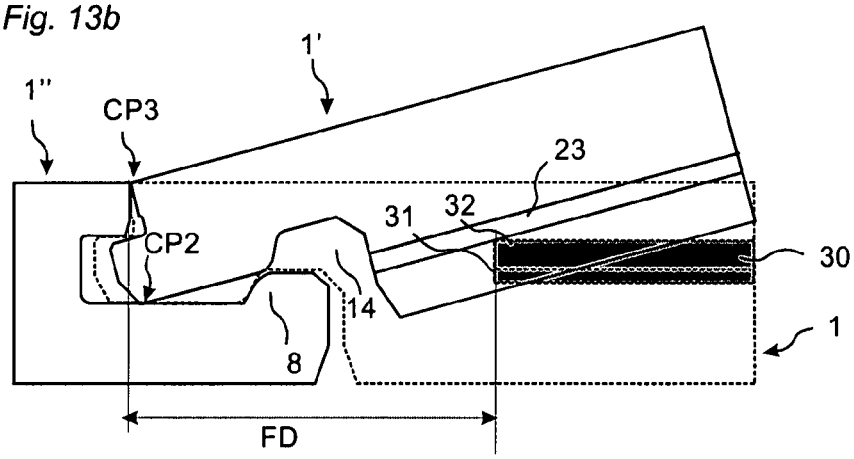
Figure 13C:
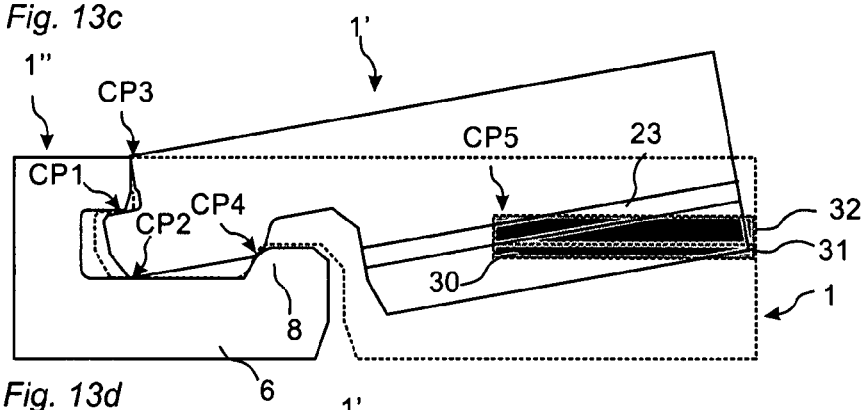
Figure 13D:
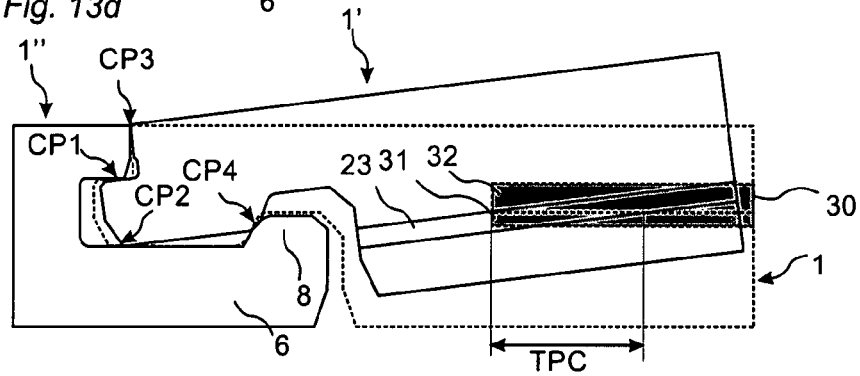

FIG. 13*a* shows an embodiment of the same locking system as in FIG. 12 during vertical folding. The edge of a flexible tongue 30 is in this embodiment positioned at a distance FD from the long edge of the first panel 1" FIG. 13 *b* shows vertical folding of a corner section CS and the position of the new panel 1' when it is close to a contact angle. Due to the bevelled sliding surfaces 23, 32 there is not yet any contact between the folding panel 1' and the flexible tongue 30. FIG. 13*c* shows the contact angle, which in this embodiment is 10 degrees. The sliding surfaces 32,23 overlap each other at an initial contact point CP5. Further angling will start to create a gradually increased separation pressure between the short edges of the panels 1, 1' since a larger part TPC of the flexible tongue will be pressed horizontally inwards into a displacement groove by the sliding surface 23 of the folding panel 1' as shown in FIG. 13*d*.

Figure 14A:
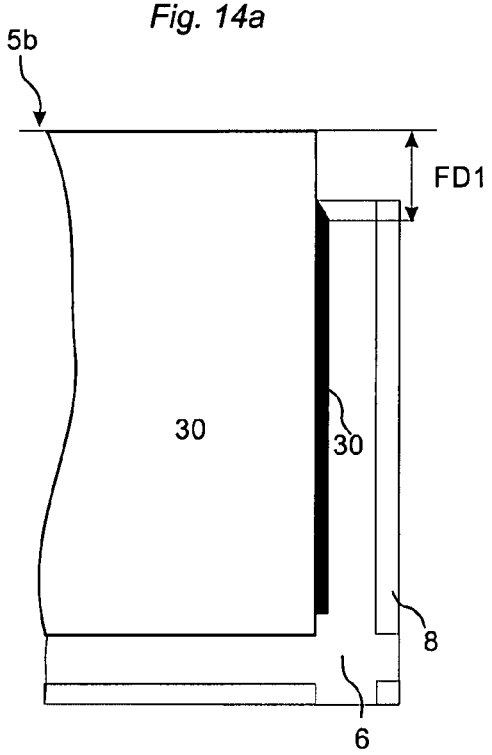
FIGS. 14*a-d* show the position of the flexible tongue in relation to the long edge according to embodiments of the invention.
Figure 14B:
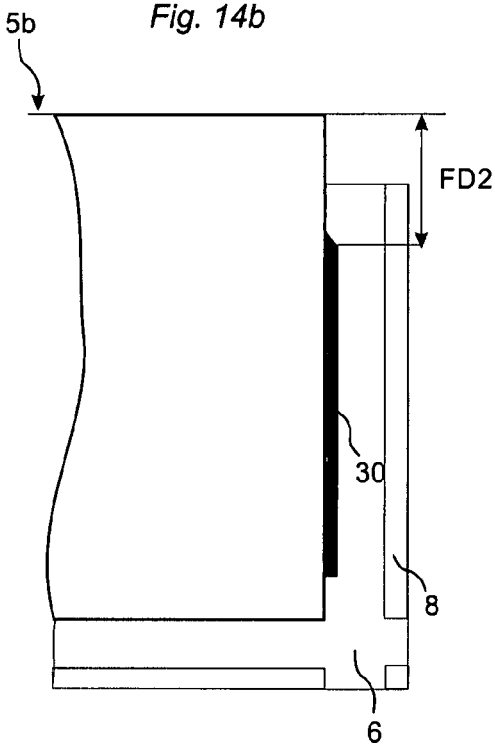
Figure 14C:
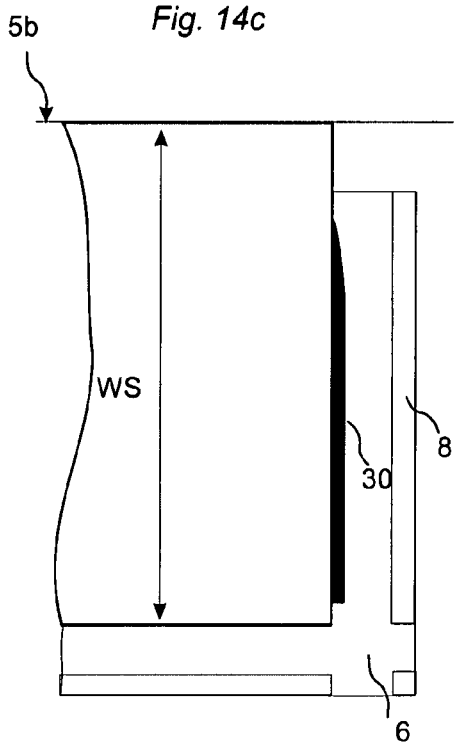
Figure 14D:
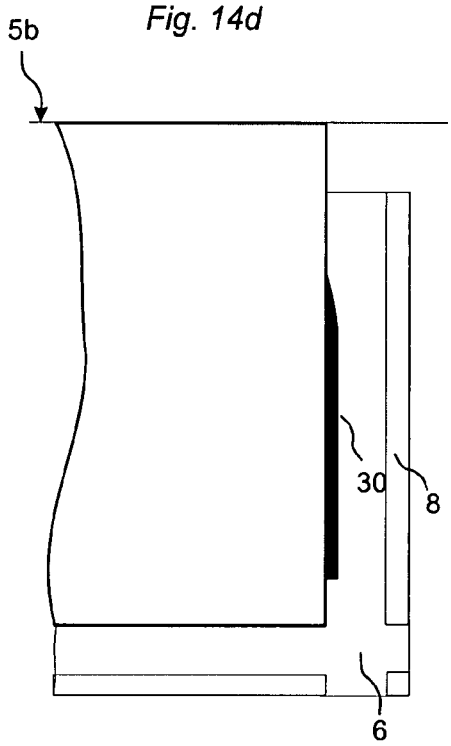

FIGS. 14*a* and 14*b* shows the position of the flexible tongue 30 in two embodiments of the invention. The flexible tongue 30 is in these embodiments bendable in the length direction horizontally. The edge of the flexible tongue is in the FIG. 14*a* located in a position FD1 close the long edge 5*b*, for example about 15 mm from the edge. Such a locking system will in a laminate floor with a normal thickness have a contact angle of about 10 degrees. The contact angle could be lower if the edge of the tongue will be positioned at a distance FD2 further away from the long edge 5*b* as shown in FIG. 14*b*. In this case locking systems with a lower contact angle could be used. Such an embodiment could be sufficient in thick and stable floor panels or narrow floor panels. In thinner floor boards, for example 6-8 mm laminate and veneered floorings, it is an advantage if the flexible tongue could lock the short edges close the to long edge and over a substantial distance of the short edge. FIGS. 14*c* and 14*d* show the flexible tongue in an essentially contact position when a first part of the flexible tongue 30 has been bended horizontally and pressed horizontally inwards into the displacement groove. It is obvious that the separation pressure will increase when a larger part of the tongue is bended and pressed horizontally sideways during the folding action. These and previously described embodiments show that the long and short edge locking systems are dependant of each other and must be adapted to each order in order to guarantee a simple and reliable locking function.

Figure 15A:
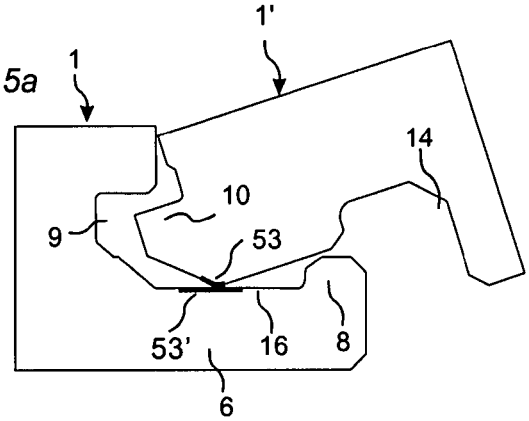
FIGS. 15*a-c* show an embodiment with friction means according to the invention.
Figure 15B:
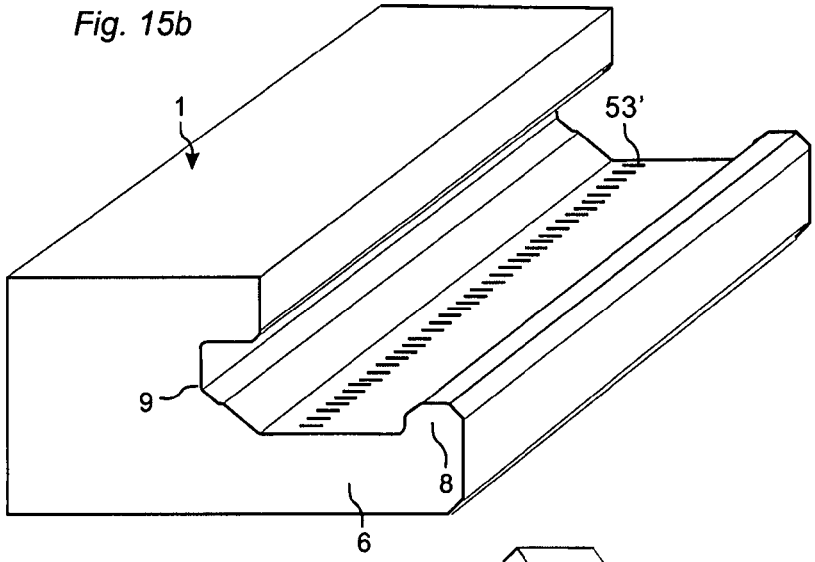
Figure 15C:
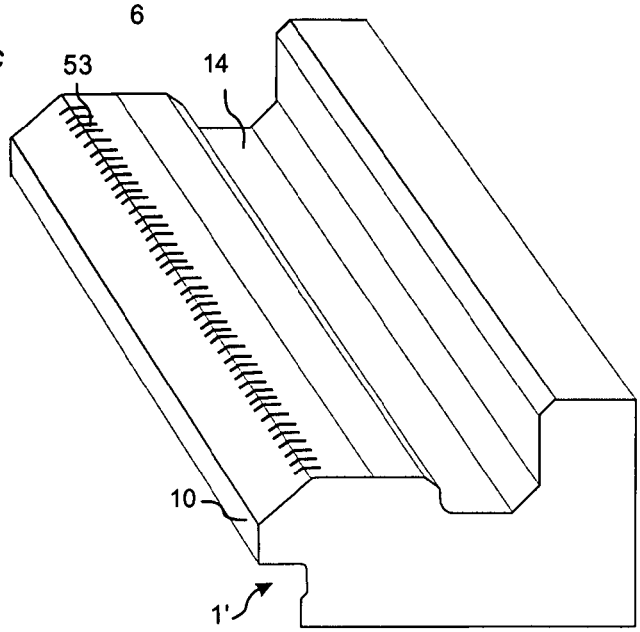

FIGS. 15*a*-*c* show friction means 53,53' which in this embodiment are formed as small local protrusions on the upper part of the locking strip 6 on the strip panel 1 and on the lower part of the tongue or on the groove panel 1'. Such protrusions could be formed on other surfaces in the locking system and they will prevent displacement at high angles for example when there are only two contact points as shown in FIG. 15*a*. The friction means could also comprise any type of materials or chemicals such as small hard particles, rubber, binders and similar materials that are applied in the locking system. Preferred materials are soft waxes such as Microcrystalline waxes or paraffin based waxes which could be applied on one or several surfaces in the locking system, for example on the tongue and or the tongue groove, on the strip, on the locking element and/or in the locking groove, on one or both guiding surfaces etc. and they could increase the initial friction between especially HDF surfaces. In a plywood core different layers and fibre structure could be used to form a tongue 10 and a strip 6 such that high friction is obtained during angling. The above mentioned friction means could be combined. Local small protrusions, rough surfaces, oriented fibre structures etc could for example be combined with wax or chemicals.

FIG. 16*a*-*d* show methods to measure friction between long edges of floor panels. A sample of a groove panel 1' with a width W2 of about 200 mm is pressed with a pressure force F1 of 10 N at an angle A against a strip panel 1", which is fixed and has a with W1 exceeding 200 mm. The pressure force F1 is applied on the groove panel 1' with a wheel which rotates with low friction. The displacement friction is defined as the maximal force F2 which is required to displace the groove panel 1' along the joint. The curve Fa in FIG. 16 *b* shows measurements made on a sample of a 8 mm laminated panel with a surface of printed paper impregnated with thermosetting resins and with a HDF core. Friction should be measured from an installation angle and gradually at lower angles. The displacement friction of this sample is at an installation angle IA about 10 N and almost the same at a contact angle CA of 10 degrees. The friction angle FA is in this sample about 5 degrees. Many HDF based locking systems on the market have a displacement friction below 10 N at the installation angle. The friction could be as low as 5 N. The long edges will in such locking system only contribute marginally to counteract displacement of the short edges during the initial stage of the vertical folding since the friction angle is lower than the contact angle. The curve Fb shows a special locking system where the friction, due to the geometry of the locking system, at an installation angle is higher than at a lower angle. The invention is based on the principle that friction should be increased at the contact angle compared to a installation angle or any other angle between the installation angle and the contact angle where the friction force is at the lowest level. A preferred embodiment is that the friction at the contact angle exceeds 15 N and still more, preferable 20 N. A preferred embodiment is also a vertical locking system with a flexible tongue that creates a tongue pressure of more than 20 N, even more than 30 N.

There are locking systems on the market that show rather high friction at high angles. Such locking systems are not possible to angle down from an installation angle to a contact angle or a guiding angle in a normal way with a pressure F1 of 10 N, which corresponds to a 60 N pressure force applied to a floor panel of 120 cm during installation and they are a type of locking systems where angling must be combined with very hard pressure or a snap action in an angled position. Such locking systems are not used in vertical folding systems. They are not excluded according to the invention but they are not favourable in an vertical folding system since they will only marginally, in some specific applications, improve installation compared to the traditionally used installation with angling short and long edges, snapping short and long edges or angling long edges and snapping short edges.

Figure 16A:
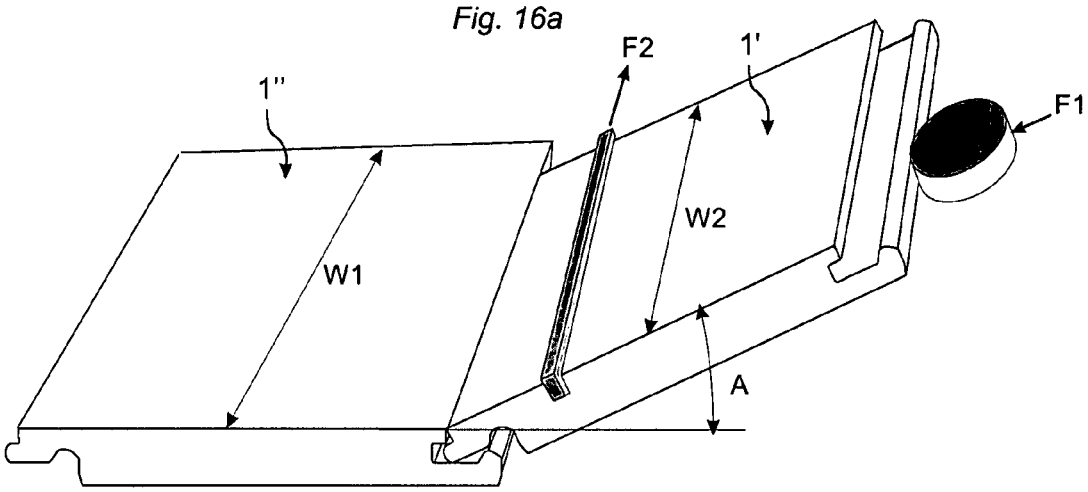
FIGS. 16*a-d* show a method to measure friction forces at various angles according to embodiments of the invention.
Figure 16B:
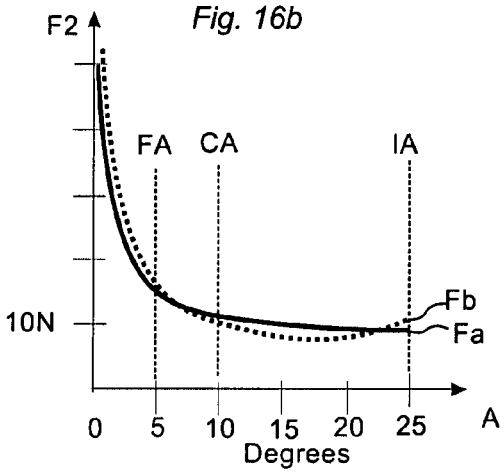
Figure 16C:
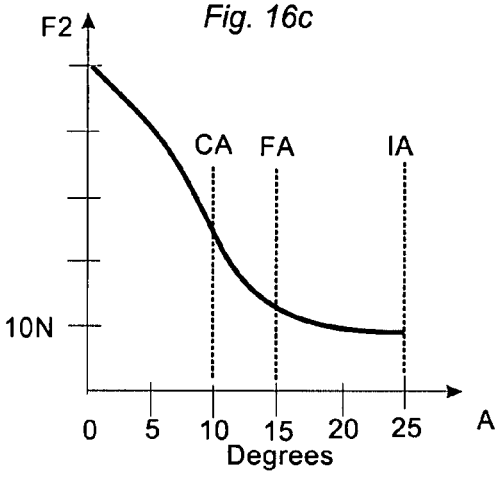
Figure 16D:
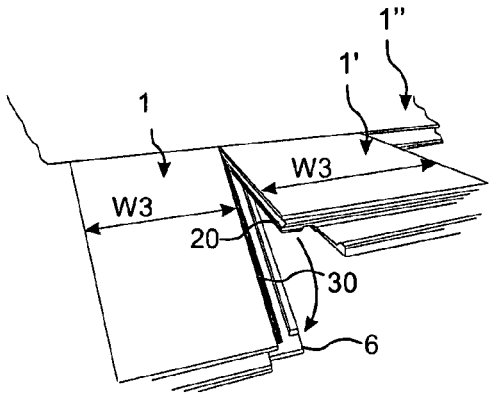

FIG. 16*c* shows a more favourable locking system according to the invention where the friction angle FA is about 15 degrees and the contact angle CA 10 degrees. The friction angle FA is higher than the contact angle CA and the friction between the long edges has increased considerably at the contact angle CA compared to the installation angle IA. FIG. 16*d* shows how two samples 1, 1' with a width W3 of 200 mm are installed and according to the forth principle of the invention, such an installation should not cause a separation of the short edges when the folding panel is pressed to the sub floor, exclusively vertically and without any sideways pressure towards the short edge, provided that the panels have locking systems according to the invention. The test could also be made with one full size panel 1 and one panel 1' cut to a length of about 20 cm. Such locking system with a long edge friction that prevents displacement of such small floor pieces, will allow an easy installation, not only of the ordinary floor panels but also of all the cut to size floor panels close to the wall.

Figure 17A:
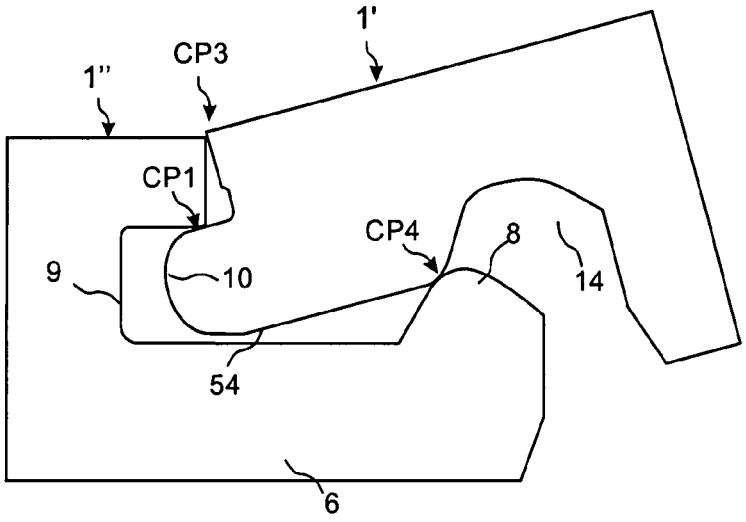
FIGS. 17*a-c* show alternative embodiments with three contact points according to the invention.
Figure 17B:
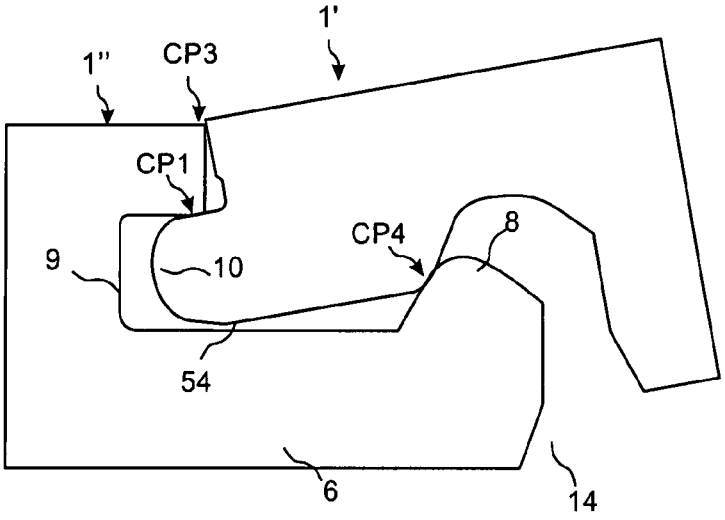
Figure 17C:
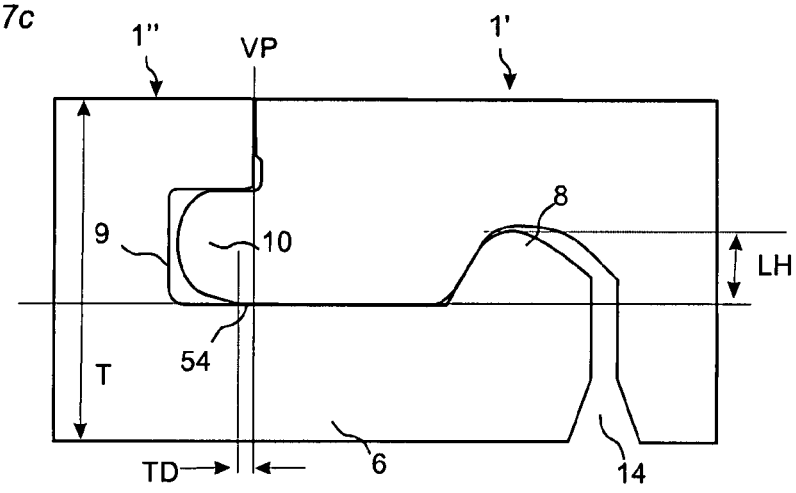

FIG. 17*a-c* show how the locking system in FIG. 11 could be adjusted in order to create a friction with initially three contact points CP3, CP1 and CP4. The friction is mainly obtained by the pressure between the locking element 8/locking groove 14 and the upper part of the tongue 10/tongue-groove 9. The tongue has in this embodiment a lower part 54 which is essentially parallel with the horizontal plane HP and which extends from the vertical plane preferably along a shorter distance TD then in FIG. 11 and which is less than 0.1 times the floor thickness T.

Figure 18A:
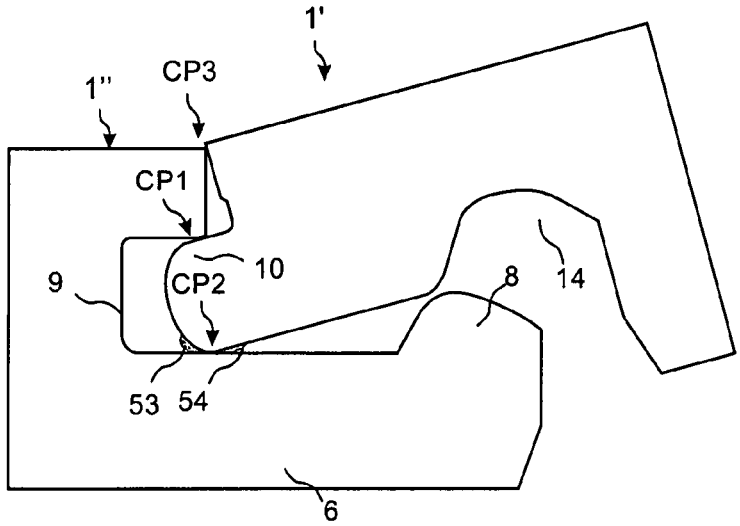
FIGS. 18*a-c* show further alternative embodiments with three contact points according to the invention.
Figure 18B:
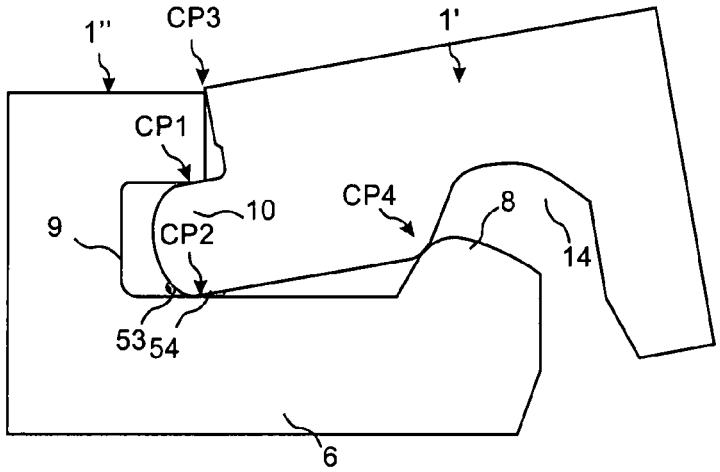
Figure 18C:
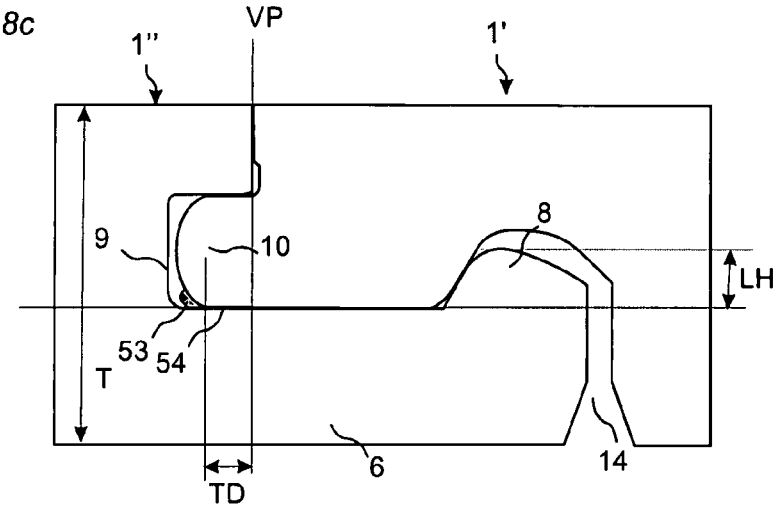

FIG. 18*a*-18*c* show that the locking system in FIG. 11 could also be adjusted in order to create a friction with initially three other contact points CP3, CP1 and CP3. The friction is mainly obtained by the pressure between the upper and lower parts of the tongue 10/tongue groove 9. The tongue has in this embodiment a lower part 54 which is essentially parallel with the horizontal plane HP and which extends from the vertical plane preferably along a the same distance TD as in FIG. 11. The height LH of the locking element is however lower. Friction means 53 are shown in the form of wax, on the lower part on the tongue 10. The wax should preferably be rather soft and it should preferably be possible to deform during the angling. This soft wax will prevent initial displacement along the joint. Such wax could be applied in all locking system and it would prevent displacement especially against surfaces made of HDF.

FIGS. 17 and 18 show that a lot of combinations of friction angles and friction points could be obtained if the dimensions of the tongue 10, groove 9, strip 6 locking element 8 and the locking groove 14 are adjusted within the principles of the invention.

Figure 19A:
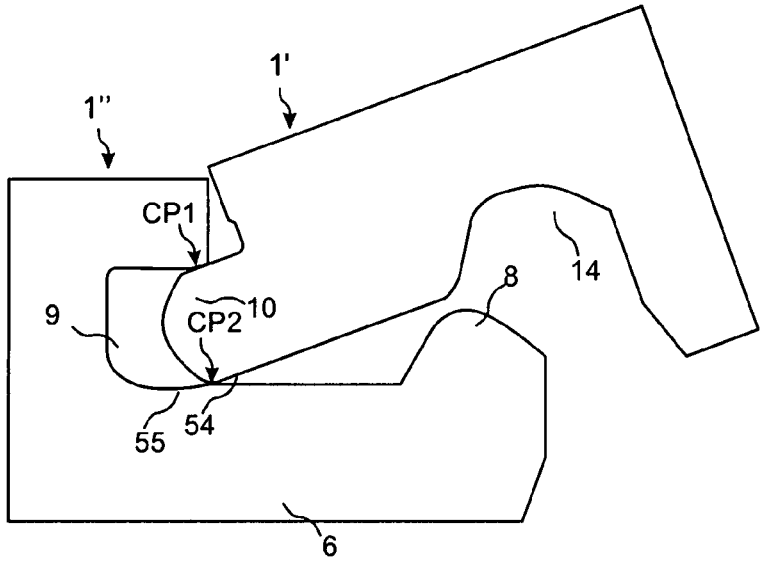
FIGS. 19*a-c* show further alternative embodiments with two and three contact points which creates friction according to the invention.
Figure 19B:
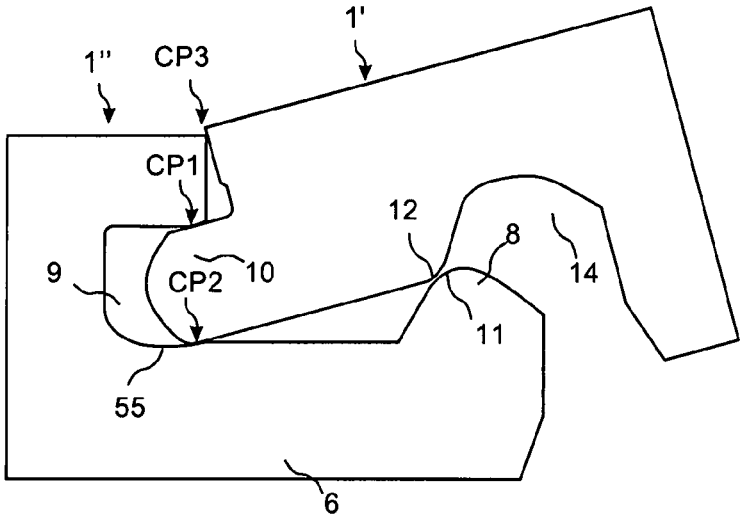
Figure 19C:
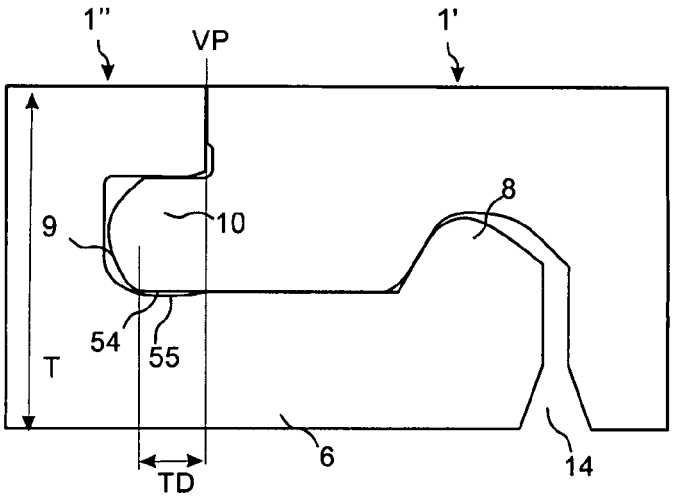

FIG. 19*a* shows an embodiment with a friction angle of 20 degrees where the friction is obtained with only two contact points CP1 and CP2 between the upper and lower parts of the tongue 10/tongue-groove 9. The tongue has in this embodiment also a lower part 54, which is essentially parallel with the horizontal plane HP, and which extends from the vertical plane along a distance TD of more than 0.2 times the floor thickness T. The tongue has in this embodiment a space 55 between the lower part of the tongue and the tongue groove which facilitates the locking and allows that the guiding surfaces 11,12 are overlapping at a high angle of for example 15 degrees as shown in FIG. 19*b*.

Figure 20A:
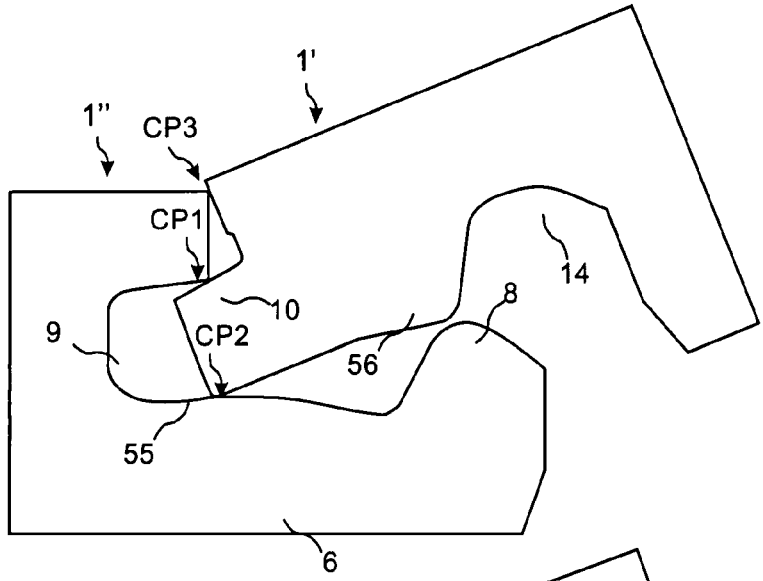
FIGS. 20*a-c* show alternative embodiments with four contact points at an angle of 20 degrees according to the invention.
Figure 20B:
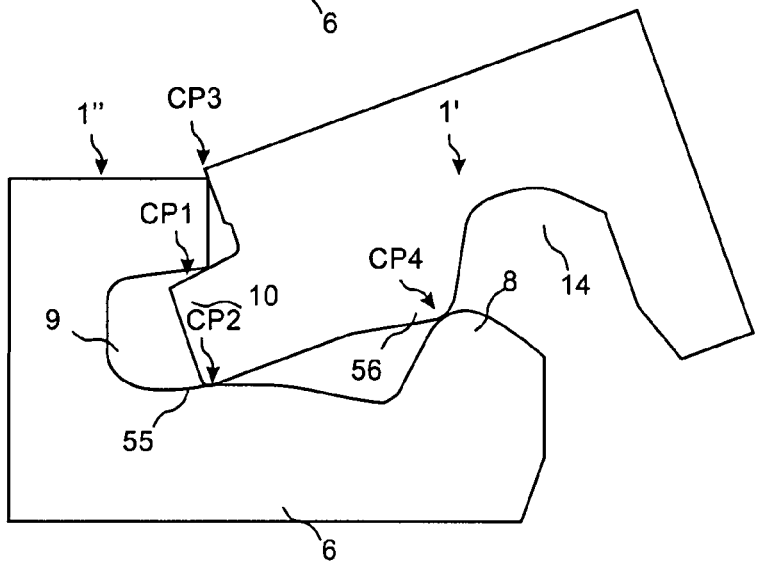
Figure 20C:
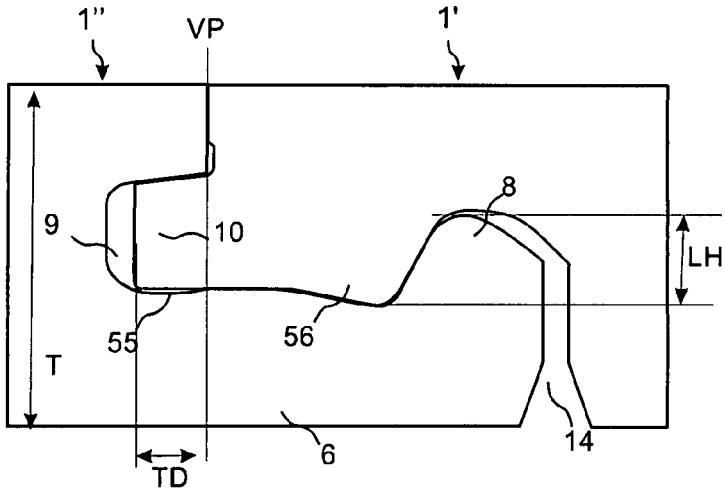

FIG. 20*a-c* show that it is possible to design a locking system with three contact points CP3, CP1 and CP2 at an installation angle of 25 degrees as shown in FIG. 20*a*. The locking element has been made even higher (LH) than in the previous embodiments and the groove panel 1' has a protrusion 56 between the tongue 10 and the tongue groove 9. The upper portion of the tongue has an angle against the horizontal plane and this facilitates machining with large rotating tools of the tongue groove 9.

A simple vertical locking on the short edge does not give any major improvement over the present technology if it is not combined with a well functioning long edge locking system with superior guiding and locking properties that allow a connection of long and short edges with a simple angling action. As can be seen from the embodiments shown in for example FIGS. 10*b*, 11*a*, 17*a*, 13*c* 18*b*, 19*b* and 20*b*, it is possible to form a locking system with a combined friction angle and guiding angle and with a locking element 8 and a locking groove 14 that holds the folding panel in an angled up position. The only action, which is than required to lock the panels, is a vertical pressing on the folding panel close to the short edges.

The invention provides, based on this principle, an installation method of three panels where the first 1" and the second panel 1 is laying flat on the sub floor with the long edges connected to each other as for example shown in FIG. 7*a*. The method comprises the steps of a) bringing a new panel 1' in an angled position with a long edge 5*a* in contact with the upper part of a long edge 5*b* of the first panel 1" and b) bringing a short edge 4*b* of the new panel 1' in contact with a short edge 4*a* of the second panel 1 such that the new panel 1' is maintained in this position by the locking system on the long and/or short edges. The new panel 1' could be maintained in this position by the guiding surface of the locking element and the locking groove as shown in FIG. 10*a* and/or by the edge of the flexible tongue.

c) pressing a short edge section of the new panels downwards towards the floor and thereby connection the first, second and third panel to each other with vertical folding preferably without substantial visible gaps between the short edges.

This installation method allows that floor panels will be maintained in an angled up position by for example the guiding surfaces 11,12 as shown in FIG. 10. This will facilitate installation since the installer could change hand position from a first position where the panel is brought into an installation angle of 25 degrees, pressed towards the edge of the already installed first panel 1" and preferably angle down slightly to the friction and guiding angle. The installer can then move his hands to a second position suitable to press down preferably both short edge section of panel towards the sub floor. The guiding surfaces will guide the locking element into the locking groove and the tongue in the tongue groove. The friction between long edges will prevent displacement. The advantage is that the combined actions of pressing together upper edges in an angle, pressing the panel sideways to avoid separation of short edges and folding down the panel to the floor, could be avoided and replaced by two or three separate and simple independent actions.

Figure 21A:
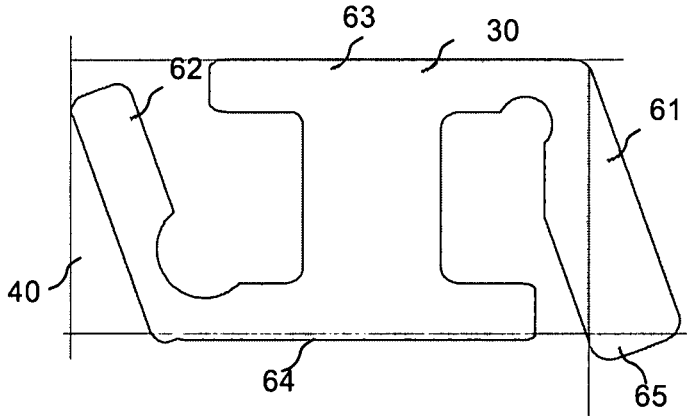
FIGS. 21*a-d* show a flexible tongue with two flexible parts
Figure 21B:
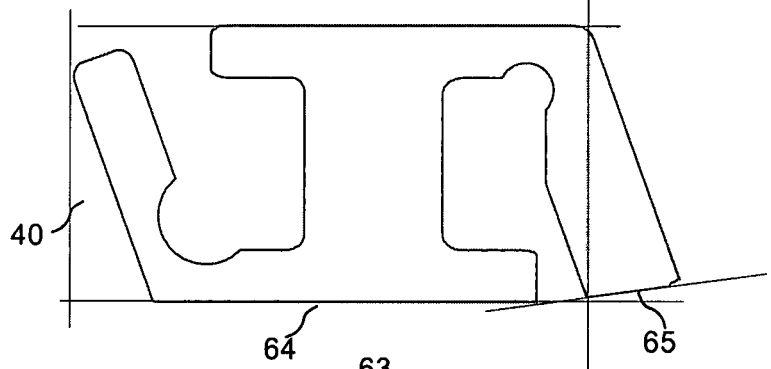
Figure 21C:
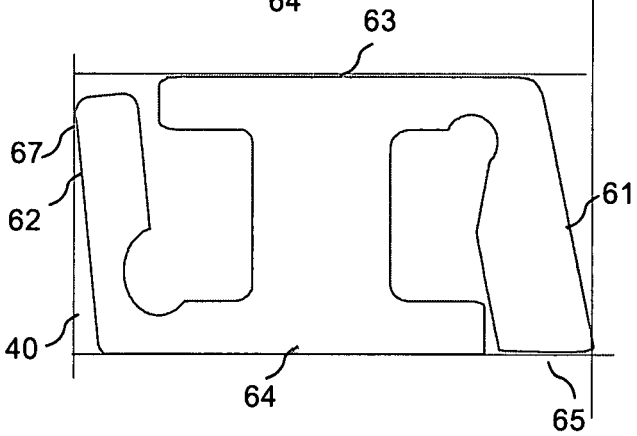

FIGS. 21*a-c* show a flexible tongue 30 with an inner 62 and an outer 61 flexible part. Flexible tongues as shown in FIGS. 5*a*-5*c* suffers from the following disadvantages 1. They are generally made from an extruded plastic section that is cost effective but the production tolerances are not sufficient to obtain a high quality locking.

2. The flexibility is not sufficient due to the fact that only one flexible snap tab is used that bends over a very limited vertical distance in thin floorboards. This low flexibility creates substantial separation forces of the edges.
3. It is difficult to combine flexibility and locking strength especially in flexible tongues as shown in FIGS. 5*a, b*. The embodiment according to the invention reduces or eliminates the above-mentioned problems. The inner flexible part 62 is not a part of the vertical locking and could therefore be made very flexible since its main function is to displace the flexible tongue 30 in a displacement groove. The upper part 67 of the inner flexible part will be pressed against an inner part of a displacement groove and will be bended or compressed as soon as an edge of a floor panel is pressed against the outer flexible part 61. It is proffered that the outer part 61 is more rigid and stronger than the inner part 62. The combined flexibility of the inner and outer parts could be designed to give a stronger locking with less separation force than the known tongues. The flexible tongue 30 could of course have one or several for example W-shaped inner parts and/or outer parts extending vertically up or down and this could be used to create more flexibility and displacement. Such tongue could also be made with a rigid outer part that is not bendable. The tongue could be connected to the folding panel. The outer flexible part 61 will in such an embodiment extend vertically upwards and lock against an upper part of a tongue groove.

Figure 21D:
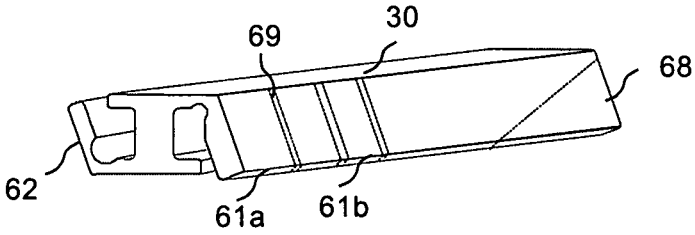

FIG. 21*b* shows that an extruded tongue made of for example plastic or metal could be equalized by for example machining or grinding. This will improve production tolerances considerably to a level similar to injection moulding or even better. Displacement, locking function and locking strength could be improved considerably. In the shown embodiment the lower contact surface 64 and/or the locking surface 65 has been equalized prior to the insertion into the displacement groove 40. A part of the flexible tongue, preferably the outer flexible part 61 could be equalized when the tongue is or has been connected to the edge. This could be obtained in a separate production step or in line when the locking system is formed. The flexible tongue could be designed such that it bends horizontally in the length direction during vertical folding. Such bending will be facilitated and separation forces will be reduced if a tongue section 68 at an edge as shown in FIG. 21*d* is removed. This means that the width W of the tongue 30 will vary along the length L. Such tongue section could also be removed from the inner resilient part 67 and the tongue will bend in the length direction with less resistance and facilitate the vertical folding. Such forming with a cut of part at an edge section could be made in all types of extruded tongues especially in such tongues that have a limited flexibility, for example the embodiment with only one outer resilient or flexible part as shown in FIGS. 5*a*, 5*b* and 6*c*. The flexible tongue could also be designed according to the hinge principle with a rigid protrusion and a flexible knee joint such that it does not bend horizontally during locking. Such embodiment could give a strong locking. Considerable separation forces could however occur. This could be counteracted for example with an embodiment that comprises several inner or outer individual flexible parts 61*a*, 61*b* which are separated with a cut 69 made by for example punching or machining. Such individual flexible parts could snap individually and this will make it possible to reduce production tolerances especially if the tongues are made with individual flexible parts that have lengths which for example could vary some 0.1 mm and that are designed to lock at specific predetermined levels in relation to each other. This ensures that some individual flexible parts always will be in a perfect locked position. Individual separate parts could be combined with a flexible tongue that is connected in a fixed manner to the panel edge, preferably into a groove extending horizontally.

The invention comprises also a separate extruded flexible tongue designed to be used for vertical locking of floorboard characterized in that such a tongue has been equalized preferably on an upper 63 and/or lower 64 contact surface and/or on a locking surface 65. Such a tongue and the above described tongue with a removed edge section could also have a shape similar to the shapes shown in FIGS. 5*a*-5*c* where the flexible tongue comprises only an inner or an outer flexible snap tab.

Machining, grinding and similar production steps will generally create a surface that differs from the extruded virgin surface. This could in most cases be detected in a microscope. Such machining could also be used to increase or decrease friction between the tongue and the displacement groove.

Figure 22A:
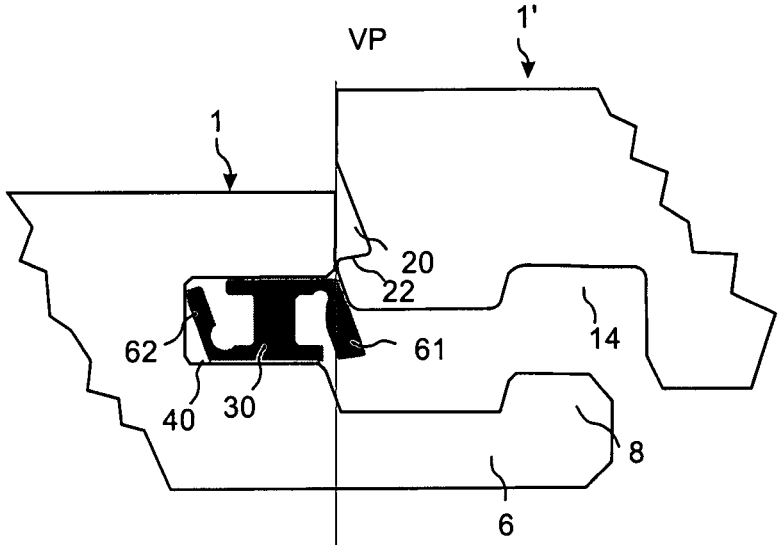
FIGS. 22*a-c* show installation of panels with a flexible tongue according to the invention
Figure 22B:
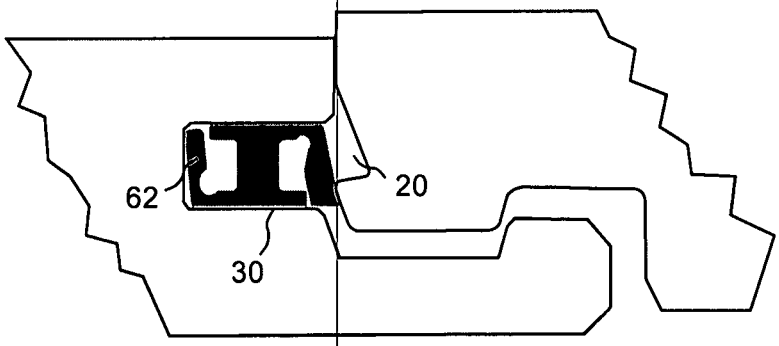
Figure 22C:
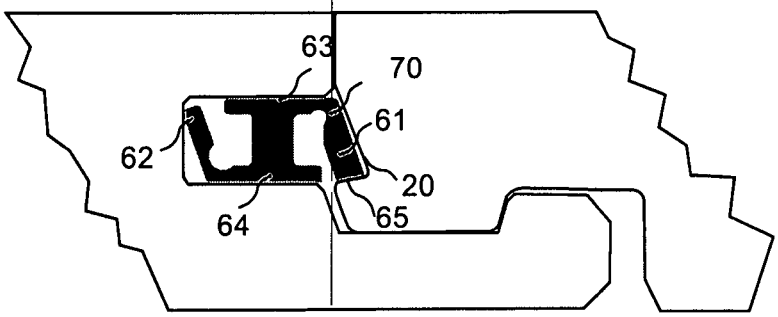

FIGS. 22*a*-22*c* shows vertical folding or vertical locking. One panel 1' is moved preferably along the vertical plane VP towards another panel 1. The inner flexible part 62 will be bended vertically when an edge section of the folding panel 1' comes in contact with an outer part of the flexible tongue 30, preferably the outer flexible part 61, and the flexible tongue will be displaced inwardly into the displacement groove 40 where it is connected preferably with a friction connection. Gradually even this outer flexible part 61 will start to bend as shown in FIG. 22*b*. Finally both the inner 62 and the outer parts 62 will snap back towards its initial positions and the flexible tongue will be displace in the displacement groove 40 towards the tongue groove 20. The locking surface 65 of the flexible tongue 30 will lock against a part of a tongue groove 20. The connection between the tongue and the displacement groove could be made with a small play allowing easy displacement and some tilting of the tongue during locking. The outer flexible part 61 is preferably during locking mainly displaced horizontally with a minor turning around the upper knee 70. The lower contact surface 65 could be made with an angle, which is preferably less than 10 degrees against the horizontal plane and this will increase the locking strength.

Figure 23A:
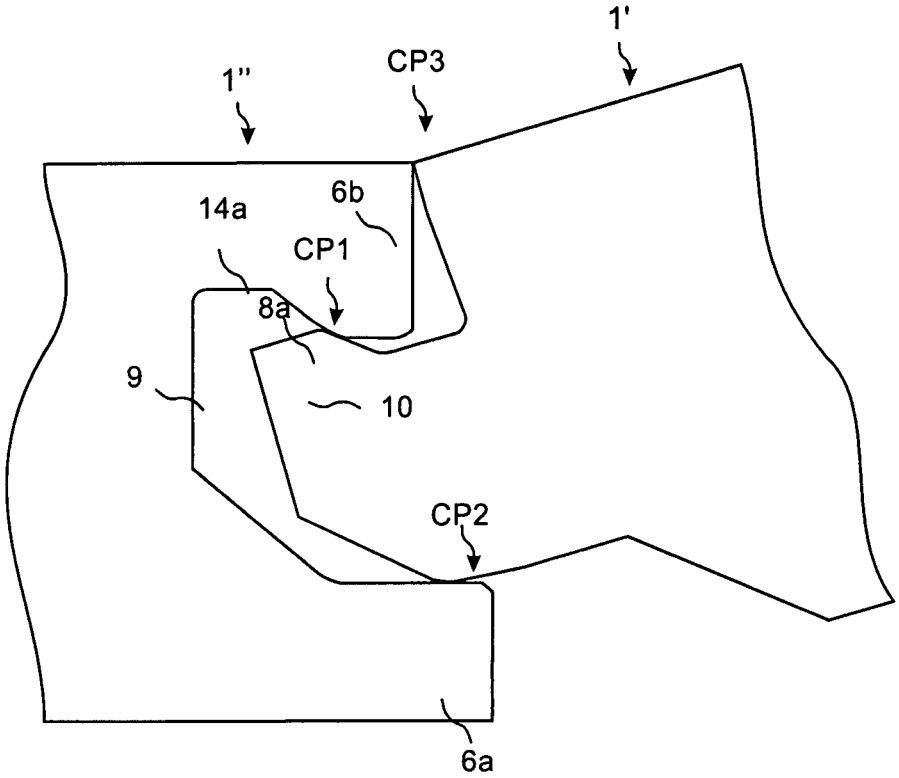
FIGS. 23*a-b* show a tongue lock system
Figure 23B:
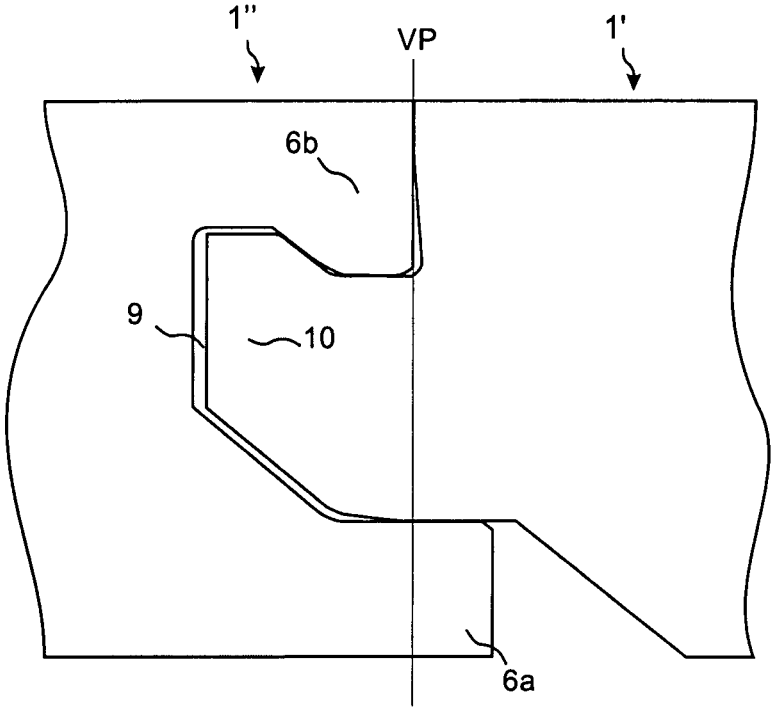

FIG. 23*a* show a tongue lock system, which could be locked with angling. The new panel 1' has a first connector comprising a tongue 10 with a locking element 8*a* at the upper part. The first panel 1" has an undercut tongue groove 9 with an upper 6*b* and lower 6*b* lip and a locking groove 14*a* formed in the upper lip 6*b* and extending downwards towards the lower lip 6*a*. The first and second connectors lock the panels vertically and horizontally. The lower lip 6*a* extends preferably beyond the vertical plane VP and has preferably a horizontal contact surface, which is in contact with a lower part of the tongue 10. The locking system could for example be designed such that it has three contact points CP1,2,3 at an angle exceeding 15 degrees as shown in FIG. 23*a*. The tongue lock could be used as an alternative to the strip lock systems in all embodiments described above. A tongue lock on long edges could be combined with a hook system on the short edges, which preferably only locks horizontally as shown in FIG. 24*d*.

Figure 24A:
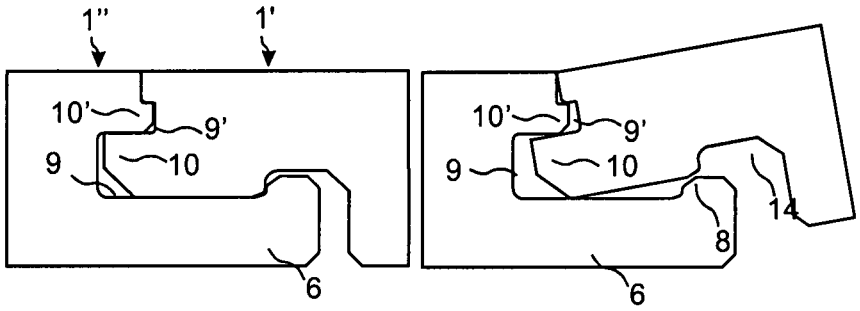
FIGS. 24*a-e* show locking system that could be used in the invention

FIG. 24*a* shows a locking system with a double tongue 10, 10' and two corresponding tongue grooves 9,9' which could be used to lock the long edges with angling, snapping or even vertical locking if the tongues and the strip is adjusted to allow a vertical snap action. Such system could have more than four contact points and the friction along the joint could be considerable.

Figure 24B:
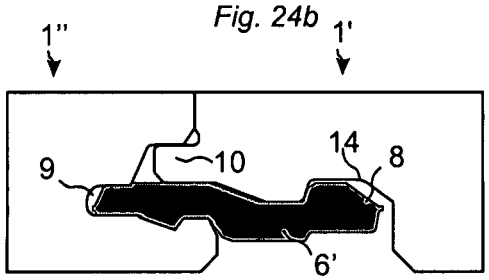
Figure 24D:
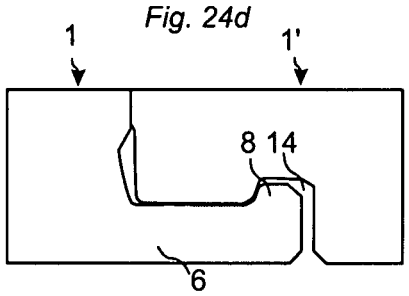

FIG. 24*b* shows a locking system with a separate strip 6' which also could be used to lock the long edges in the same way as the embodiment in FIG. 24*a*. Such a strip could comprise a material or a surface that has more favourable friction properties than the core material.

Figure 24C:
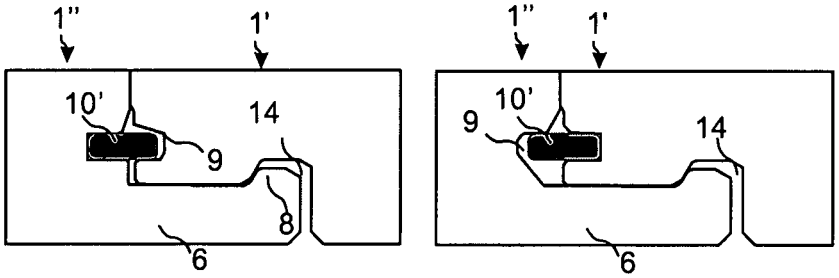

FIG. 24*c* shows a locking system with a separate tongue 10' that could be flexible or rigid and that could be connected to the strip panel 1" or the folding panel 1' on long and/or short edges in order to improve friction properties or to save material.

FIG. 24*d* shows a hook system, which only locks horizontally.

Figure 24E:
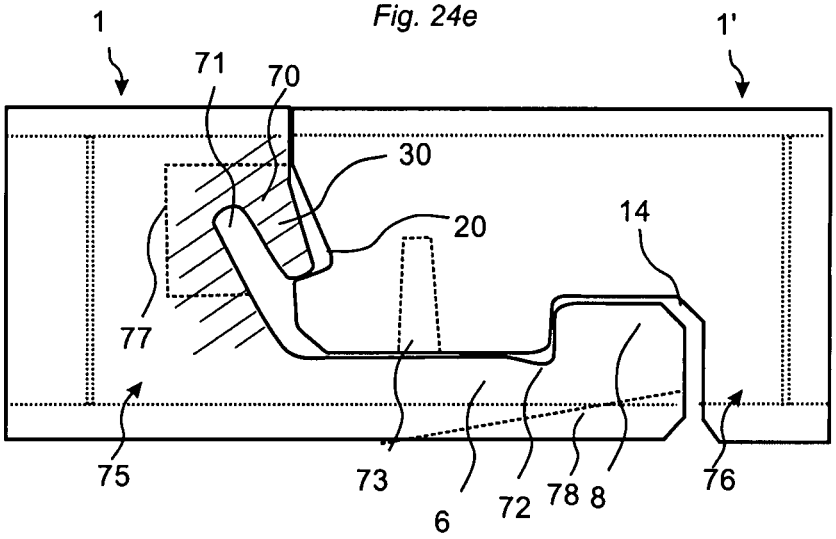

FIG. 24*e* show an embodiment of a locking system with a flexible tongue 30 made in one piece with the core. An undercut groove 71, which is formed behind the flexible tongue 30, could increase the flexibility of the tongue. Such a groove could be formed, preferably by a scraping tool, when the short edges are machined. Such scraping or broaching technology could be used to form advanced shapes similar to extruded plastic sections especially in fibre-based material such as HDF but even in solid wood and plastic materials. The flexible tongue 30 could also be formed with large rotating tools on the folding panel 1' with an outer part that extend upwards. The locking system could also have two flexible tongues—one on each edge. Wood fibres in the flexible tongue could be impregnated and/or coated with for example a binder 70 in order to increase the strength and flexibility. Impregnation could be made prior or after the forming of the tongue or the edge. The whole edge or parts of the locking system for example the tongue groove 20, the locking element 8 or the locking groove 14 could also be impregnated and/or coated. The undercut groove could be filled with flexible materials in order to improve strength and flexibility. Vertical folding could be facilitated if the strip 6 and/or the locking element 8 could flex during the vertical folding. Wax in the locking system will facilitate locking. A essentially vertical groove 73, above the strip in the folding panel 1' or a cavity 72 in the strip 6 adjacent to the locking element 8 in the strip panel 1 1 will increase the flexibility of the locking further system and allow parts to be more flexible. Parts 78 of the lower side of the strip and/or balancing layer could be removed and this could increase the flexibility of the strip and allow easier bending towards the sub floor. The folding panel could have a protrusion 74 and preferably also locking surfaces of the type as described in FIG. 27*c*. The flexible tongue could also be formed from a separate material, which is fixed connected to the panel by for example gluing, friction or snapping. Such separate material could for example be a rather local edge portion 77 that could be connected to the edge prior to the final machining. The undercut grove 71 could also be preformed before the separate material 77 is connected to the edge of the panel. Such a connection could be made on individual panel edges or to a panel board that is thereafter cut to individual floor panels. The separate material 75, 76 could also be connected to the edge of the strip panel 1 and/or the folding panel 1' such that it comprises a major parts of the locking system. Such separate material could in a wood floor preferably be glued to the upper top layer and the lower balancing layer. Separate materials could comprise of for example solid wood which is preferably hard and flexible such as rubber wood or birch, wood impregnated with binders, for example acrylic binders, plastic materials, compact laminate made of wood fibre material and phenol which also could comprise glass fibre, HDF or HDF reinforced by binders, HDF with essentially a vertical fibre orientation, materials with several layers comprising wood fibres and/or plastic materials and/or glass fibre. Such materials could be used separately or in combinations. The locking system could of course also be made according to the principles described above without the undercut groove 71, for example according to the embodiment described in FIG. 5*e* if appropriate materials and joint configurations are used to allow the required flexibility.

A lot of chemicals could be used to impregnate or to coat parts or the whole locking systems such as melamine, urea, phenol, thermoplastic materials such as PP or PUR. Such chemicals could be cured with for example heat, microwave, UV or similar with or without pressure.

The flexible tongue 70 could in a standard HDF material flex a few tenths of a millimetre and this could be sufficient to obtain a vertical locking especially in a laminate floor. Impregnation and/or coating could increase this flexibility considerably.

According to the invention a preferred embodiment comprising a short edge locking system is provided that could be locked with vertical folding or vertical locking and that is characterized in that the locking system comprises an edge with a strip 6, a locking element 8, a flexible tongue 30 extending downwards and formed in one piece with a panel core or in a separate material which iud connected in a fixed manner to the core. The flexible tongue 30 comprises an undercut groove 70 formed behind the tongue.

Figure 25A:
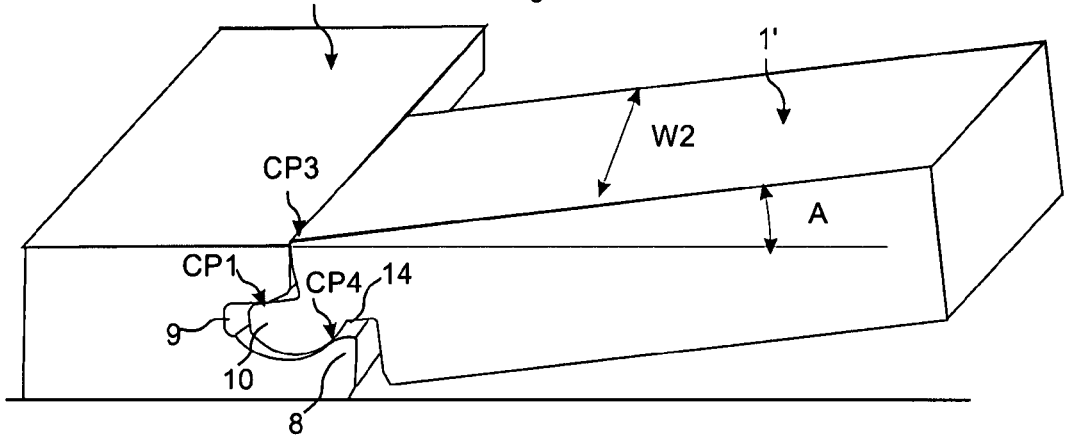
FIGS. 25*a-c* show methods to measure contact points
Figure 25B:
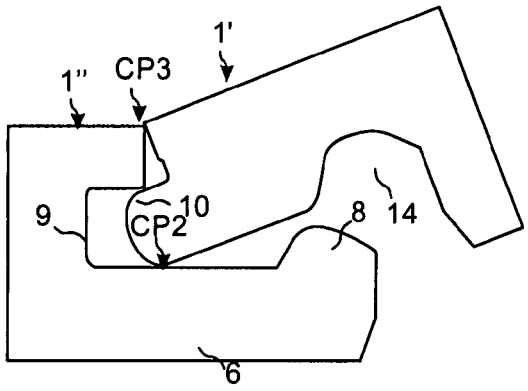
Figure 25C:
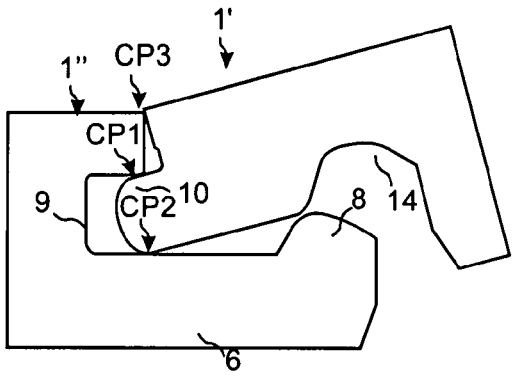

FIGS. 25*a-c* shows how the highest three point contact angle could be correctly determined in a locking system mainly made in a wood fibre based core material. There are several hundred different locking systems on the market used to connect laminate floorings only. In most of them it is rather easy to measure the highest three point contact angle. This is shown in FIG. 25*a*. A sample with a width W2 and length of about 100 mm is angled down from an installation angle with top edges in contact until a resistance occurs from the contact between the locking groove and the locking element. The sample should in this position, which is the highest three point contact angle, be able to maintain it's up angled position and it should not fall down to the sub-floor due to the weight of the sample. Such a locking system has a design, which is characterized in that the three points are the upper edges CP3, the upper part of the tongue and the groove CP1 and the locking element/locking groove CP4. A locking system could however have a design as showed in FIGS. 25*b,c* where the three contact points are the upper and lower parts of the tongue together with top edges (CP1, CP2, CP3). Some of such locking systems will however not stand up in an up angled position. In such systems a cross section of a joint should be analysed in a microscope. If lose fibres makes it difficult to define a three point contact angle, friction should be measured as described in FIG. 16. Increased friction is an indication that an additional contact point is active in the locking system.

Figure 26A:
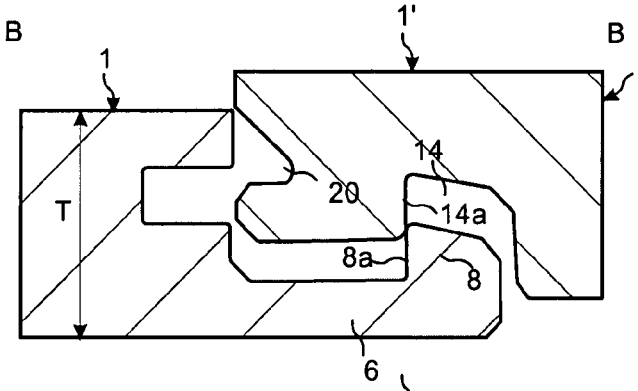
FIGS. 26*a-d* show embodiments of the invention with vertical locking surfaces
Figure 26B:
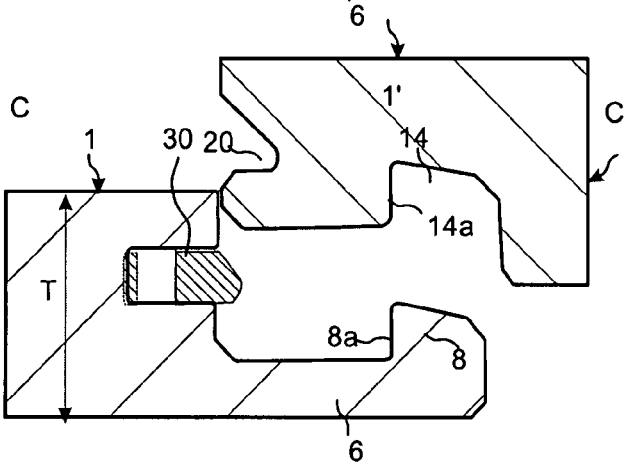
Figure 26C:
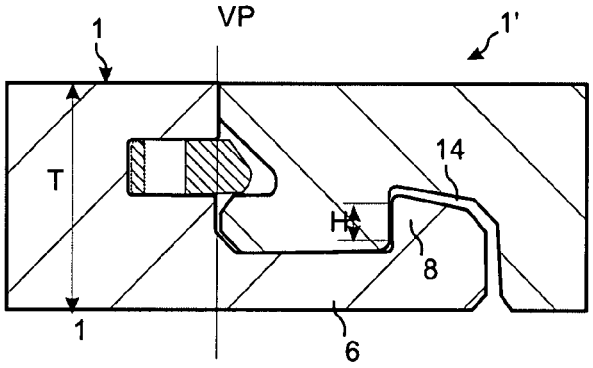

FIGS. 26*a*-26*d* shows an embodiment of a locking system at the short edges that counteracts or prevents displacement of the long edges during vertical folding. FIG. 26*a* show a cross section B-B of a short side locking system close to the edge part where the folding starts, as shown in FIG. 4*a*. This locking system, as described before in connection to for example the FIGS. 1-3, 5, and 8, comprises a strip 6 with a locking element 8 and a separate flexible tongue 30 in a strip panel 1, a tongue groove 20 and a locking groove 14 in the folding panel 1'. The locking surfaces are essential vertical and parallel with the vertical plane VP. Preferably this locking system could be designed such that the locking element 8 with its upper part of the locking surface 8*a* is in contact with the lower part of the locking surface 14*a* of the locking groove 14 as shown in FIG. 26*a*, when there are no contacts between the fold panel 1' and the flexible tongue 30. This could be accomplished due to the fact that there is no tongue part close to the long edge or that the tongue is bow shaped and has no protruding part that is in contact with the folding panel 1'. FIG. 26*b* shows a cross cut at C-C in FIG. 4*a*. The locking surfaces 8*a*,14*a* will prevent separation when the tongue 30 is in contact with the fold panel provided that they are essentially and preferably completely vertical and that they extend vertically along a considerable distance so that they could prevent displacement at a angle of preferably 10 degrees or higher, even in an embodiment where the flexible tongue 30 is positioned close to the long edge. The locking surfaces should preferably have a height H which is at least 0.1 or even more than 0.15 time the floor thickness T. Vertical locking surfaces could also be made with a height H of about 0.2*T or more.

Figure 26D:
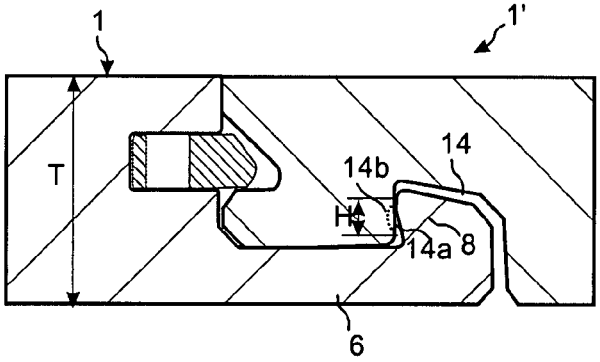

Several alternatives are possible within the main principle of this invention. FIG. 26*d* shows that the function could be equivalent if only the locking surface 14*a* of the locking groove 14 meets the requirements above. The function could also be the same if the locking groove 14*b* is for example bow shaped towards the outer edge, provided that there are at least two parts which are located vertically along a vertical plane and that the distance is about 0.1*T.

Figure 27A:
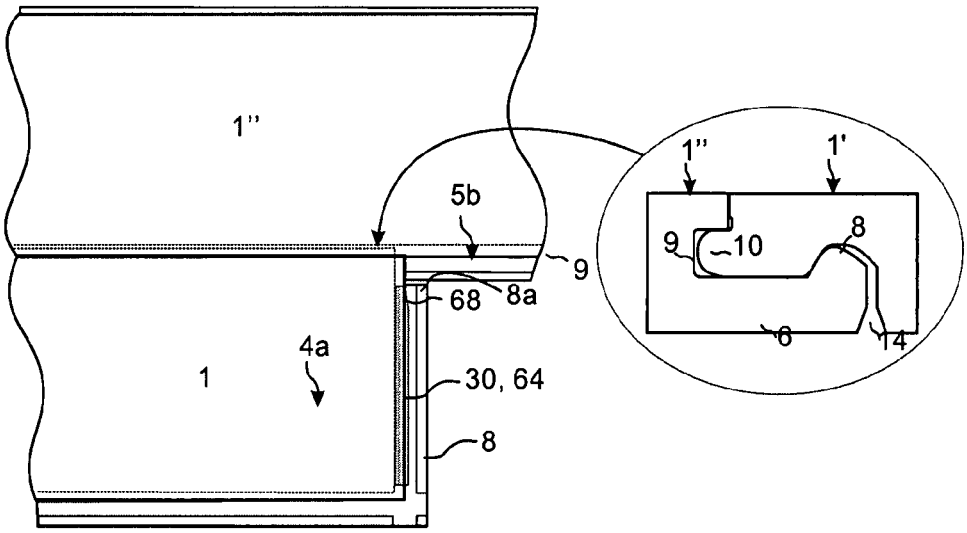
FIGS. 27*a-c* show locking systems on long and short edges according to the invention

FIG. 27*a* shows an embodiment where the locking element 8 and the locking groove 14 on the short edge is used to prevent separation. It is an advantage if the edge 8*a* of the locking element 8 is located close to the long edge 5*b* of the first panel 1" since this edge will grip into the locking groove of the new panel at a rather high angle and the flexible tongue could be positioned such that it locks close to the long edge. The flexible tongue 30 is in this embodiment an extruded section with a cut of edge section 68 that facilitates horizontal displacement during folding. High and vertical locking surfaces on the short edges are especially suitable in locking systems with a flexible tongue comprising an extruded plastic section and especially if such a section has only one outer flexible snap tab that due to limited flexibility causes a considerable separation pressure.

Figure 27B:
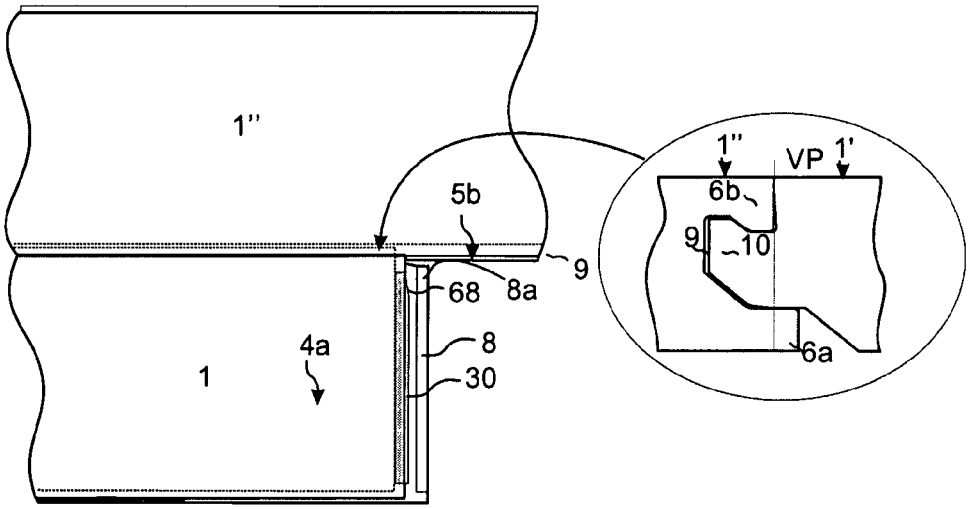

FIG. 27 shows that the flexible tongue 30 could be moved even further towards the long edge 5*b* and prevent displacement along the long edge at an even higher angle if a compact tongue lock system is used on the long edges since such a locking system does not comprise a strip 6*a* protruding far beyond the vertical plane VP.

Figure 27C:
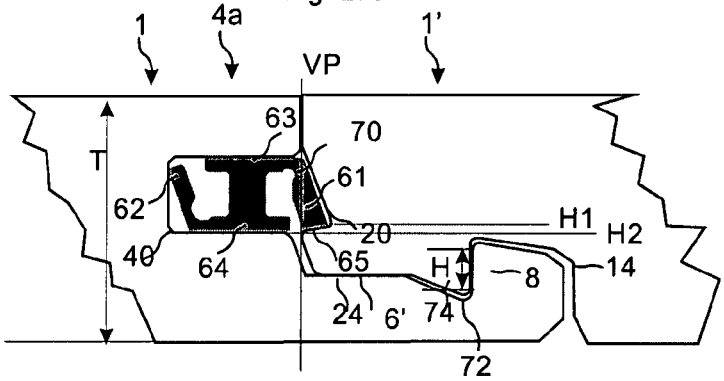

FIG. 27*c* show a locking system with a preferably extruded and flexible tongue 30 and essentially vertical locking surfaces between the locking element 8 on the strip 6 and the locking groove 14 in the folding panel 1'. The folding panel 1' comprises a protrusion 74 adjacent to the locking surface of the locking groove 14 that is received in a adjacent cavity 72 on the strip 6 and preferably an essentially horizontal lower contact surface 24 that locks vertically against an adjacent strip contact surface 6'. This configuration is very suitable in flooring with a HDF core since the cavity is formed in the lower part of the core where the density is high. The cavity will only to a limited extent decrease the strength of the locking system. The height H of the vertical locking surfaces is preferably at least 0.1*T. In order to avoid cracks when the floor shrinks and to facilitate the fixing of the separate tongue 30 into the displacement groove 40, the design of the locking system is preferably such that the locking element 8 is located below a horizontal plane H2 that comprises the lower part of the displacement groove 40 and the locking groove 14 is located under a horizontal plane H1 that comprises the inner part and lowest part of the tongue groove 20.

The invention is not limited to the abovementioned illustrative embodiments, but is naturally applicable to other embodiments within the scope of the following patent claims, and equivalents thereof.

The invention claimed is:

1. A set of essentially identical floor panels each comprising long and short edges together provided with first and second connectors, the connectors are integrated with the floor panels and configured to connect adjacent edges, the first connector comprises a locking strip with an upwardly directed locking element at an edge of one floor panel and a downwardly open locking groove at an adjacent edge of another floor panel for connecting the adjacent edges horizontally in a direction perpendicular to the adjacent edges, the second connector comprises a tongue at an edge of one floor panel, extending horizontally perpendicular to the edge and a horizontally open tongue groove in an adjacent edge of another floor panel for connecting the adjacent edges in vertical direction, the connectors at the long edges are configured to be locked with angling and the connectors at the short edge are configured to be locked with vertical folding, whereby a long edge of a new panel in a second row is configured to be connected to a long edge of a first panel in a first row by angling, whereby a short edge of the new panel and a short edge of a second panel in the second row are configured to be connected with the same angle motion wherein when the new panel is pressed with its upper edge of a long edge against the upper edge of a long edge of the first panel at an angle against the principal plane of at least about 10 degrees, the connectors of the long edges have at least three separate contact points between adjacent parts of the connectors, the contact points being in a single cross-sectional plane of the adjacent long edges, the plane extending from a rear face of the floor panels to a front face of the floor panels.

2. The set of floor panels as claimed in claim 1, wherein the long edges have at least four contact points.

3. The set of floor panels as claimed in claim 2, wherein the long edges have vertical upper and lower contact points and horizontal inner and outer contact points between adjacent surfaces of the first and second long edges when the new panel is pressed with its upper edge against the upper edge of the first panel at an angle against the principal plane between about 0 to about 10 degrees.

4. The set of floor panels as claimed in claim 1, wherein the second connector at the short edges comprises a tongue comprising a separate material, and the tongue is provided with a flexible part which is configured to be displaced horizontally during the folding and to cooperate with the tongue groove in the adjacent short edge for locking the floor panels together in a vertical direction parallel to the vertical plane.

5. The set of floor panels as claimed in claim 4, wherein the tongue at the short edge has a bow shaped part, when viewed from a plan view, and is flexible in the length direction.

6. The set of floor panels as claimed in claim 4, wherein the tongue at the short edge is provided with flexible protrusions.

7. The set of floor panels as claimed in claim 4, wherein the tongue at the short edge is connected to the short edge in a connection groove, wherein an inner part of the tongue is horizontally displaceable in the connection groove during folding of a panel.

8. The set of floor panels as claimed in claimed in claim 4, wherein the flexible part is a snap tab.

9. The set of floor panels as claimed in claim 8, wherein the flexible part is a snap tab on the strip panel, the snap tab being bendable around a center point located at an upper part of the tongue during locking of the floor panels and where the snap tab is extending downwards from the center point.

10. The set of floor panels as claimed in claim 1, wherein the angle is at least about 15 degrees.

11. The set of floor panels as claimed in claim 1, wherein the tongue includes a top surface facing in a direction of a front face of the one floor panel and a bottom surface facing in a direction of a rear face of the one floor panel, and at least two of the three contact points are on the top and bottom surfaces, respectively, of the tongue.

12. A set of essentially identical floor panels each comprising long and short edges together provided with first and second connectors, the connectors are integrated with the floor panels and configured to connect adjacent edges, the first connector comprises a locking strip with an upwardly directed locking element at an edge of one floor panel and a downwardly open locking groove at an adjacent edge of another floor panel for connecting the adjacent edges horizontally in a direction perpendicular to the adjacent edges, the second connector comprises a tongue at an edge of one floor panel, extending horizontally perpendicular to the edge and a horizontally open tongue groove in an adjacent edge of another floor panel for connecting the adjacent edges in vertical direction, the connectors at the long edges are configured to be locked with angling and the connectors at the short edge are configured to be locked with vertical folding, whereby a long edge of a new panel in a second row is configured to be connected to a long edge of a first panel in a first row by angling, whereby a short edge of the new panel and a short edge of a second panel in a second row are configured to be connected with the same angle motion wherein the tongue at the short edges comprise a separate material and is being arranged in a connection groove and that said tongue is provided with a flexible part with an edge section located closest to the long edge of the first panel, the edge section is configured to be displaced horizontally during the folding and to cooperate with the tongue groove of an adjacent short edge for locking the floor panels together in a vertical direction, wherein the tongue at the long edge includes a top surface facing the front face of the floor panels and an opposing bottom surface facing the rear face of the floor panels, and the tongue at the long edge is configured so that there is a space extending from a proximal portion to a distal portion of the bottom surface of the tongue and between the bottom surface of the tongue and the locking strip at the long edge during locking of the long edges of the floor panels, and the first and second connectors at the long edges are configured such that a friction force along the long edges is lower in an installation angle than in a contact angle when the panels are pressed against each other with the same pressure force and with the upper joint edges in contact, whereby the installation angle is about 25 degrees and the contact angle is a lower angle corresponding to an initial contact between the edge section and the adjacent short edge.

13. The set of floor panels as claimed in claim 12, wherein the long edges at the contact angle have at least three contact points, the contact points being in a single cross-sectional plane of the adjacent long edges, the plane extending from a rear face of the floor panels to a front face of the floor panels.

14. The set of floor panels as claimed in claim 13, wherein the long edges have vertical upper and lower contact points and horizontal inner and outer contact points between adjacent surfaces of the first and second long edges when the new panel is pressed with its upper edge against the upper edge of the first panel.

15. The set of floor panels as claimed in claim 12, wherein the tongue at the short edge is provided with a bow shaped part, when viewed from a plan view, and is flexible in the length direction.

16. The set of floor panels as claimed in claim 12, wherein the tongue at the short edge is provided with flexible protrusions.

17. The set of floor panels as claimed in claim 12, wherein the tongue at the short edge is connected to the short edge in a connection groove, wherein an inner part of the tongue is horizontally displaceable in the connection groove during folding of a panel.

18. The set of floor panels as claimed in claim 12, wherein the flexible part is a snap tab.

19. The set of floor panels as claimed in claim 18, wherein the flexible part is a snap tab on the strip panel, the snap tab being bendable around a center point located at an upper part of the tongue during locking of the floor panels and where the snap tab is extending downwards from the center point.

20. The set of floor panels as claimed in claim 12, wherein the contact angle is at least about 10 degrees.

21. The set of floor panels as claimed in claim 12, wherein the core of the panels comprise HDF.

22. The set of floor panels as claimed in claim 12, wherein the panel has a thickness of about 6-9 mm.

23. The set of floor panels as claimed in claim 12, wherein the panel has a length not exceeding about 120 cm.

24. The set of floor panels as claimed in claim 12, wherein the panel has a width exceeding about 20 cm.

25. A set of essentially identical floor panels each comprising long and short edges together provided with first and second connectors, the connectors are integrated with the floor panels and configured to connect adjacent edges, the first connector comprises a locking strip with an upwardly directed locking element at an edge of one floor panel and a downwardly open locking groove at an adjacent edge of another floor panel for connecting the adjacent edges horizontally in a direction perpendicular to the adjacent edges, the second connector comprises a tongue at an edge of one floor panel, extending horizontally perpendicular to the edge and a horizontally open tongue groove in an adjacent edge of another floor panel for connecting the adjacent edges in vertical direction, the connectors at the long edges are configured to be locked with angling and the connectors at the short edge are configured to be locked with vertical folding, whereby a long edge of a new panel in a second row is configured to be connected to a long edge of a first panel in a first row by angling, whereby a short edge of the new panel and a short edge of a second panel in the second row are configured to be connected with the same angle motion wherein the tongue at the short edge is made of a separate material and connected to a connection groove and that said tongue has a flexible part configured to be displaced horizontally during the folding and to cooperate with the tongue groove of an adjacent short edge for locking the floor panels together in a vertical direction, wherein the tongue at the long edge includes a top surface facing the front face of the floor panels and an opposing bottom surface facing the rear face of the floor panels, and the tongue at the long edge is configured so that there is a space extending from a proximal portion to a distal portion of the bottom surface of the tongue and between the bottom surface of the tongue and the locking strip at the long edge during locking of the long edges of the floor panels, and whereby the connectors on long and short edges are configured such that the second and new panel, whereby one of said panels, cut to a length of about 20 cm, is not displaced away from the other panel when said panels are in a contact position at an installation angle and during the vertical folding.

26. The set of floor panels as claimed in claim 25, wherein the long edges at a contact angle have at least three contact points, the contact points being in a single cross-sectional plane of the adjacent long edges, the plane extending from a rear face of the floor panels to a front face of the floor panels.

27. The set of floor panels as claimed in claim 26, wherein the long edges have vertical upper and lower contact points and horizontal inner and outer contact points between adjacent surfaces of the first and second long edges when the new panel is pressed with its upper edge against the upper edge of the first panel.

28. The set of floor panels as claimed in claim 25, wherein friction means are provided in the long edge locking system.

29. The set of floor panels as claimed in claim 28, wherein friction means are small local protrusions.

30. The set of floor panels as claimed in claim 28, wherein friction means comprise a separate material applied in the locking system.

31. The set of floor panels as claimed in claim 30, wherein the separate material comprises wax.

32. The set of floor panels as claimed claim 25, wherein the tongue at the short edge is provided with a bow shaped part, when viewed from a plan view, and is flexible in length direction.

33. The set of floor panels as claimed in claim 25, wherein the tongue at the short edge comprises flexible protrusions.

34. The set of floor panels as claimed in claim 33, wherein the flexible part is a snap tab on the strip panel, the snap tab being bendable around a center point located at an upper part of the tongue during locking of the floor panels and where the snap tab is extending downwards from the center point.

35. The set of floor panels as claimed in claim 25, wherein the flexible part is a snap tab.

36. The set of floor panels as claimed in claim 25, wherein the core of the panels comprise HDF.

37. The set of floor panels as claimed in claim 25, wherein the panel has a thickness of about 6-9 mm.

38. The set of floor panels as claimed in claim 25, wherein the panel has a length not exceeding about 120 cm.

39. The set of floor panels as claimed in claim 25, wherein the panel has a width exceeding about 20 cm.

40. An installation method to connect floor panels with vertical folding whereby the panels have an angling locking system on the long edges and a vertical folding system on the short edges for locking the panels vertically and horizontally, whereby a first and a second panel are laying flat on a sub floor with the long edges connected to each other, wherein the method comprises the steps of:

a) bringing a long edge of a new panel in contact with the upper part of a long edge of the first panel so that the new panel in one plane is angled at an angle greater than zero relative to the first panel in another plane;

b) bringing a short edge of the angled new panel in contact with a short edge of the second panel, whereby the angled new panel is maintained at an angle greater than zero relative to the first panel by friction resulting from at least one contact point between the angled new panel and the first panel in the locking system on the long edges;

c) pressing a short edge section of the new panel downward towards the sub floor; and d) connecting the first, second and new panel to each other with vertical folding.

41. The method as claimed in claim 40, wherein the method comprises the step of bringing the panels to a position where the long edges have vertical upper and lower contact points and horizontal inner and outer contact points between adjacent surfaces of the first and second long edges while pressing the upper edge of the first panel against the upper edge of the new panel at an angle against the principal plane of about 10 degrees.

42. The method as claimed in claim 40, wherein the method comprises the step of bringing the panels to a position where the long edges have vertical upper and lower contact points and horizontal inner and outer contact points between adjacent surfaces of the first and second long edges while pressing the upper edge of the first panel against the upper edge of the new panel at a contact angle.

43. A flexible tongue for vertical locking of floorboards wherein the flexible tongue comprises a middle part, a first long edge and a second long edge, the first long edge being on an opposite side of the middle part, in a horizontal direction, as the second long side, the first long edge is configured to be located in an inner part of a groove formed in a panel edge, the first long edge comprises an inner flexible part extending from the middle part and which is configured to be displaced horizontally during folding of a panel, the second long edge is configured to be located at the outer part of the groove, the second long edge comprises an outer flexible part extending from the middle part and which is configured to be displaced horizontally during folding of a panel, the inner flexible part extending from the middle part in an opposing direction than a direction in which the outer flexible part extends from the middle part.

44. An extruded flexible tongue having a plurality of surfaces including extruded virgin surfaces and at least one equalized surface, and the flexible tongue is designed to be used for vertical locking of floorboards, wherein the tongue is equalized on less than all of the plurality of surfaces, and the at least one equalized surface differs from the extruded virgin surfaces by having a different frictional coefficient than the extruded virgin surfaces.

45. A set of essentially identical floor panels each comprising long and short edges together provided with first and second connectors, the connectors are integrated with the floor panels and configured to connect adjacent edges vertically and horizontally whereby the long edges are configured to be locked with angling and the short edges with vertical folding, wherein when one panel is pressed with its upper edge against the upper edge of another panel at an angle against the principal plane of at least about 10 degrees, the connectors of the long edges have at least three separate contact points between adjacent parts of the connectors, the contact points being in a single cross-sectional plane of the adjacent long edges, the plane extending from a rear face of the floor panels to a front face of the floor panels.

46. The set of floor panels as claimed in claim 45, wherein at least one of the connectors comprises a tongue including a top surface facing in a direction of a front face of a floor panel and a bottom surface facing in a direction of a rear face of the floor panel, and at least two of the three contact points are on the top and bottom surfaces, respectively, of the tongue.

47. A set of essentially identical floor panels each comprising long and short edges together provided with first and second connectors, the connectors are integrated with the floor panels and configured to connect adjacent edges vertically and horizontally whereby the long edges are configured to be locked with angling and the short edges with vertical folding, wherein the connectors at the long edge include a tongue and a locking strip, the tongue including a top surface facing the front face of the floor panels and an opposing bottom surface facing the rear face of the floor panels, and the tongue is configured so that there is a space extending from a proximal portion to a distal portion of the bottom surface of the tongue and between the bottom surface of the tongue and the locking strip during locking of the long edges of the floor panels, and wherein the first and second connectors on the long edges are configured such that a friction force along the long edges is lower in an installation angle than in a contact angle when the panels are pressed against each other with the same pressure force and with the upper joint edges in contact, whereby the installation angle is about 25 degrees and the contact angle is a lower angle corresponding to an initial contact between the edge section and the adjacent short edge.

48. A set of essentially identical floor panels each comprising long and short edges together provided with first and second connectors, the connectors are integrated with the floor panels and configured to connect adjacent edges at a vertical joint plane vertically and horizontally whereby the long edges are configured to be locked with angling and the short edges with vertical folding, wherein the vertical joint plane is at upper edges of the floor panels, and the connectors on the short edges have a first connector including a displaceable tongue in a sidewardly open groove, and a locking element, and a second connector including a tongue groove for receiving a tip of the displaceable tongue, and a locking groove for receiving the locking element, the sidewardly open groove and the locking element being on opposite sides of the vertical joint plane, and the short edges have locking surfaces between a locking groove and a locking element designed for horizontal locking of the short edges whereby the locking surfaces are essentially vertical and extend over a height which is at least about 0.1 times the thickness of the floor panel.

49. A short edge locking system for vertical and horizontal locking of adjacent edges of two similar floor panels allowing locking of the adjacent edges with vertical folding or vertical locking, wherein the locking system comprises an edge with a strip, a locking element, a flexible tongue spaced horizontally at a distance greater than zero from the locking element and formed in one piece with the core of one of the panels, wherein the locking element is disposed more distally on the edge than the flexible tongue, and the tongue extends downwards and comprises an undercut groove formed behind the flexible tongue, the undercut groove comprising a top wall and two opposing side walls, the top wall being closer to a front face of the floor panels than the two opposing side walls, and the two opposing side walls extending downwards from the top wall.

50. The short edge locking system as claimed in claim 49, wherein the undercut groove is filled with a flexible material.

51. The short edge locking system as claimed in claim 49, wherein the adjacent edges of two similar floor panels are joined after locking at a vertical joint plane which extends to the front face of the floor panels, and a majority of the flexible tongue is one side of the vertical joint plane, and the locking element is on an opposing side of the vertical joint plane.

52. The short edge locking system as claimed in claim 49, wherein the flexible tongue is configured to bend inside at least a part of the undercut groove.

53. The short edge locking system as claimed in claim 49, wherein the top wall is curved.

54. The short edge locking system as claimed in claim 49, wherein the two opposing side walls extend at an angle to a vertical plane.

* * * * *